US009388608B2

(12) United States Patent
Kreuser et al.

(10) Patent No.: US 9,388,608 B2
(45) Date of Patent: Jul. 12, 2016

(54) WINDOW LOCKING ARRANGEMENTS

(71) Applicant: Simonton Building Products LLC, Parkersburg, WV (US)

(72) Inventors: Christopher Kreuser, Westerville, OH (US); Joel Williamson, Newark, OH (US); Matthew A. Tosi, New Albany, OH (US)

(73) Assignee: SIMONTON BUILDING PRODUCTS LLC, Parkersburg, WV (US)

( * ) Notice: Subject to any disclaimer, the term of this patent is extended or adjusted under 35 U.S.C. 154(b) by 261 days.

(21) Appl. No.: 13/955,592

(22) Filed: Jul. 31, 2013

(65) Prior Publication Data

US 2014/0035297 A1 Feb. 6, 2014

Related U.S. Application Data

(60) Provisional application No. 61/677,676, filed on Jul. 31, 2012.

(51) Int. Cl.

| | |
|---|---|
| ***E05C 3/04*** | (2006.01) |
| ***E05C 3/00*** | (2006.01) |
| ***E05B 9/08*** | (2006.01) |
| *E05C 7/00* | (2006.01) |

(52) U.S. Cl.

CPC ..... *E05C 3/004* (2013.01); *E05B 9/082* (2013.01); *E05C 3/046* (2013.01); *E05C 2007/007* (2013.01); *Y10T 292/1083* (2015.04)

(58) Field of Classification Search

USPC ..... 292/DIG. 2, 202, DIG. 7, DIG. 20

See application file for complete search history.

(56) References Cited

U.S. PATENT DOCUMENTS

| | | | | |
|---|---|---|---|---|
| 1,521,112 | A * | 12/1924 | Lawrence | E05F 11/382 160/DIG. 2 |
| 4,813,725 | A | 3/1989 | Mosch | |
| 4,854,622 | A * | 8/1989 | Lozano | E05B 15/0205 16/382 |
| D366,409 | S | 1/1996 | Delaske | |
| 6,412,834 | B1 | 7/2002 | Waitai et al. | |
| 6,546,671 | B2 | 4/2003 | Mitchell et al. | |
| 6,634,683 | B1 | 10/2003 | Brannan | |
| 6,802,545 | B2 | 10/2004 | Subliskey | |
| 6,969,096 | B2 | 11/2005 | Subliskey | |
| 7,017,957 | B2 | 3/2006 | Murphy et al. | |
| 7,063,361 | B1 | 6/2006 | Lawrence | |
| D527,613 | S | 9/2006 | Omangi et al. | |
| 7,171,784 | B2 | 2/2007 | Eenigenburg | |

(Continued)

OTHER PUBLICATIONS

US 6,536,817, 03/2003, Subliskey (withdrawn)

*Primary Examiner* — Mark Williams
(74) *Attorney, Agent, or Firm* — Lathrop & Gage LLP

(57) ABSTRACT

A sash lock assembly comprises a window sash frame component, a sash lock having a sash body, and at least one fastener. The sash lock body is mounted on a top of the window sash frame component. The sash lock body includes at least one fastener passage. One exemplary sash lock assembly has the at least one fastener is installed from a rear of the sash lock body, through the at least one angled fastener passage, and into the top of the window sash frame component to secure the sash lock body to the window sash frame component and conceal the at least one fastener is from view without applying an additional cover. One exemplary sash lock assembly has at least one mounting projection that fits within at least one opening in the top of the window sash frame component.

16 Claims, 85 Drawing Sheets

(56) References Cited

U.S. PATENT DOCUMENTS

| | | | |
|---|---|---|---|
| 7,222,458 | B2 | 5/2007 | Polowinczak et al. |
| D559,078 | S | 1/2008 | Baczuk et al. |
| D560,112 | S | 1/2008 | Baczuk et al. |
| 7,552,562 | B2 | 6/2009 | Curtis et al. |
| D597,398 | S | 8/2009 | Jones et al. |
| 2008/0169658 | A1 | 7/2008 | Wolf |
| 2010/0083714 | A1 | 4/2010 | Keighley et al. |
| 2010/0263415 | A1 | 10/2010 | Ruspil |
| 2012/0284993 | A1 * | 11/2012 | Liang ..... E05C 3/046 29/453 |

* cited by examiner

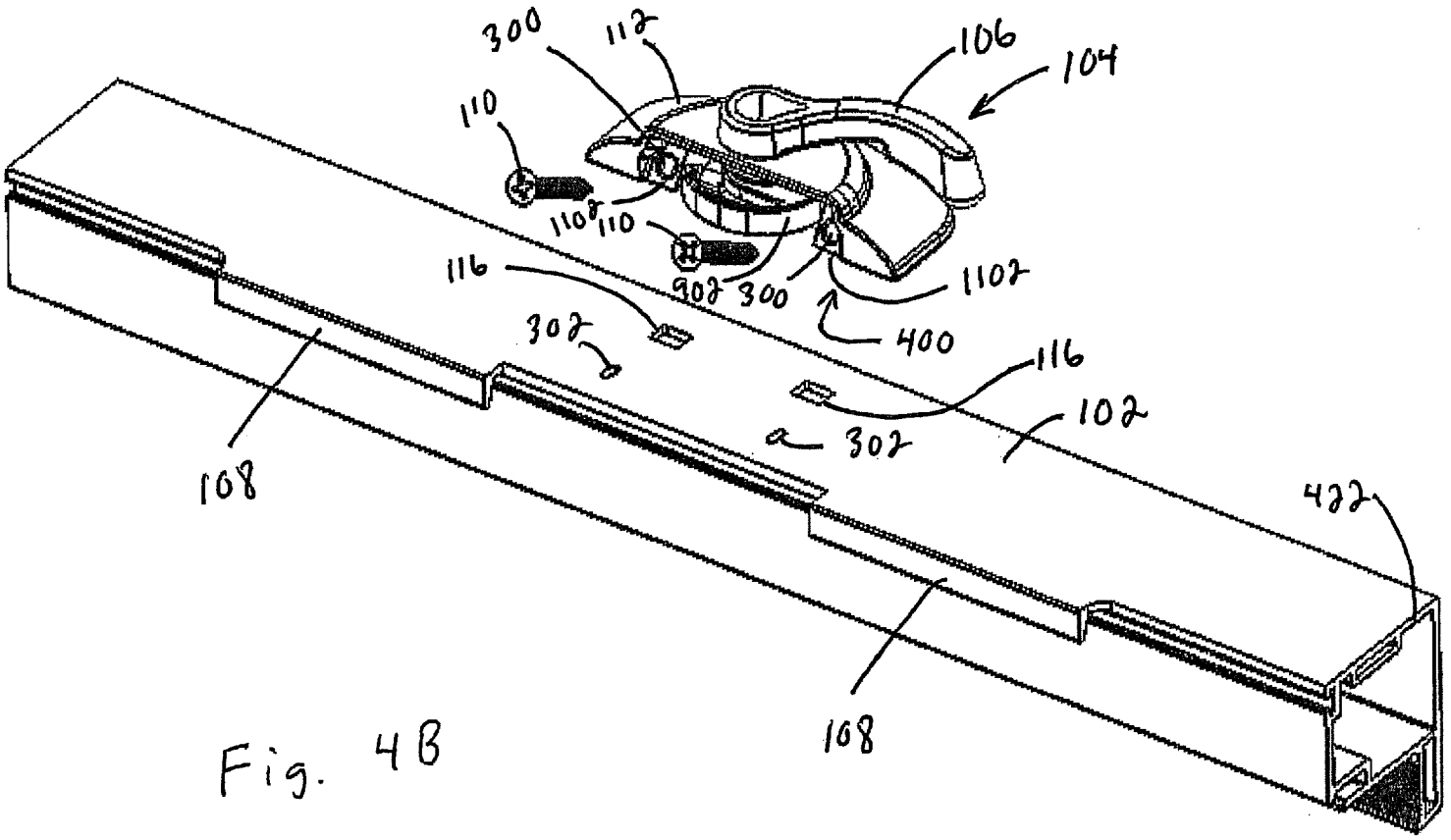
422
104
106
110a
110
110
110

WINDOW LOCKING ARRANGEMENTS

RELATED APPLICATION

The present application claims the benefit of U.S. Provisional patent application Ser. No. 61/677,676 filed on Jul. 31, 2012. U.S. Provisional patent application Ser. No. 61/677,676 is incorporated herein by reference in its entirety.

FIELD OF THE INVENTION

The present application relates to the field of window locking hardware.

BACKGROUND

Locking arrangements have been used to prevent unwanted entry through windows for many, many years. One type of window that is often provided with a locking arrangement is a sash type window having a window frame, an upper sash, and a lower sash. The upper and lower sashes are mounted in the window frame. The lower sash and optionally the upper sash are slidably mounted in the frame to open and close the window. The locking arrangements are used to lock the position of the lower sash with respect to the upper sash and thereby lock the window closed. Each sash typically includes a sash frame in which the glass of the window sash is mounted. Typical locking arrangements are operable to selectively lock a top component or rail of the lower sash frame to the bottom component or rail of the upper sash frame to selectively lock the window.

SUMMARY

The present application discloses exemplary embodiments of window sash lock assemblies. In one exemplary embodiment, the sash lock assembly comprises a window sash frame component, a sash lock having a sash body, and at least one concealed fastener. The sash lock body is mounted on a top of the window sash frame component. The sash lock body includes at least one angled fastener passage. The at least one fastener is installed from a rear of the sash lock body, through the at least one angled fastener passage, and into the top of the window sash frame component to secure the sash lock body to the window sash frame component. The at least one fastener is concealed from view by the sash lock body without applying an additional cover.

In one exemplary embodiment, the sash lock assembly comprises a window sash frame component, a sash lock having a sash body, and at least one fastener. At least one opening is in a top of the window sash frame component. The sash lock body is mounted on a top of the window sash frame component. The sash lock body includes at least one mounting projection that fits within the at least one opening in the top of the window sash frame component. The sash lock body includes at least one fastener passage. At least one fastener is installed through the at least one fastener passage, and into the top of the window sash frame component to secure the sash lock body to the window sash frame component.

BRIEF DESCRIPTION OF THE DRAWINGS

In the accompanying drawings which are incorporated in and constitute a part of the specification, embodiments of the invention are illustrated, which together with a general description of the invention given above and the detailed description given below, serve to provide examples of the principles of this invention.

FIG. 1B is an end view of the sash locking arrangement illustrated by FIG. 1A;

FIG. 1D is a sectional view taken along the plane indicated by lines 1D-1D in FIG. 1A;

FIG. 4B is another exploded perspective view illustrating assembly of the window sash lock and window sash component illustrated by FIG. 3A;

FIG. 5B is a sectioned perspective view taken along the plane indicated by lines 5B-5B in FIG. 5A;

FIG. 12A is a side view of a spring washer of the sash lock assembly illustrated by FIG. 8A;

FIG. 12B is a perspective view of the spring washer illustrated by FIG. 12A;

FIG. 15G is a bottom view of the housing illustrated by FIG. 15A;

DETAILED DESCRIPTION

The present patent application specification and drawings provide multiple embodiments of window locking arrangements. Any feature or combination of features from each of the embodiments may be used with features or combinations of features of other embodiments.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members or elements.

The present application discloses exemplary embodiments of locking arrangements 100 for windows. The locking arrangements 100 may be used in a wide variety of different types of windows. In one exemplary embodiment, the locking arrangements 100 are used in a sash type window having a window frame, an upper sash, and a lower sash. The upper and lower sashes are mounted in the window frame. The lower sash and optionally the upper sash are slidably mounted in the frame to open and close the window. The locking arrangements 100 are used to lock the position of the lower sash with respect to the lower sash and thereby lock the window closed. Each sash includes a sash frame in which the glass of the window sash is mounted.

Figure 1A:
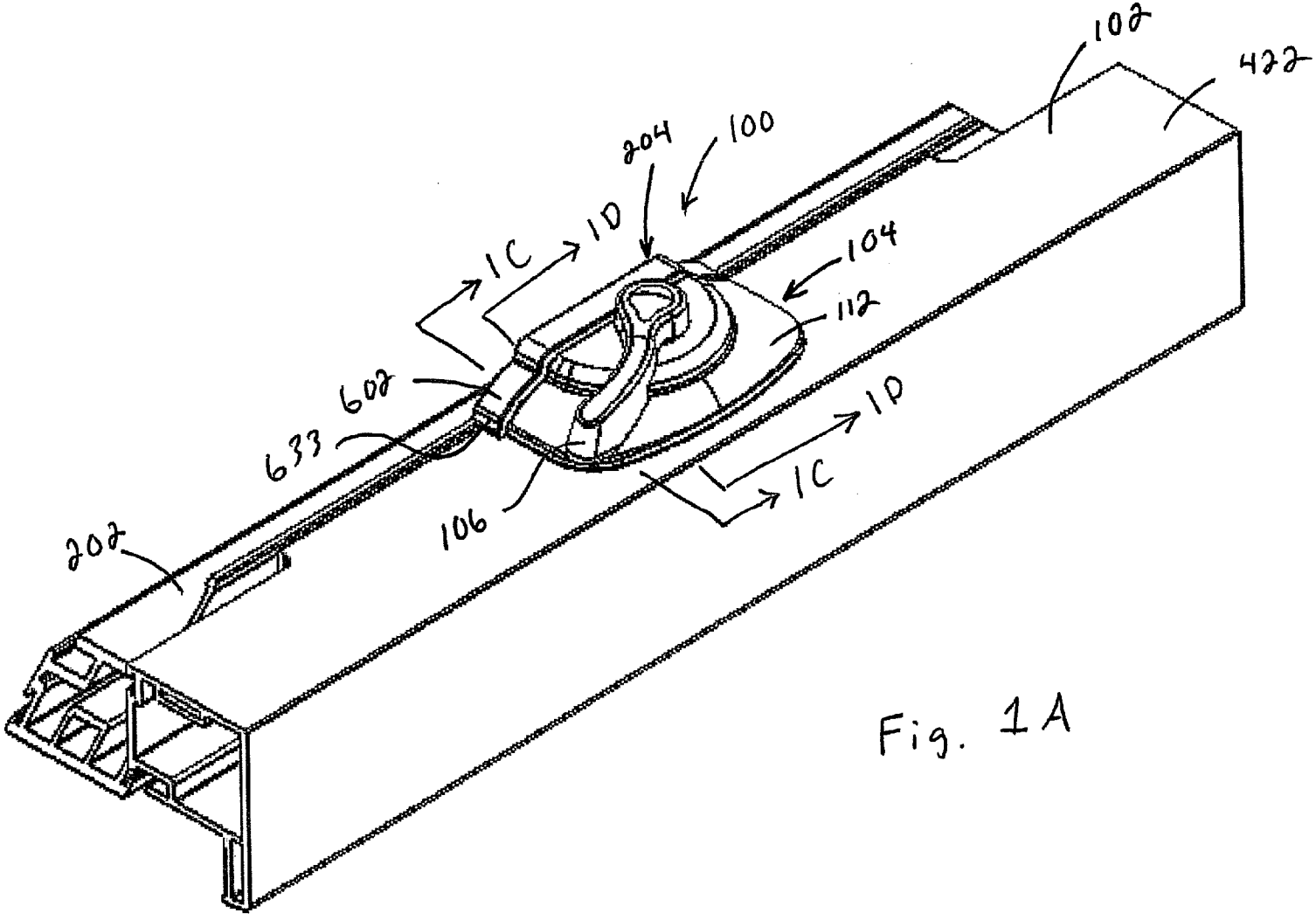
FIG. 1A is a perspective view of an exemplary embodiment of a window sash locking arrangement.
Figure 18:
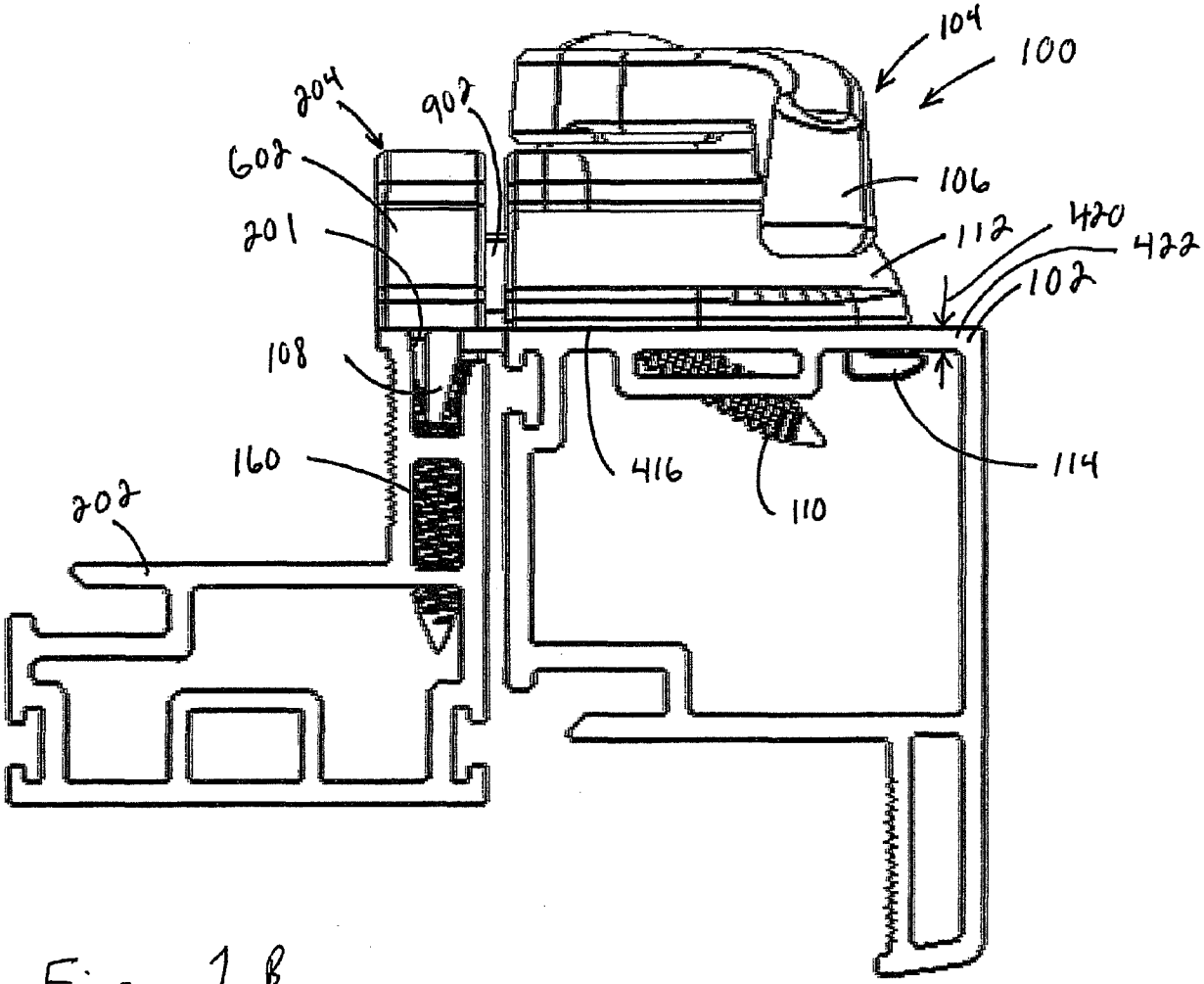
Figure 1C:
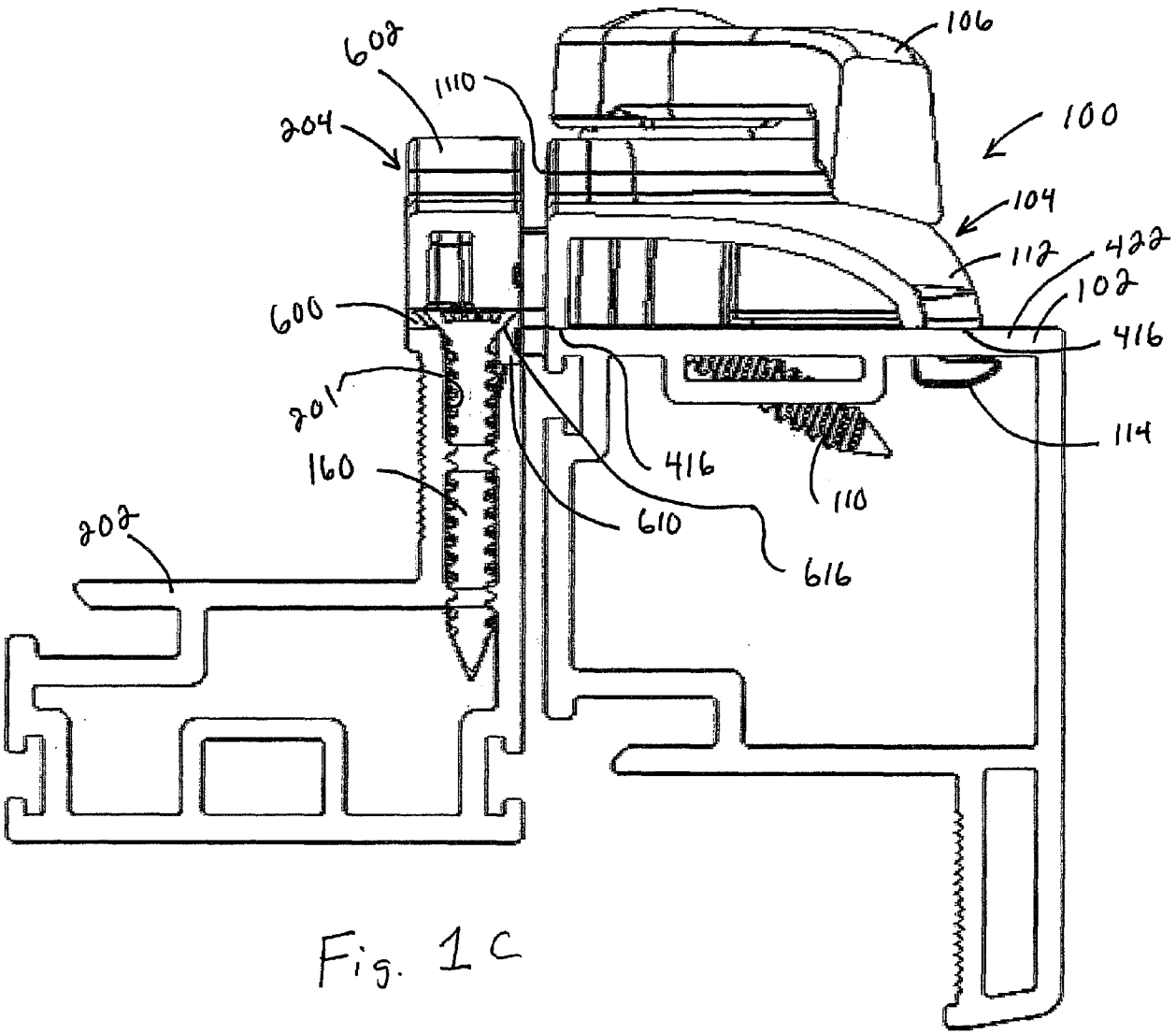
FIG. 1C is a sectional view taken along the plane indicated by lines 1C-1C in FIG. 1A.
Figure 10:
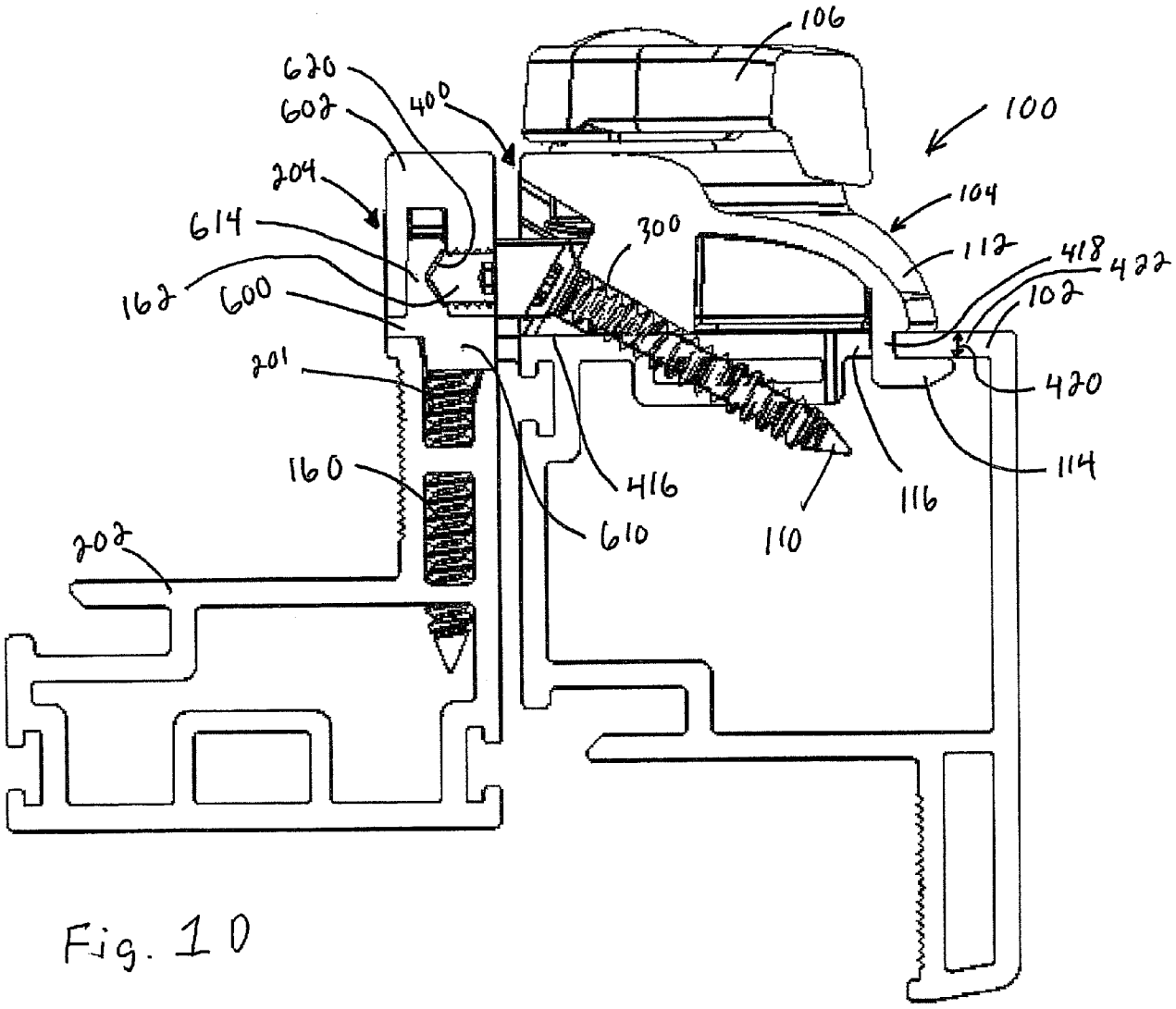
FIG. 10A is a perspective view of a handle of the sash lock assembly illustrated by FIG. 8A.
FIG. 10B is another perspective view of the handle illustrated by FIG. 10A.
FIG. 10C is a front view of the handle illustrated by FIG. 10A.
FIG. 10D is a rear view of the handle illustrated by FIG. 10A.
FIG. 10E is a first side view of the handle illustrated by FIG. 10A.
FIG. 10F is a second side view of the handle illustrated by FIG. 10A.
FIG. 10G is a top view of the handle illustrated by FIG. 10A.
FIG. 10H is a bottom view of the handle illustrated by FIG. 10A.
Figure 1E:
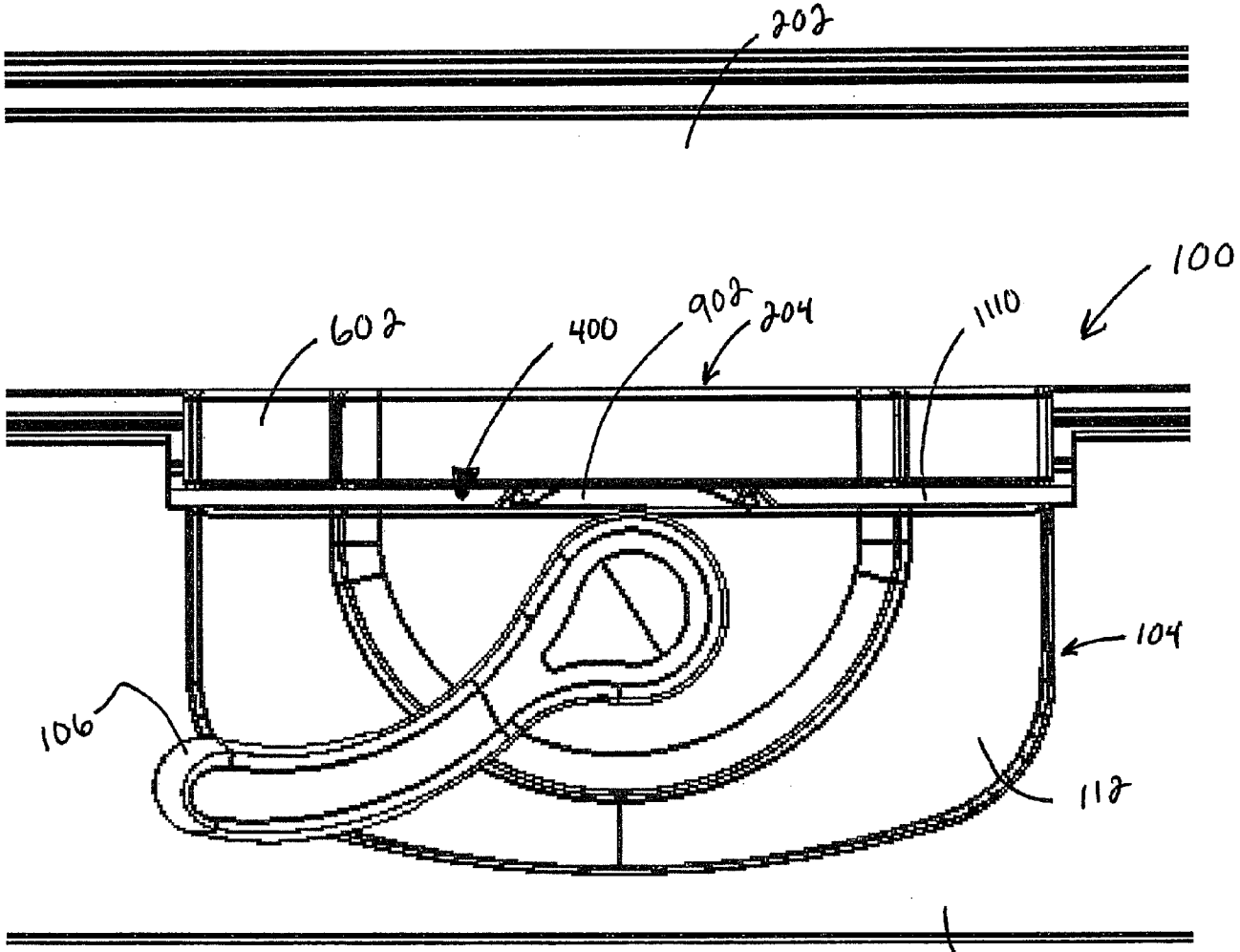
FIG. 1E is a top view of the sash locking arrangement illustrated by FIG. 1A.
Figure 2A:
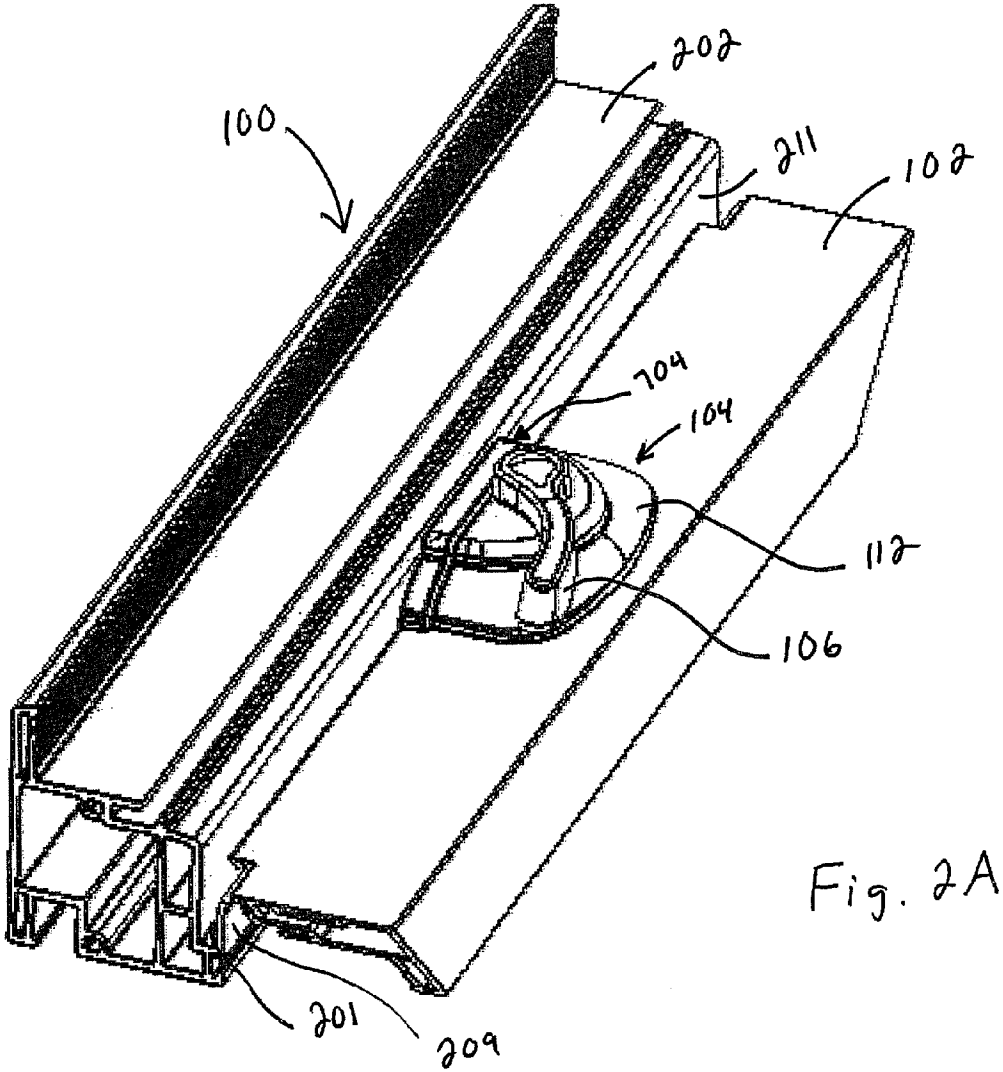
FIG. 2A is a perspective view of another exemplary embodiment of a window sash locking arrangement.
Figure 2B:
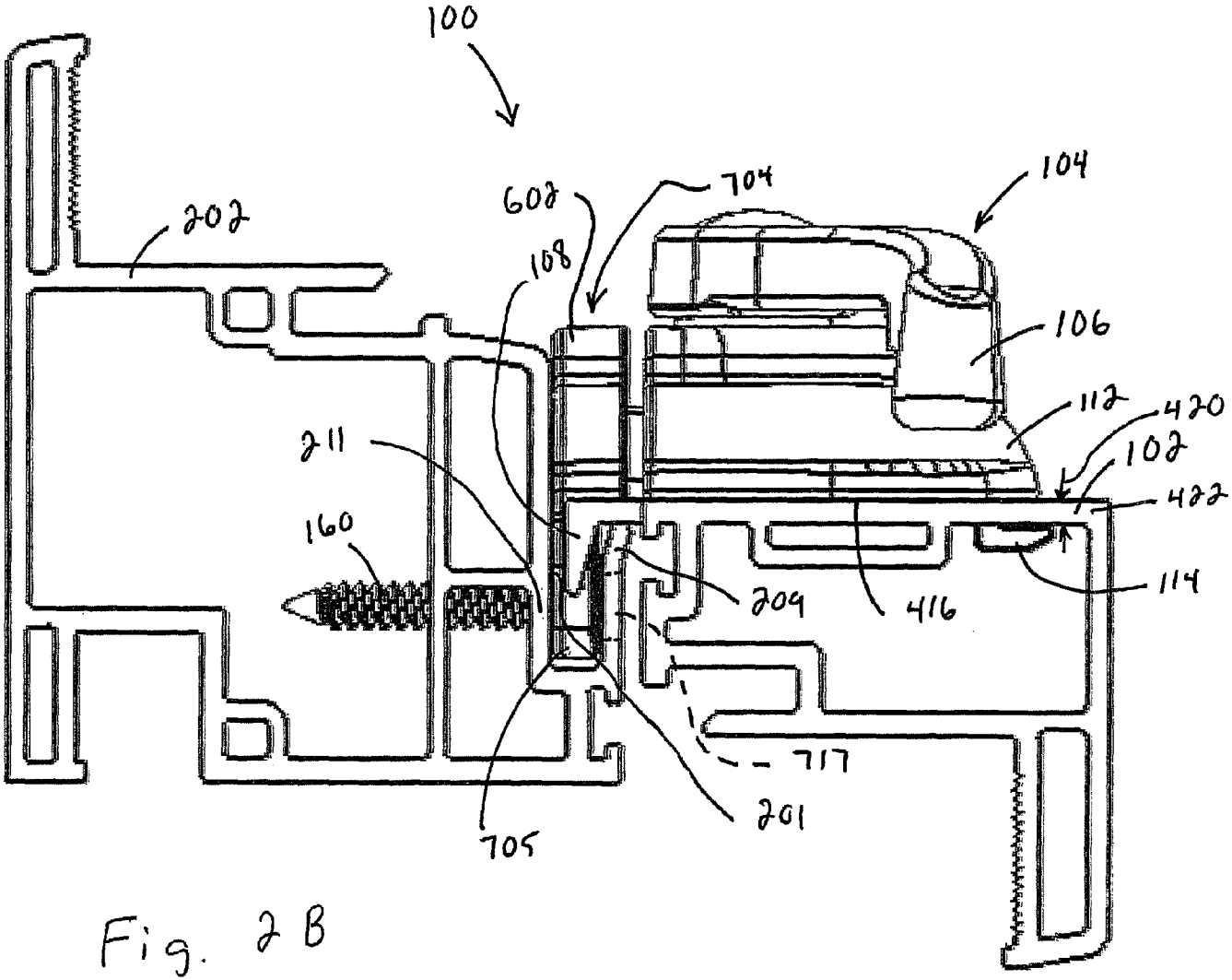
FIG. 2B is an end view of the sash locking arrangement illustrated by FIG. 2A.
Figure 2C:
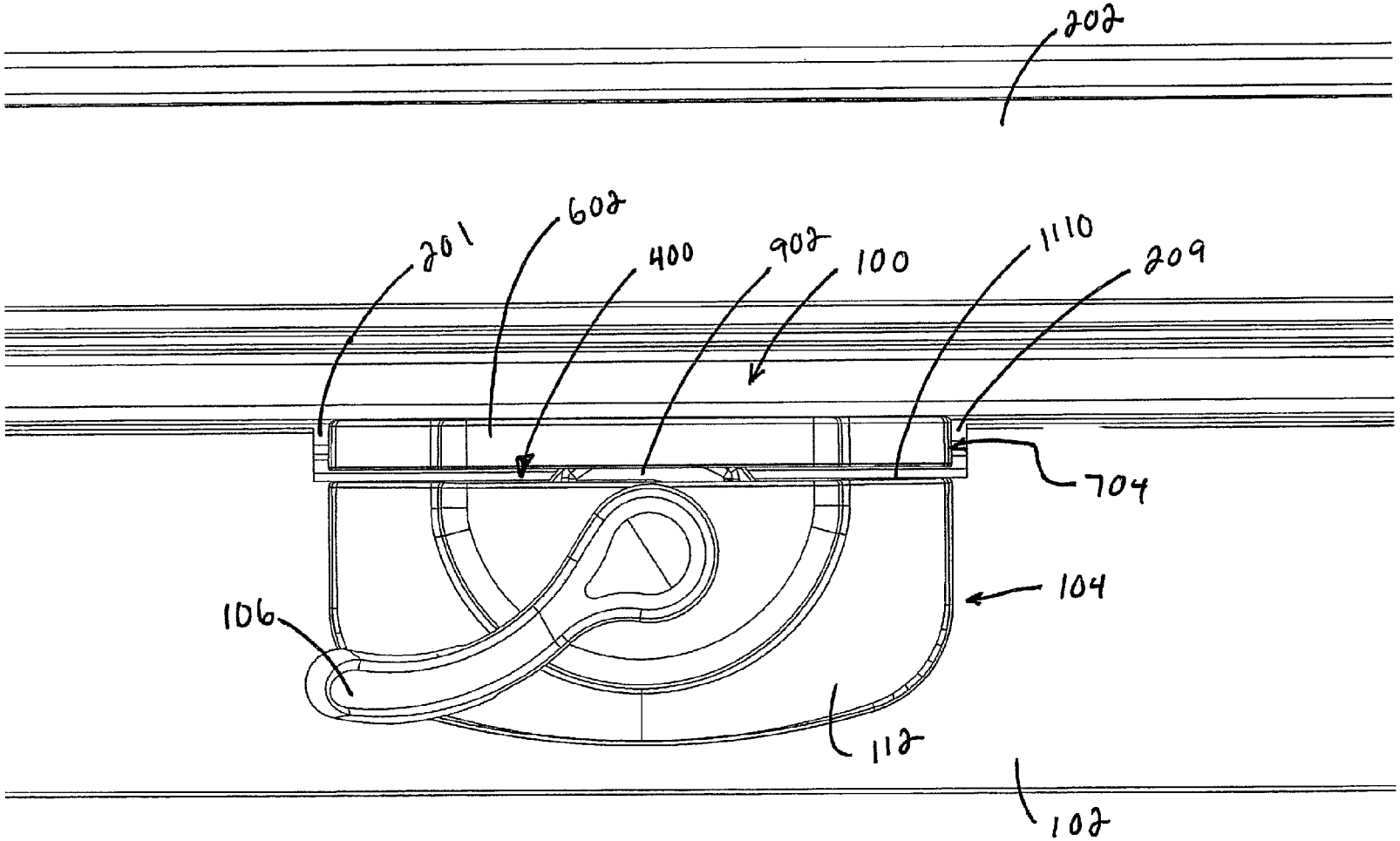
FIG. 2C is a top view of the sash locking arrangement illustrated by FIG. 2A.

Referring to FIGS. 1A and 2A, the locking arrangements 100 are operable to selectively lock a top component 102 or rail of the lower sash frame to a bottom component 202 or rail of the upper sash frame to selectively lock the window. The top component 102 of the lower sash frame and the bottom component 202 of the upper sash frame can take a wide variety of different forms. Referring to FIGS. 1B and 2B, in the illustrated embodiment, the components 102, 202 are hollow and may be formed by an extrusion and/or molding process. The components 102, 202 may be made from a wide variety of different materials. For example, the components 102, 202 may be made from polymeric materials, such as plastic, metals, such as aluminum or steel, natural materials, such as wood, or any combination thereof.

Figure 3A:
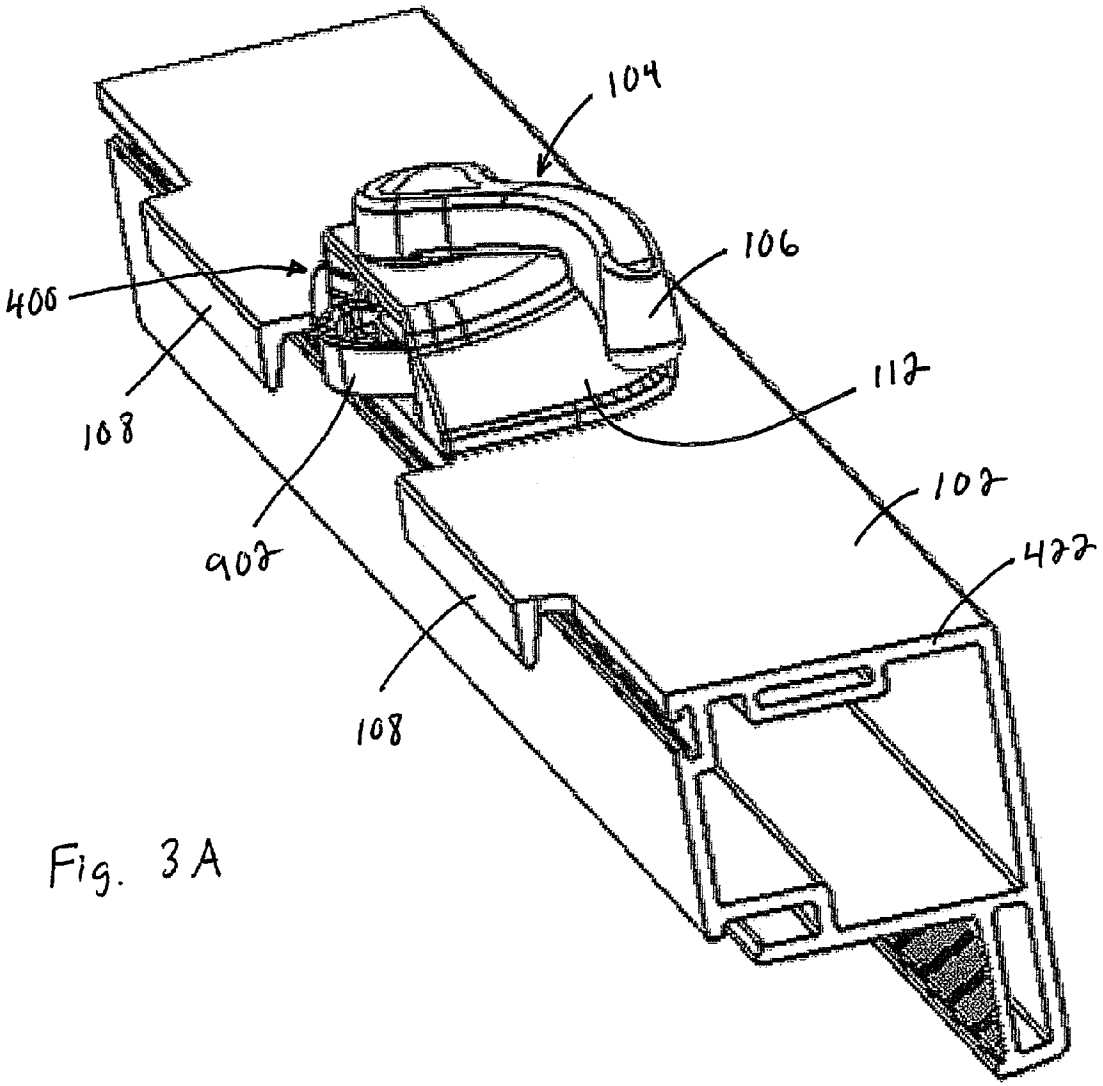
FIG. 3A is a perspective view illustrating a window sash lock assembled with a window sash component.
Figure 3B:
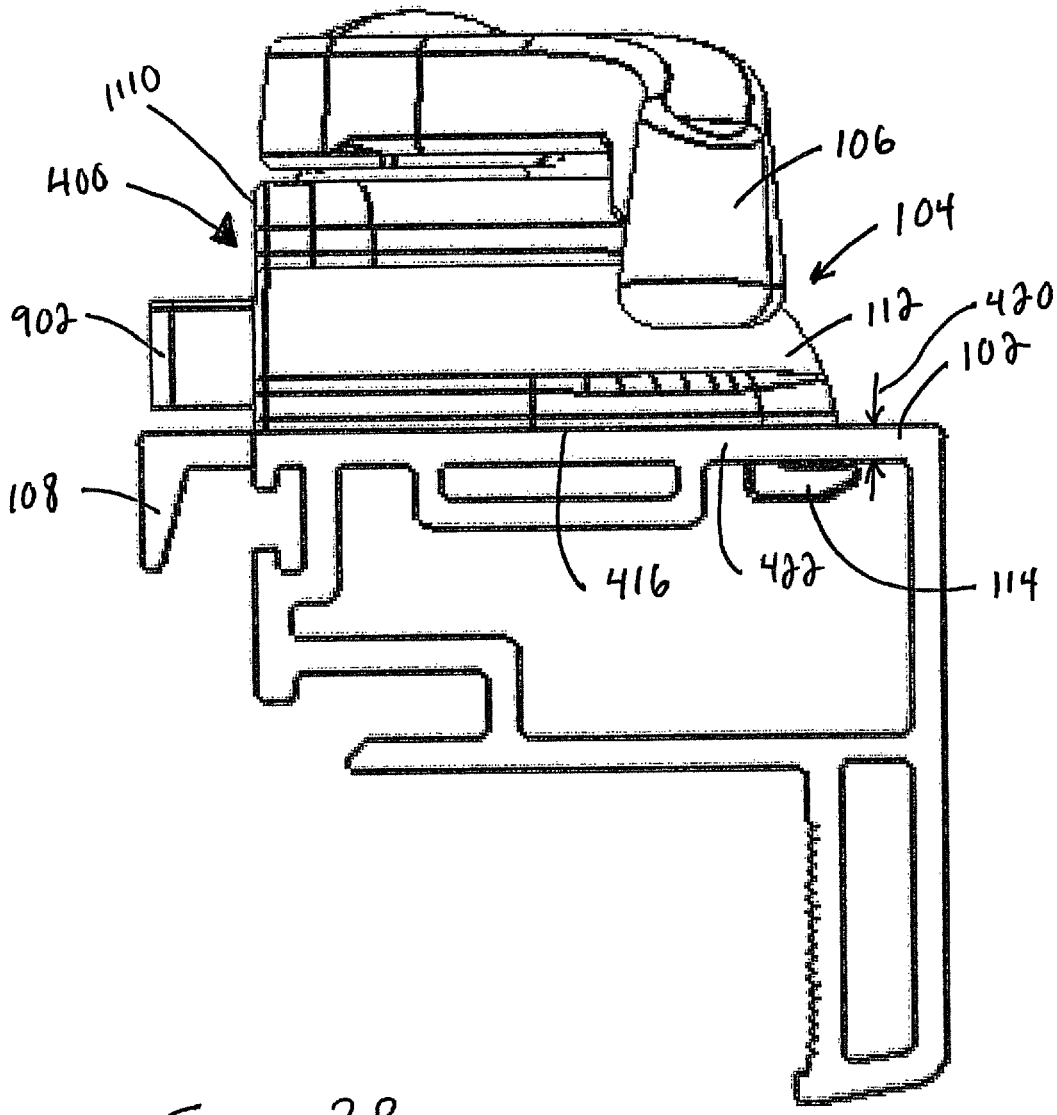
FIG. 3B is a side view of the sash lock and window sash component illustrated by FIG. 3A.
Figure 3C:
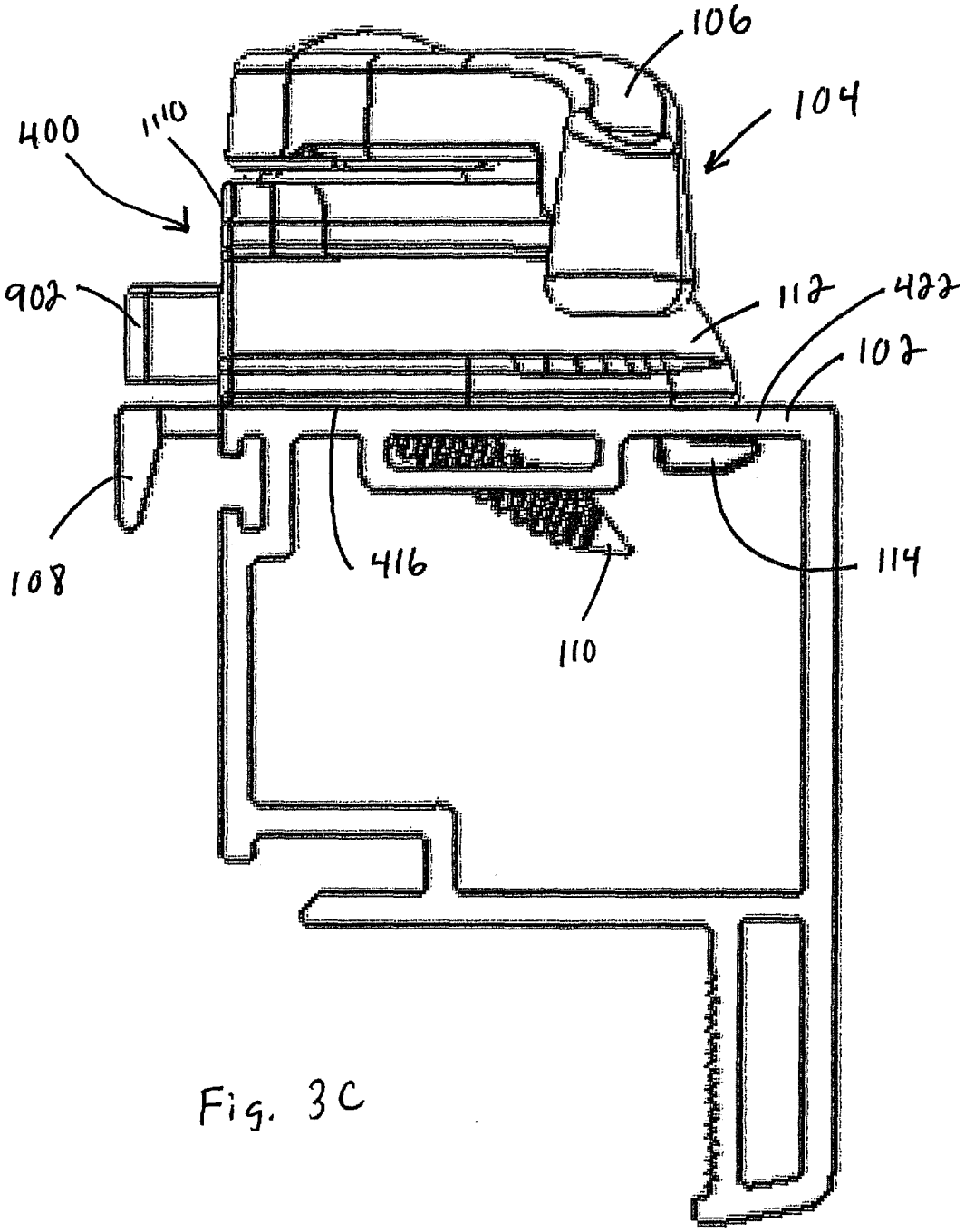
FIG. 3C is an end view of the sash lock and window sash component illustrated by FIG. 3A.
Figure 3D:
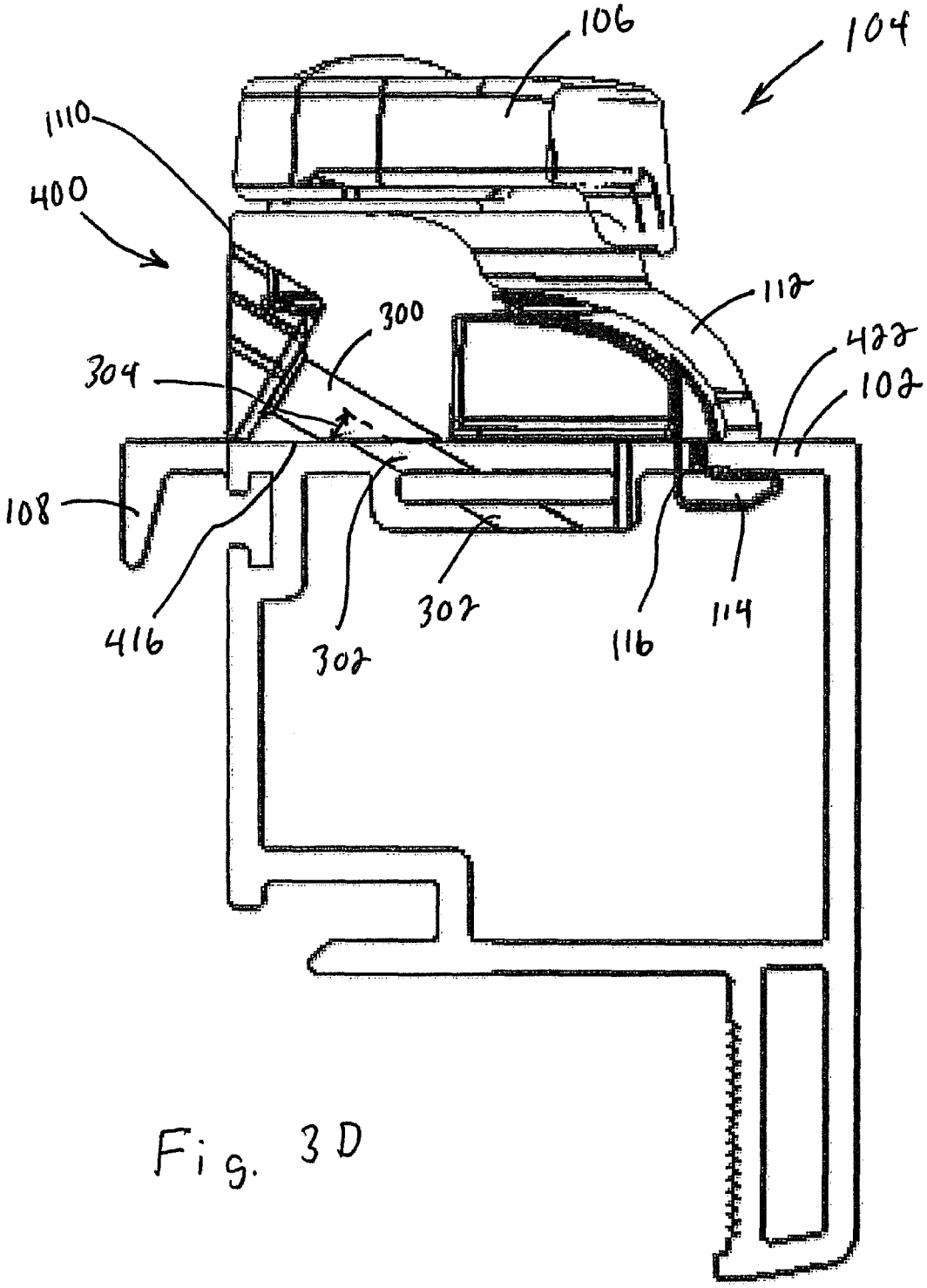
FIG. 3D is a sectional view of the sash lock and window sash component taken through openings where mounting screws are inserted, with the mounting screws removed to clarify the drawing.
Figure 3E:
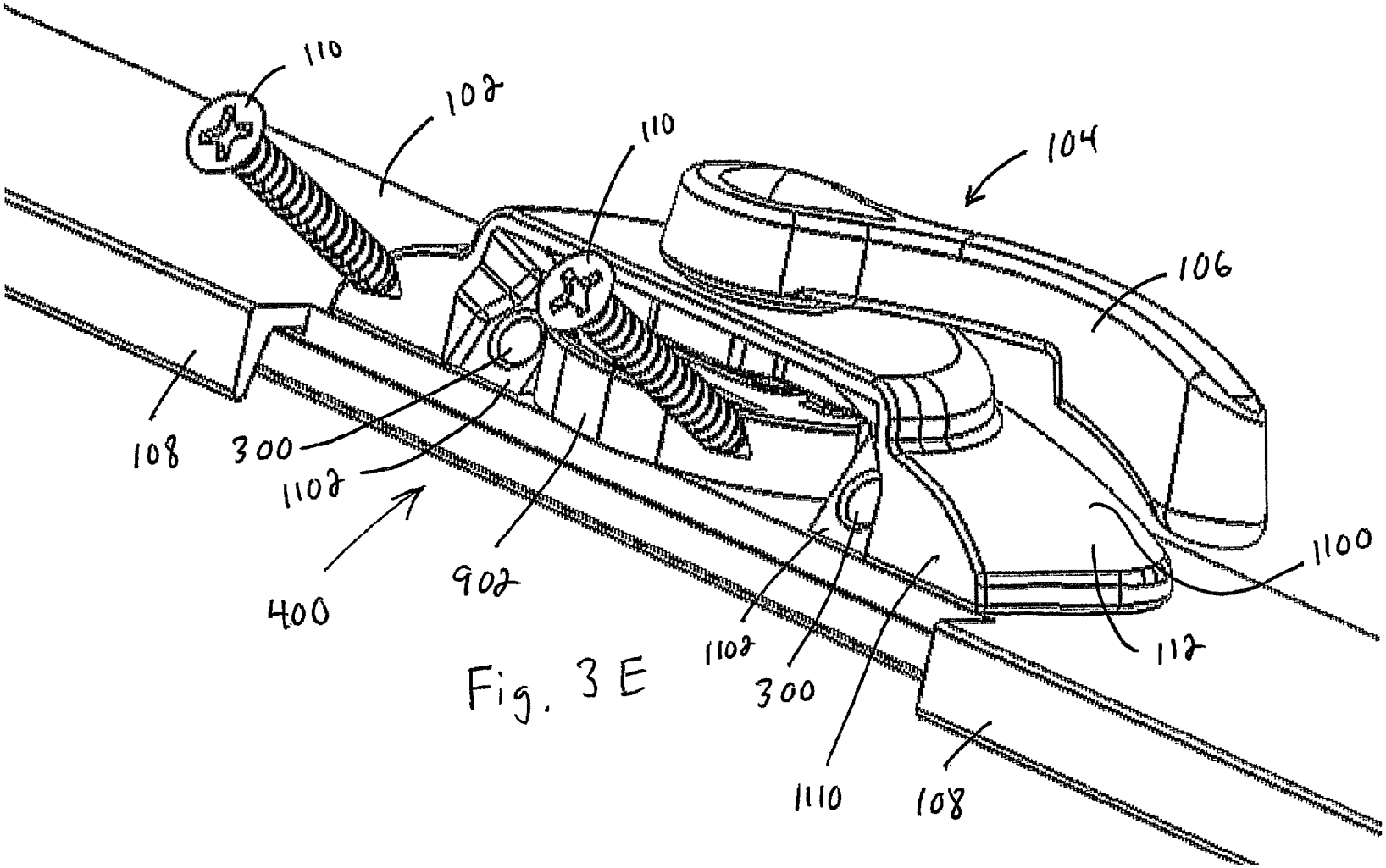
FIG. 3E is a perspective view of the sash lock and window sash component illustrated by FIG. 3A illustrating securing of the sash lock to the window sash component with threaded fasteners.
Figure 3F:
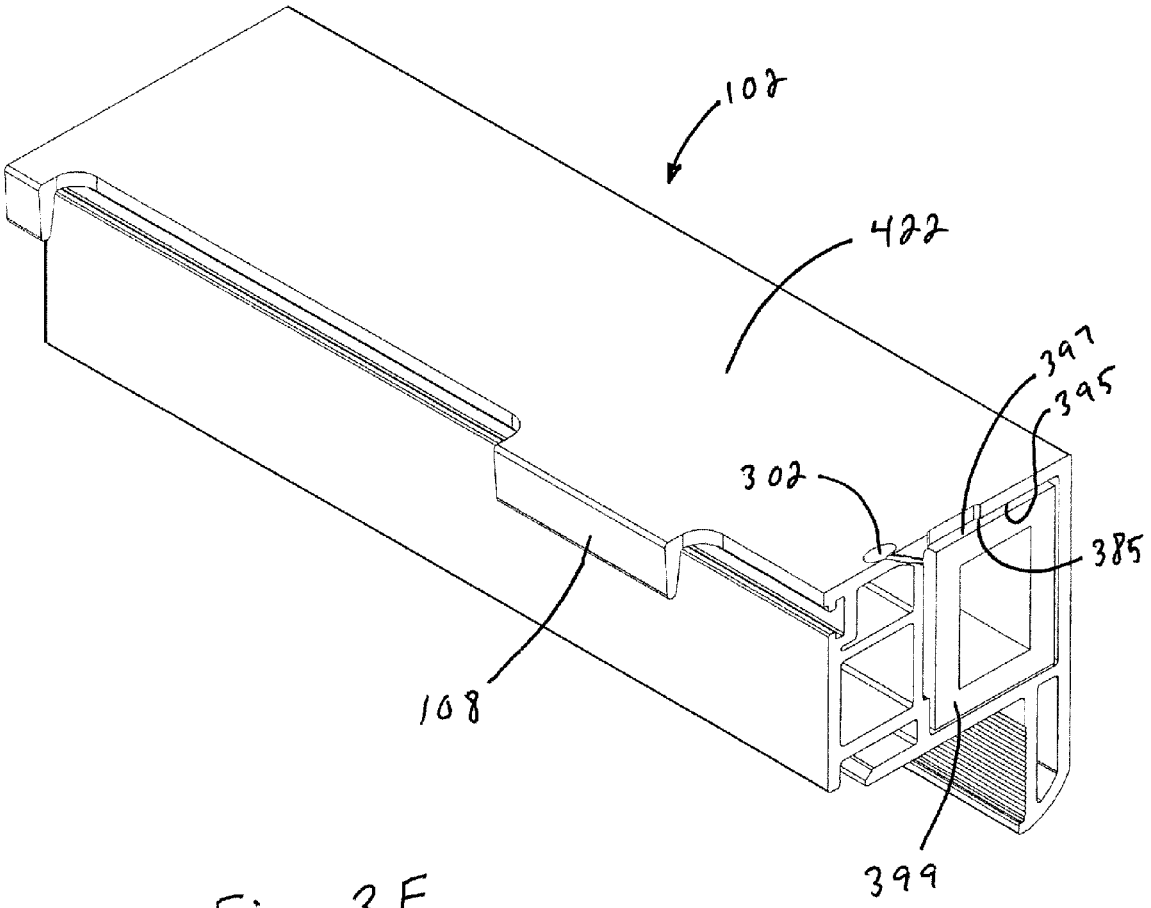
FIG. 3F is a sectioned perspective view of an exemplary embodiment of a hollow reinforced window sash component.
Figure 3G:
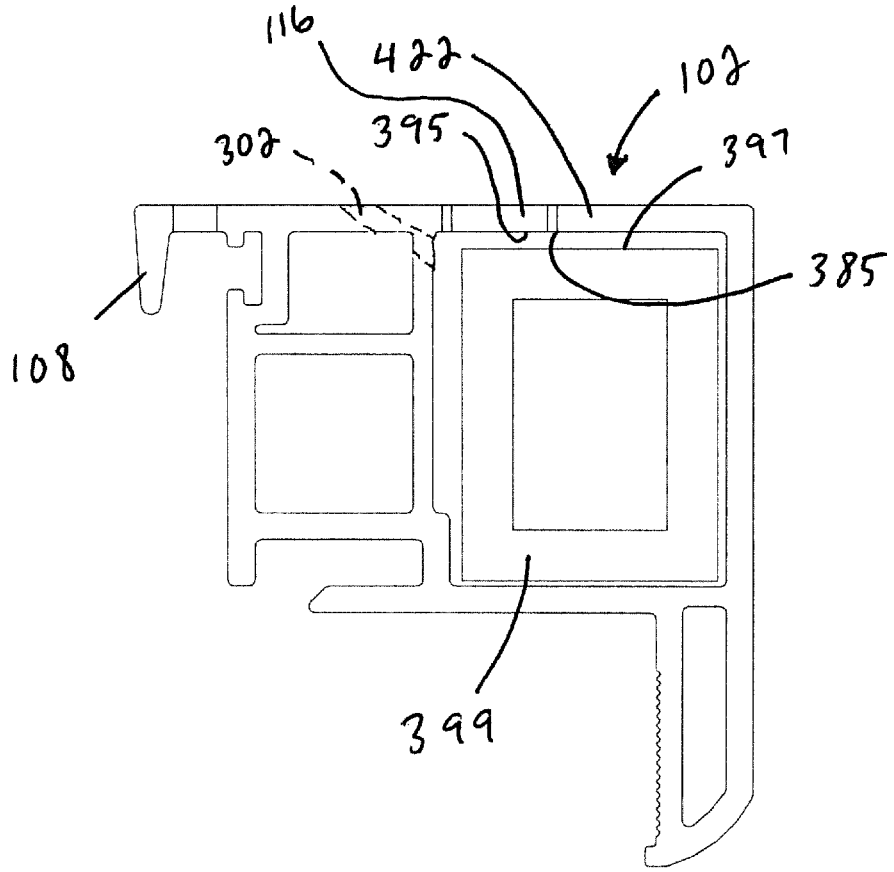
FIG. 3G is a sectional view of the hollow reinforced sash component illustrated by FIG. 3F.

Referring to FIGS. 3F and 3G, in one exemplary embodiment, the components 102 and/or 202 are hollow with a reinforcement member or material 399 disposed inside the window sash frame component. The reinforcement member or material 399 may take a wide variety of different forms. For example, the reinforcement member 399 may be attached or secured inside the component 102 and/or 202. In the illustrated embodiment, a top surface 397 of the reinforcement member 399 is spaced apart from a bottom surface 395 of a top wall 422 of the window sash frame component 102 and/or 202. According to another example, the reinforcement material 399 may be a foam material that is injected, extruded, co-extruded, or otherwise provided inside the component 102, 202.

In the illustrated embodiment, the components 102, 202 are configured to mate to add strength to the closed and locked window. This mating may be accomplished in a wide variety of different ways. In the illustrated embodiment, the top component 102 of the lower sash includes a flange 108 (See FIG. 1B) that fits within a groove 201 of the bottom component 202 of the upper sash when the lower sash is moved all the way down and the upper sash is moved all the way up in the frame (i.e. the window is closed).

The illustrated locking arrangements 100 include a sash lock 104 and a keeper 204. The sash lock 104 is mounted to the top component 102 of the lower sash frame and the keeper 204 is mounted to the bottom component 202 of the upper sash frame. A handle 106 of the sash lock 104 is operable to selectively lock the sash lock to the keeper 204 when the window is closed.

Figure 4A:
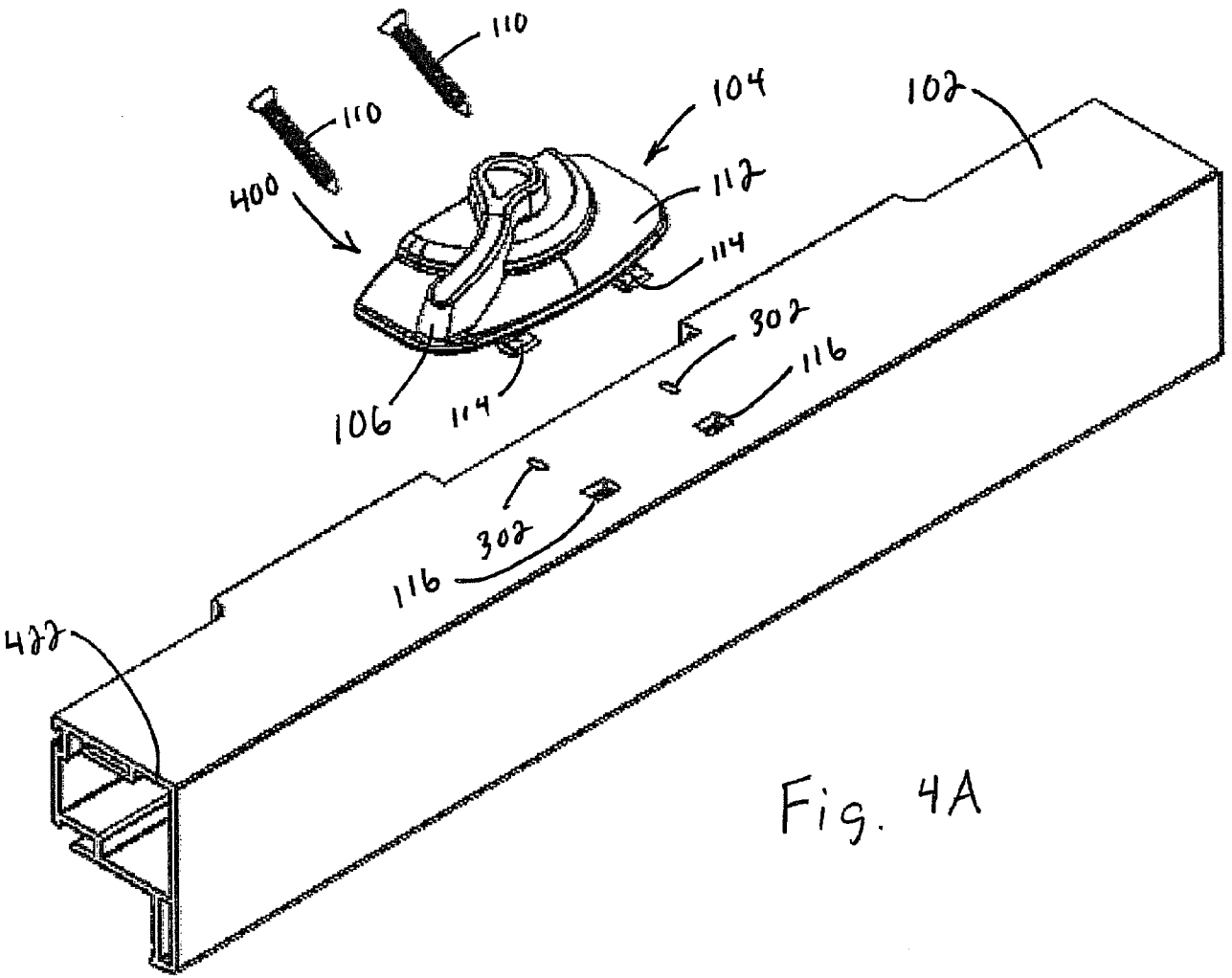
FIG. 4A is an exploded perspective view illustrating assembly of the window sash lock and window sash component illustrated by FIG. 3A.
Figure 4C:
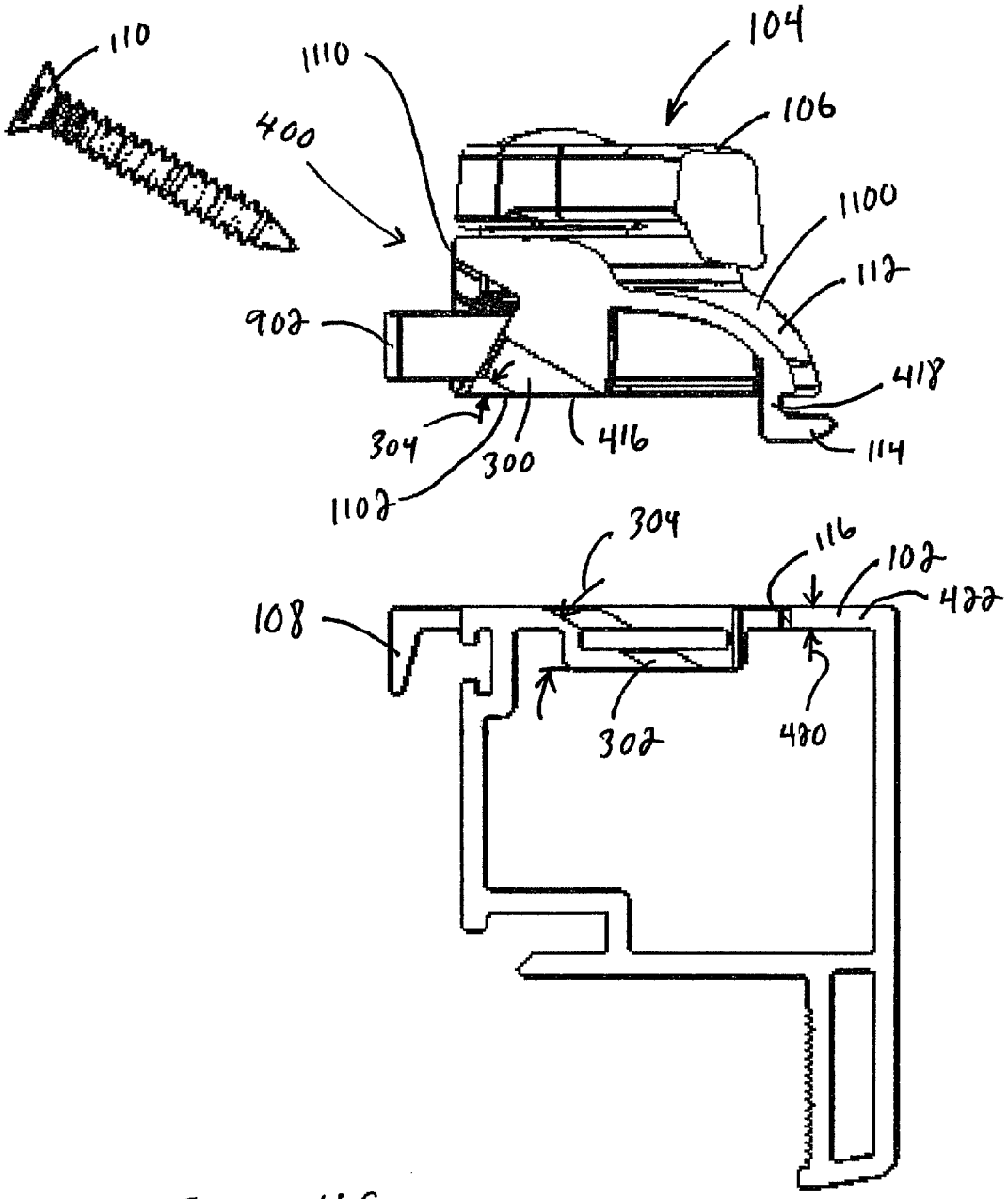
FIG. 4C is an exploded sectional view illustrating assembly of the window sash lock and window sash component illustrated by FIG. 3A.

The sash lock 104 can be mounted to the top component 102 of the lower sash frame in a wide variety of different ways. Referring to FIGS. 4A-4C, in one exemplary embodiment, the sash lock is mounted to the top component 102 of the lower sash frame in a manner where mounting fasteners 110 are concealed from view. This concealment from view may be accomplished in a variety of different ways. In one exemplary embodiment, all fasteners 110 that mount the sash lock 104 to the top component of the lower sash are installed from a rear 400 of the sash lock 104 and are covered by a body 112 of the sash lock (see FIG. 1D). In the illustrated embodiment, the sash lock is fully assembled when the fasteners 110 are used to mount the sash lock to the top component 102 and no additional steps need to be taken to conceal the fasteners (i.e. no additional cover needs to be applied to the mounted sash lock to cover the fasteners).

Referring to FIG. 3D, in an exemplary embodiment, the body 112 includes mounting passages 300 that are configured to allow the fasteners 110 to be installed from the rear of the sash lock 104 such that the fasteners are concealed from view. In one exemplary embodiment, the mounting passages 300 are aligned with optional pre-formed securing passages 302 in the top sash frame component 102. The mounting passages 300 and the optional pre-formed securing passages 302 may take a wide variety of different forms. In the illustrated embodiment, the mounting passages 300 and the pre-formed securing passages form an angle 304 with respect to a bottom surface 416 of the body 112 (See FIG. 4C). For example, the angle 304 may be between 15 and 45 degrees, such as about 30 degrees or 30 degrees. Referring to FIG. 4C, the sash lock 104 is mounted to the top sash frame component 102 by placing the fasteners through the mounting passages 300 and into the pre-formed securing passages. In an exemplary embodiment, the mounting passages 300 are configured such that there is some clearance around the fasteners 110 and the securing passages 302 are configured such that the fasteners 110 thread into the sash frame component 102.

In an exemplary embodiment, the body 112 includes optional mounting projections 114 that fit within openings 116 in the top component 102 of the lower sash frame to assist mounting of the sash lock 104 (See FIGS. 1D and 4A). The mounting projections 114 and openings 116 may aid in alignment of the sash lock 104 to the top component 102 and/or may add to the strength of the connection between the sash lock and the top component 102. The mounting projections 114 and openings 116 can take a wide variety of different forms. It should be appreciated that the openings 116 or recesses can be included on the sash lock 104 instead of the top component 102 and the projections can be included on the top component 102 instead of the sash lock body 112. The mounting projections 114 and openings 116 can take a wide variety of different shapes and sizes. Examples of mounting projections 114 include, but are not limited to pins, flanges, bosses, etc. The openings 116 may be through openings or recesses that have a bottom (i.e. a counterbore).

In the exemplary embodiment illustrated by FIGS. 4A-4C, the mounting projections 114 are rectangular flanges that are integrally formed with the sash lock body 112. Referring to FIG. 4C, the flanges are offset from the bottom surface 416 of the sash lock body 112 by legs 418 (See FIG. 1D). Referring to FIGS. 3B and 4C, the length of the legs 418 corresponds to the thickness 420 of a top wall 422 of the top sash frame component 102. In the illustrated embodiment, the openings 116 are rectangular cutouts through the top wall 422 of the top sash frame component 102. The rectangular cutouts are sized to closely accept the flanges 414. The flanges 414 extend under the top wall 422 to partially mount the sash lock 104 to the top sash frame component 102. In an exemplary embodiment, the rectangular cutouts 434 and the flanges 414 are configured such that when the flanges are placed through the cutouts and the legs 418 are in contact with a front wall of the cutouts 434, the mounting passages 300 are aligned with pre-formed securing passages 302. Fasteners 110 are placed through the passages 300 and are driven into the securing passages 302 to complete the mounting of the sash lock to the top sash frame component.

Figure 3H:
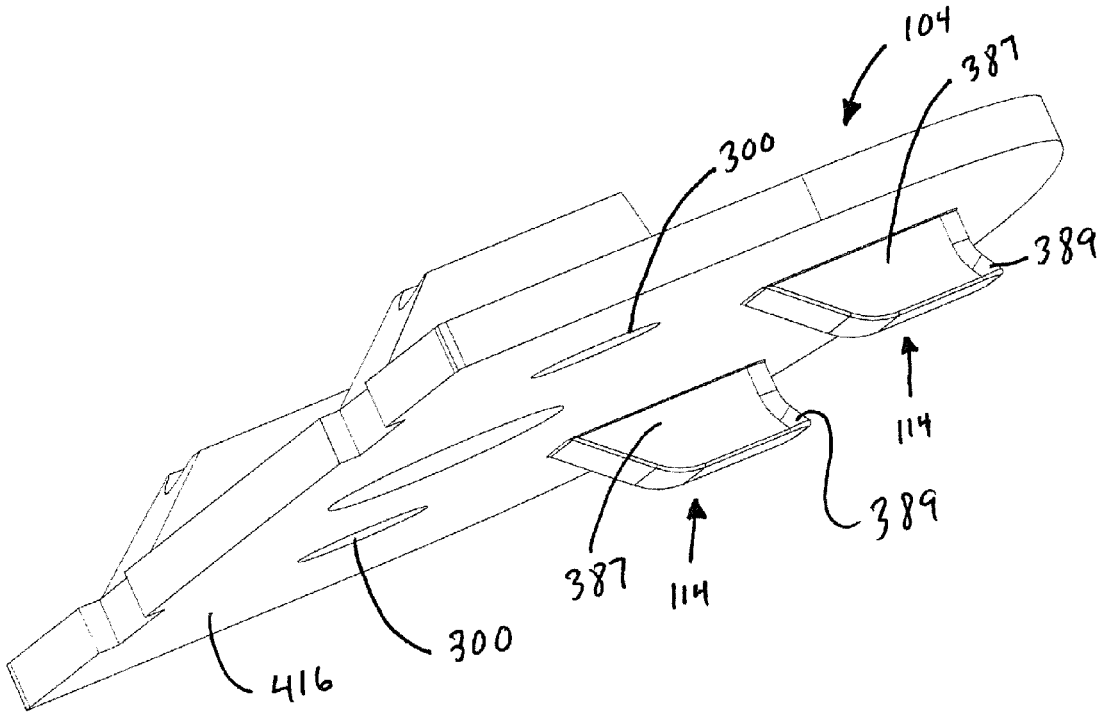
FIG. 3H illustrates an exemplary embodiment of a bottom portion of a sash lock body.
Figure 3I:
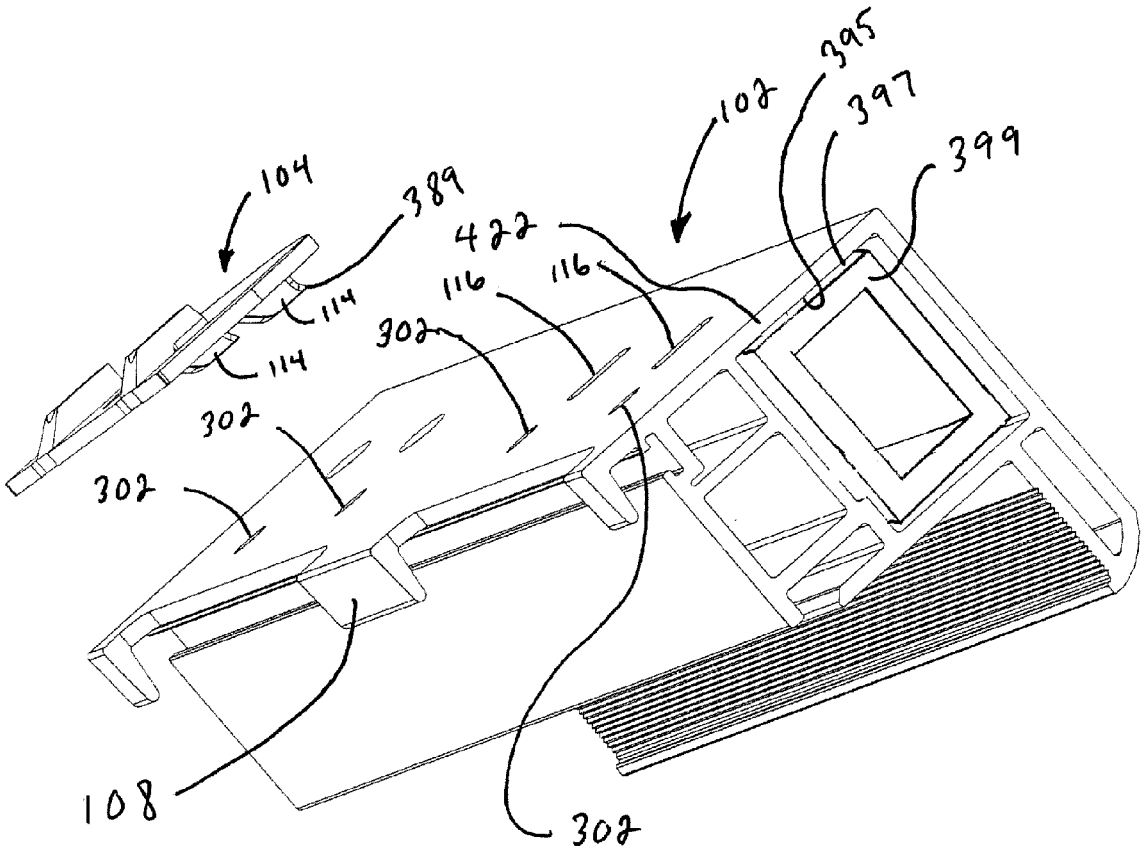
FIG. 3I is a perspective view illustrating the bottom portion of the sash lock body illustrated by FIG. 3H positioned above the hollow reinforced sash component illustrated by FIG. 3F.
Figure 3J:
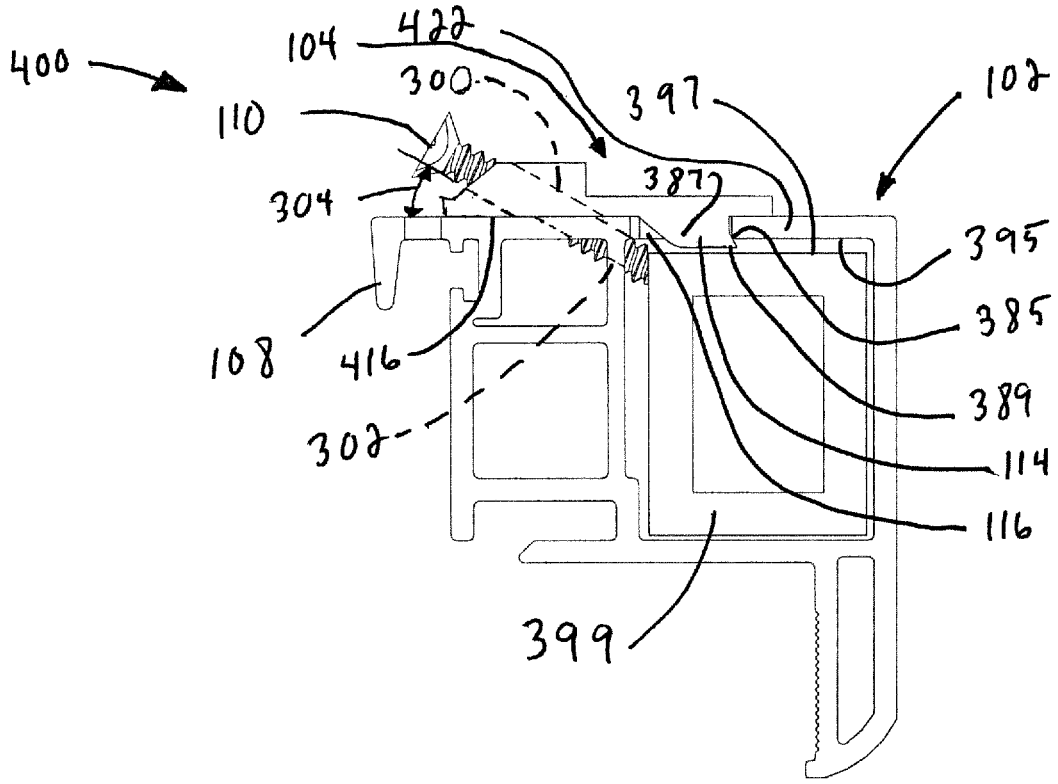
FIG. 3J is a sectional view illustrating the bottom portion of the sash lock body illustrated by FIG. 3H assembled with the hollow reinforced sash component illustrated by FIG. 3F.

FIGS. 3H-3J illustrate another exemplary embodiment of a bottom portion of a sash lock body. Only the bottom portion of the sash lock body is illustrated by FIGS. 3H-3J to simplify the drawings. Alternatively, the bottom portions illustrated by FIGS. 3H-3J may be bases that sash lock covers attach to. Referring to FIGS. 3H and 3J, in an exemplary embodiment, the body 112 includes mounting passages 300 that are configured to allow the fasteners 110 to be installed from the rear of the sash lock 104 such that the fasteners are concealed from view. In one exemplary embodiment, the mounting passages 300 are aligned with optional pre-formed securing passages 302 in the top sash frame component 102. The mounting passages 300 and the optional pre-formed securing passages 302 may take a wide variety of different forms. In the illustrated embodiment, the mounting passages 300 and the pre-formed securing passages form an angle 304 with respect to a bottom surface 416 of the body 112 (See FIG. 3J). For example, the angle 304 may be between 15 and 45 degrees, such as about 30 degrees. Referring to FIG. 3J, the sash lock 104 is mounted to the top sash frame component 102 by placing the fasteners through the mounting passages 300 and into the pre-formed securing passages. In an exemplary embodiment, the mounting passages 300 are configured such that there is some clearance around the fasteners 110 and the securing passages 302 are configured such that the fasteners 110 thread into the sash frame component 102 and the reinforcement member 399.

In the exemplary embodiment illustrated by FIGS. 3H-3J, the body 112 includes optional mounting projections 114 that fit within openings 116 in the top component 102 of the lower sash frame to assist mounting of the sash lock 104. The mounting projections 114 and openings 116 may aid in alignment of the sash lock 104 to the top component 102 and/or may add to the strength of the connection between the sash lock and the top component 102. It should be appreciated that the openings 116 or recesses can be included on the sash lock 104 instead of the top component 102 and the projections can be included on the top component 102 instead of the sash lock body 112. The mounting projections 114 and openings 116 can take a wide variety of different shapes and sizes. Examples of mounting projections 114 include, but are not limited to pins, flanges, bosses, hooks etc. The openings 116 may be through openings or recesses that have a bottom (i.e. a counterbore).

In the exemplary embodiment illustrated by FIGS. 3H-3J, the mounting projections 114 are hooks that are integrally formed with the sash lock body 112. Referring to FIG. 3J, hooked ends 389 are offset from the bottom surface 416 of the sash lock body by projections 387. Referring to FIG. 3J, the offset of the hooks 389 from the bottom of the sash lock body is configured such that the hook engages a bottom edge 385 formed in a top wall of the window sash frame component by the opening 116. In the embodiment illustrated by FIG. 3J, the openings 116 are rectangular cutouts through the top wall 422 of the top sash frame component 102. The rectangular cutouts are sized to closely accept the hooks. The hooked ends 389 extend under the top wall 422 to partially mount the sash lock 104 to the top sash frame component 102. Fasteners 110 are placed through the passages 300 and are driven into the securing passages 302 to complete the mounting of the sash lock to the top sash frame component.

In an exemplary embodiment, the hooks illustrated by FIGS. 3H-3J are configured to eliminate or minimize interference with the reinforcement member 399. In the example illustrated by FIGS. 3H-3J, a top surface 397 of the reinforcement member 399 is spaced apart from a bottom surface 395 of a top wall 422 of the window sash frame component. The illustrated hook 389 clears the top surface of the reinforcement member. In another exemplary embodiment, the reinforcement material 399 is a foam that fills the window sash component. In this embodiment, the configuration of the hooked ends 389 and the low profile of the hook, allows the hook to be inserted through the opening 116 and bite into the foam reinforcement material. This biting into the foam reinforcement material allows the hooked end to engage the bottom edge 385 formed by the opening 116. For example, the low profile hook may extend below the bottom surface 395 of the top wall by a distance of less than ⅛", less than 1/16", or less than 1/32".

Figure 3K:
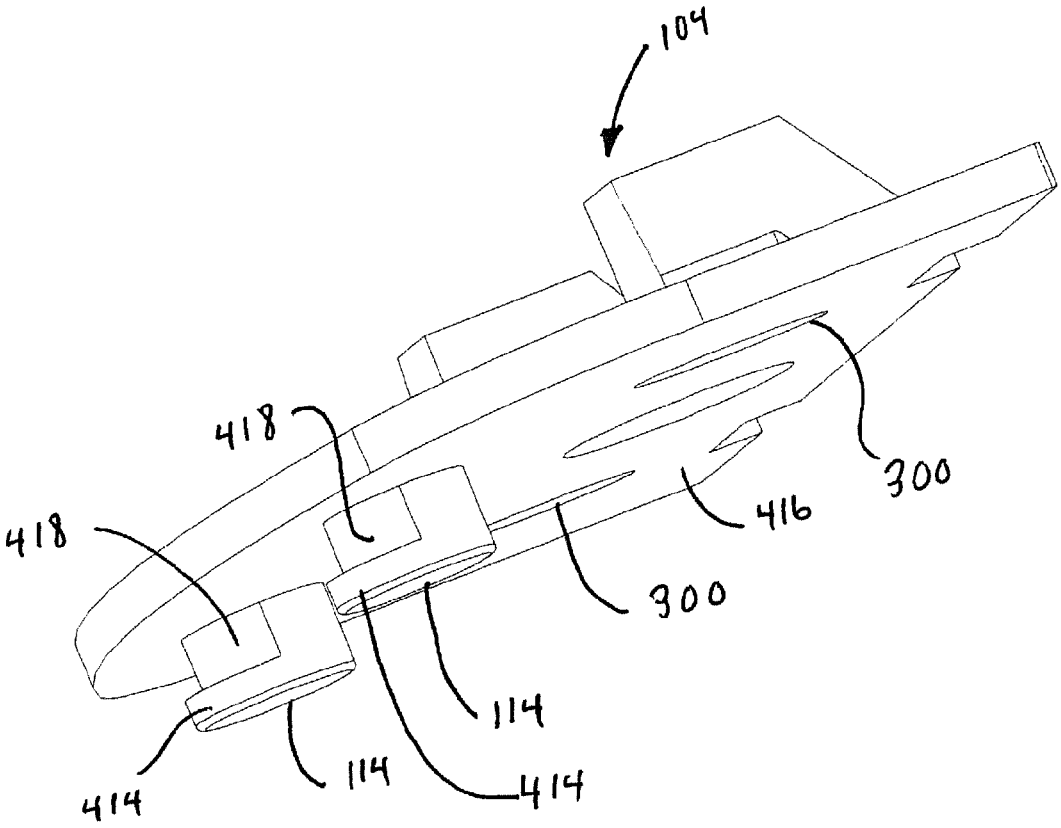
FIG. 3K illustrates an exemplary embodiment of a bottom portion of a sash lock body.
Figure 3L:
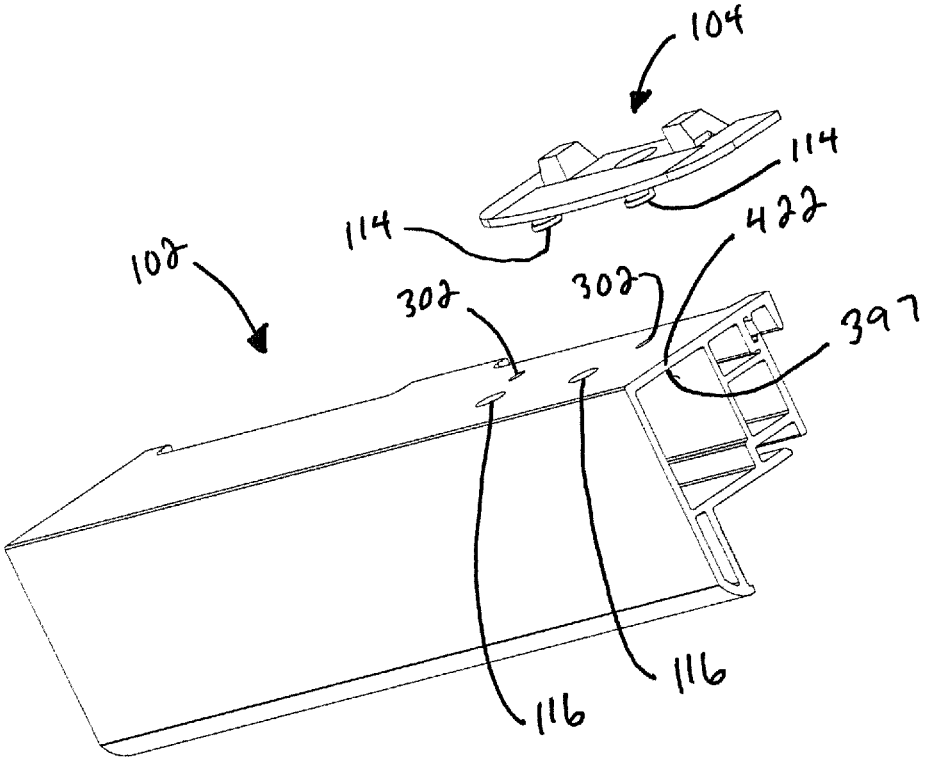
FIG. 3L is a perspective view illustrating the bottom portion of the sash lock body illustrated by FIG. 3K positioned above the hollow reinforced sash component illustrated by FIG. 3F.
Figure 3M:
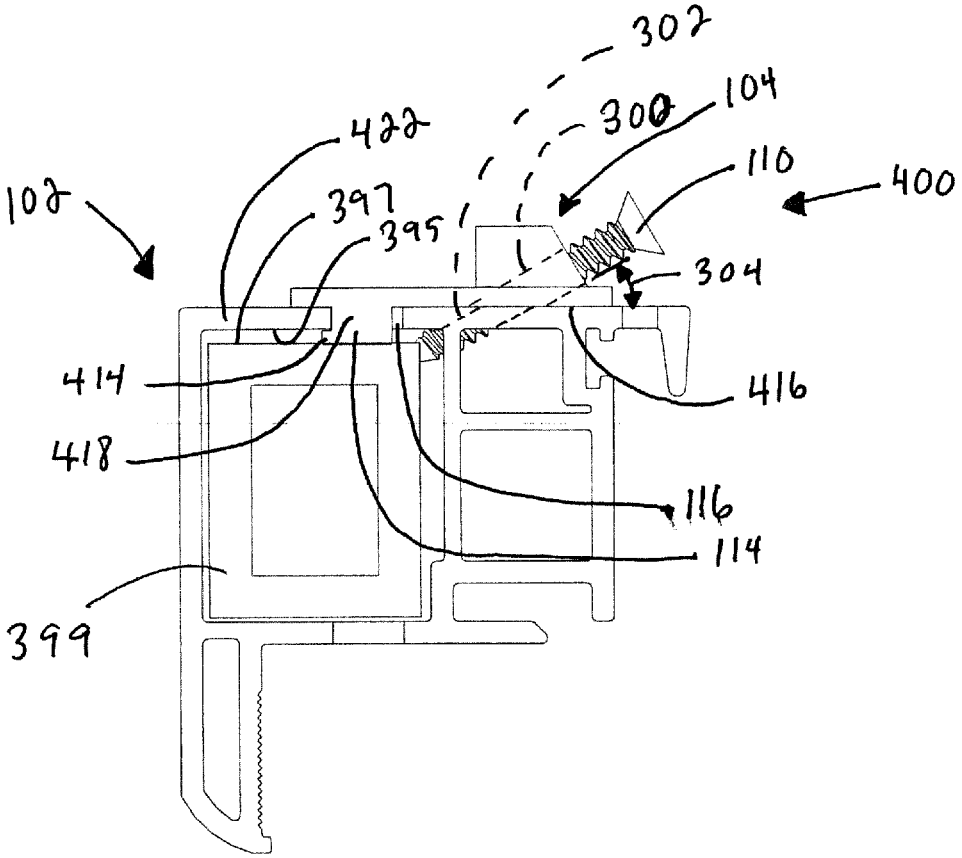
FIG. 3M is a sectional view illustrating the bottom portion of the sash lock body illustrated by FIG. 3K assembled with the hollow reinforced sash component illustrated by FIG. 3F.

FIGS. 3K-3M illustrate another exemplary embodiment of a bottom portion of a sash lock body. Only the bottom portion of the sash lock body is illustrated by FIGS. 3K-3M to simplify the drawings. Alternatively, the bottom portions illustrated by FIGS. 3K-3M may be bases that sash lock covers attach to. In the embodiment illustrated by FIGS. 3K-3M, the body 112 includes mounting projections 114 that fit within openings 116 in the top component 102 of the lower sash frame to assist mounting of the sash lock 104. The mounting projections 114 and openings 116 may aid in alignment of the sash lock 104 to the top component 102 and/or may add to the strength of the connection between the sash lock and the top component 102. It should be appreciated that the openings 116 or recesses can be included on the sash lock 104 instead of the top component 102 and the projections can be included on the top component 102 instead of the sash lock body 112. The mounting projections 114 and openings 116 can take a wide variety of different shapes and sizes. Examples of mounting projections 114 include, but are not limited to pins, flanges, bosses, etc. The openings 116 may be through openings or recesses that have a bottom (i.e. a counterbore).

In the illustrated exemplary embodiment, the mounting projections 114 are cylindrical flanges that are integrally formed with the sash lock body 112. Referring to FIGS. 3K and 3M, the flanges are offset from the bottom surface 416 of the sash lock body 112 by legs 418. The length of the legs 418 corresponds to the thickness of a top wall 422 of the top sash frame component 102. In the embodiment illustrated by FIGS. 3K-3M, the openings 116 are circular cutouts through the top wall 422 of the top sash frame component 102. The circular cutouts are sized to closely accept the flanges 414. The flanges 414 extend under the top wall 422 to partially mount the sash lock 104 to the top sash frame component 102. In an exemplary embodiment, the circular cutouts 116 and the flanges 414 are configured such that when the flanges are placed through the cutouts and the legs 418 are in contact with a front wall of the cutouts 116, the mounting passages 300 are aligned with pre-formed securing passages 302. Fasteners 110 are placed through the passages 300 and are driven into the securing passages 302 to complete the mounting of the sash lock to the top sash frame component.

In an exemplary embodiment, the flanges 414 illustrated by FIGS. 3K-3M are configured to eliminate or minimize interference with the reinforcement member 399. In the example illustrated by FIGS. 3K-3M, a top surface 397 of the reinforcement member 399 is spaced apart from a bottom surface 395 of a top wall 422 of the window sash frame component. The illustrated flange 414 clears or touches the top surface of the reinforcement member. In another exemplary embodiment, the reinforcement material 399 is a foam that fills the window sash component. In this embodiment, the configuration of the circular ends and the low profile of the flanges 414, allows the flanges to be inserted through the opening 116 and press into the foam reinforcement material. For example, the low profile flange 414 may extend below the bottom surface 395 of the top wall by a distance of less than ⅛", less than 1/16", or less than 1/32".

Figure 9A:
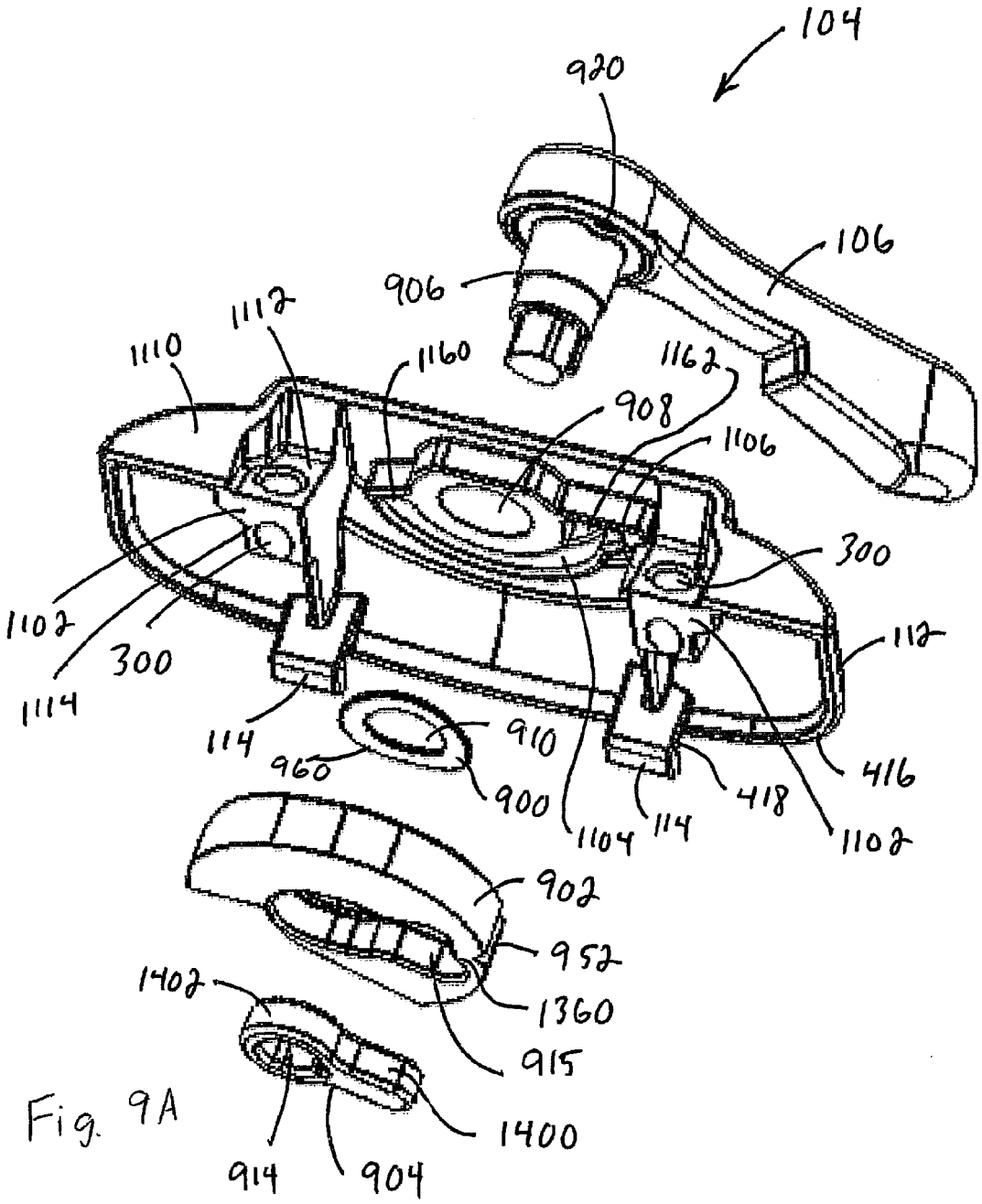
FIG. 9A is an exploded perspective view of the sash lock illustrated by FIG. 8A.
Figure 9B:
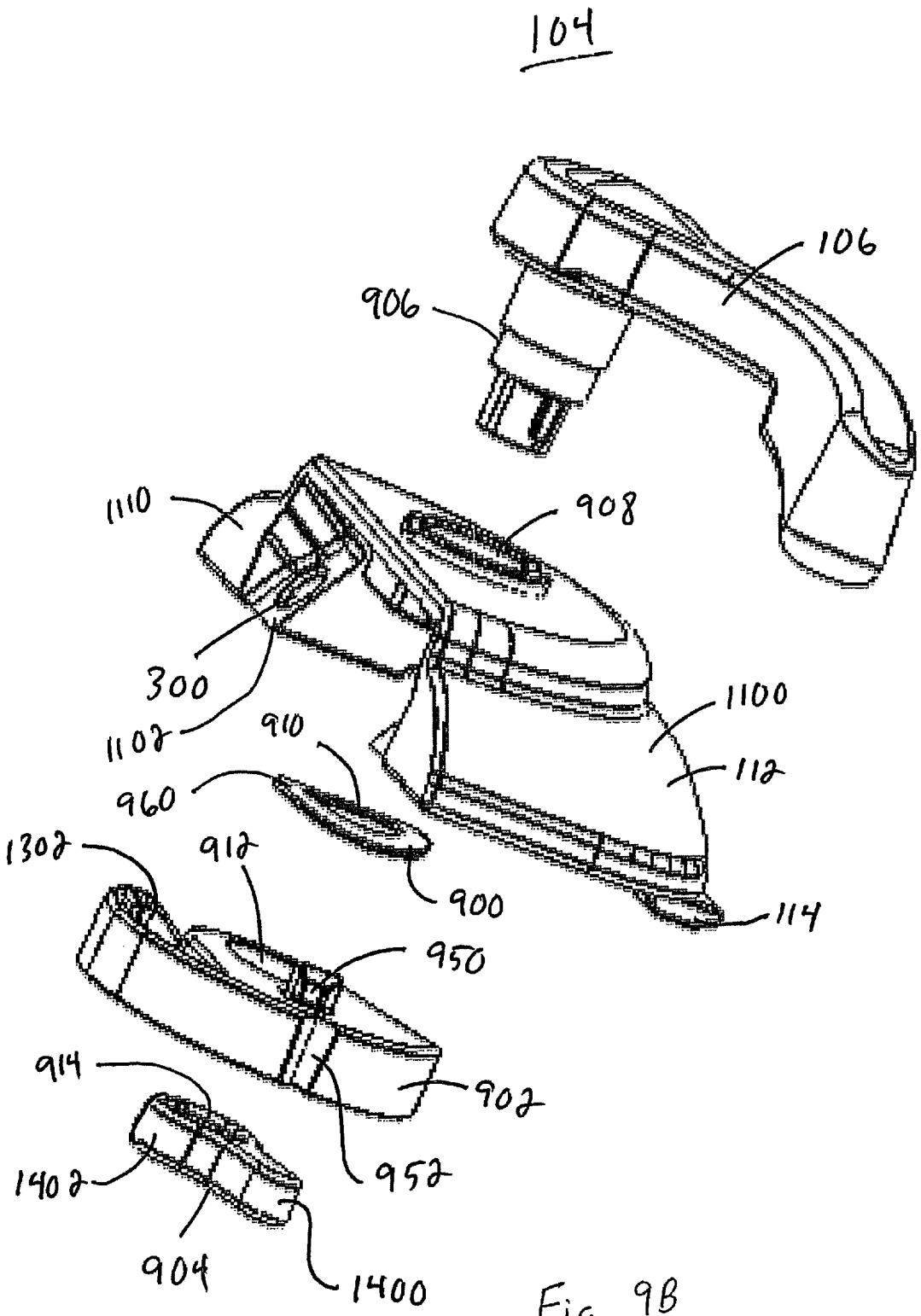
FIG. 9B is another exploded perspective view of the sash lock illustrated by FIG. 8A.
Figure 9C:
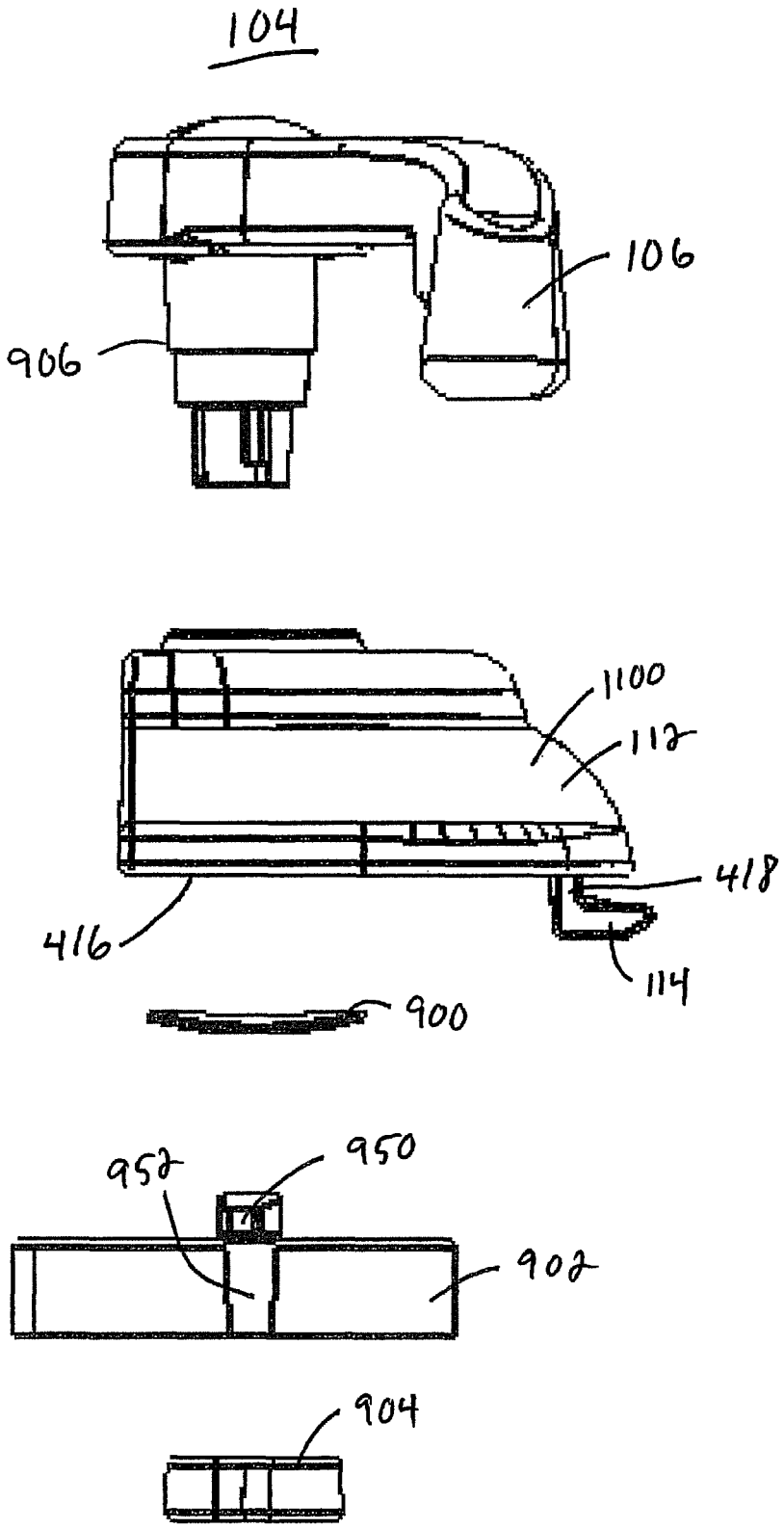
FIG. 9C is an exploded side view of the sash lock illustrated by FIG. 8A.

The sash lock 104 may take a wide variety of different forms. Referring to FIGS. 9A-9C, in an exemplary embodiment the sash lock 104 includes the handle 106, the sash lock body 112, a spring washer 900, a cam member 902, and a drive member 904. The handle can take a wide variety of different forms. In the illustrated handle 106 includes a shaft 906. The shaft extends through a clearance opening 908 in the body 112, a clearance opening 910 in the spring washer 900, an oblong clearance opening 912 in the cam member 902, and is secured in an opening 914 in the drive member 904. The drive member 904 fits within a drive recess 915 in the cam member 902. Rotation of the handle 106 rotates the drive member 904 to engage the surface of the drive recess 915 to move the cam member between an unlocked position and a locked position.

Figure 10A:
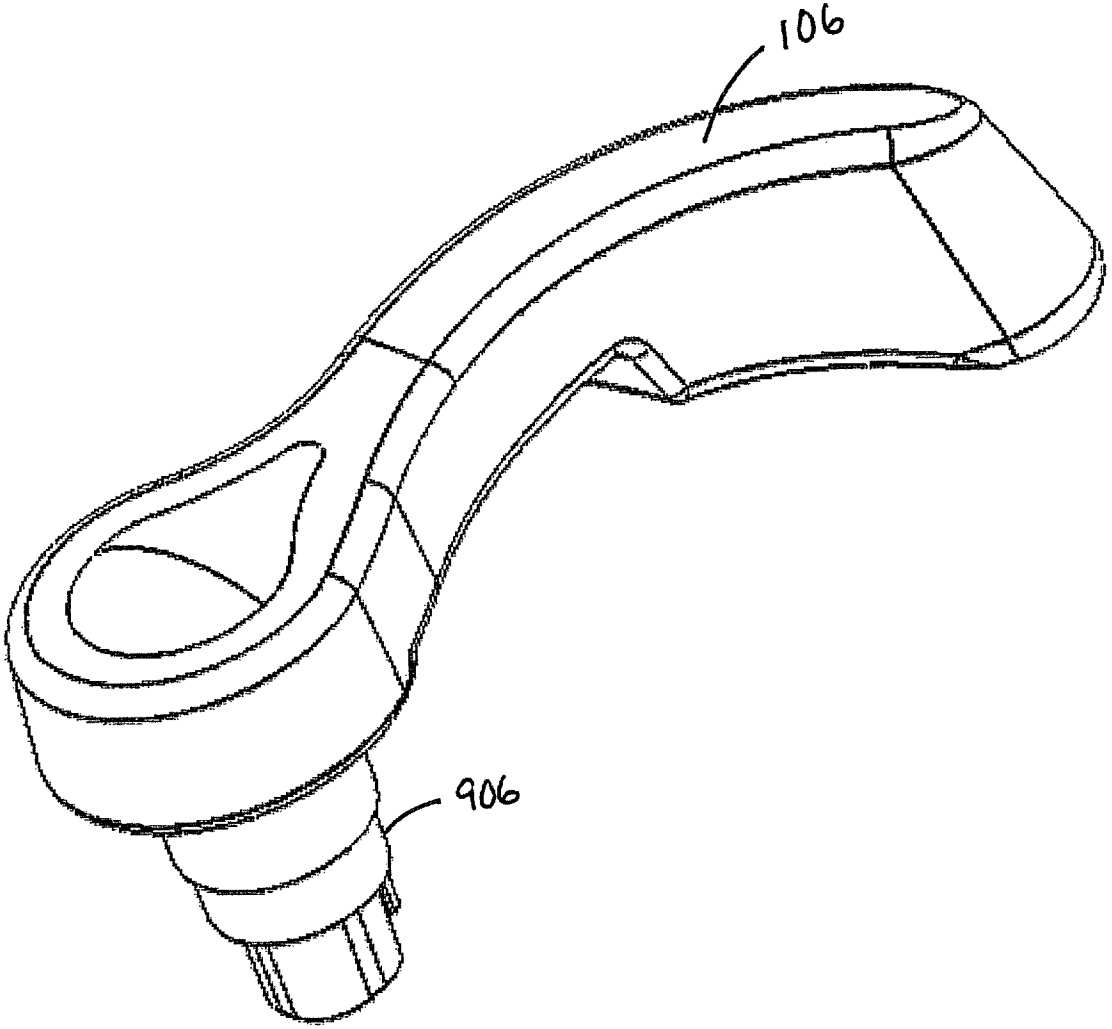
Figure 10B:
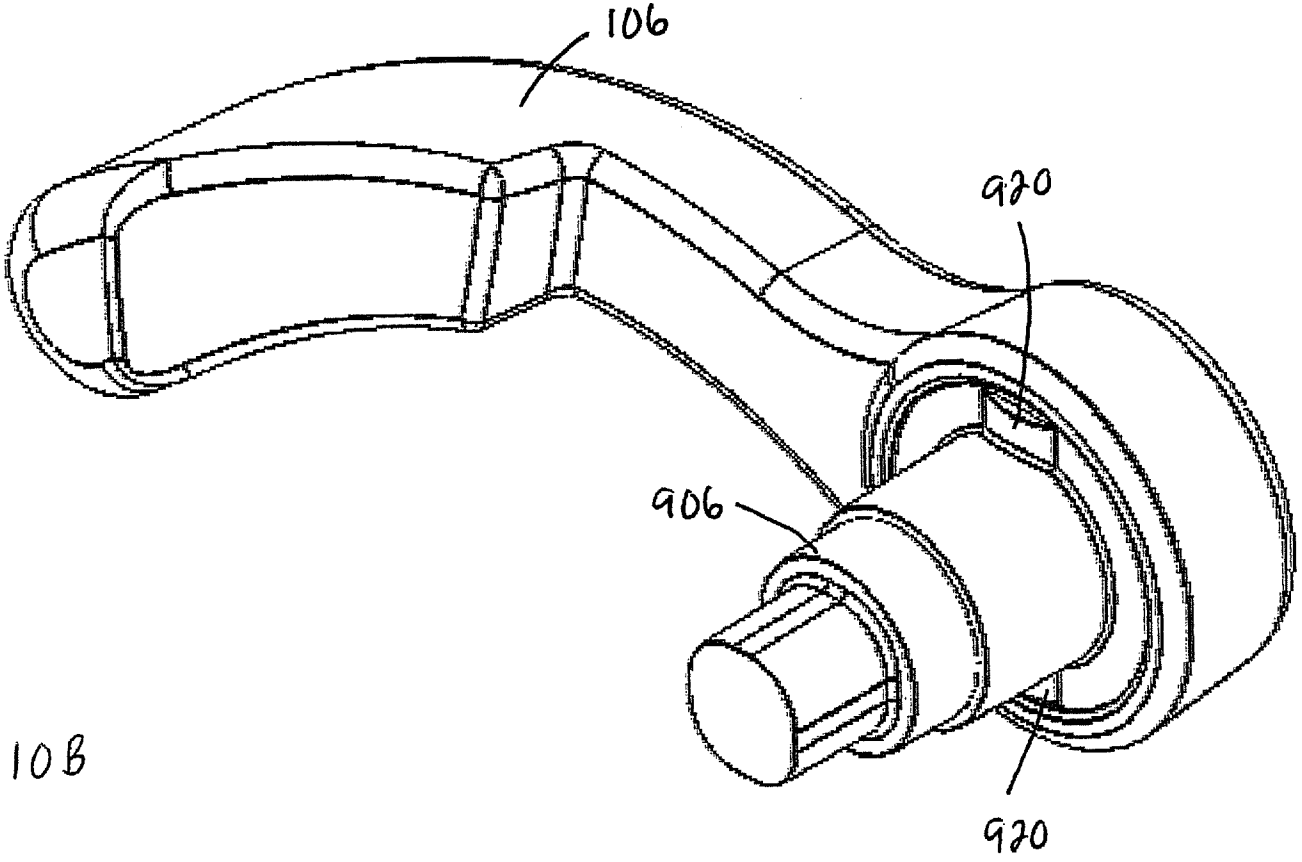
Figure 10C:
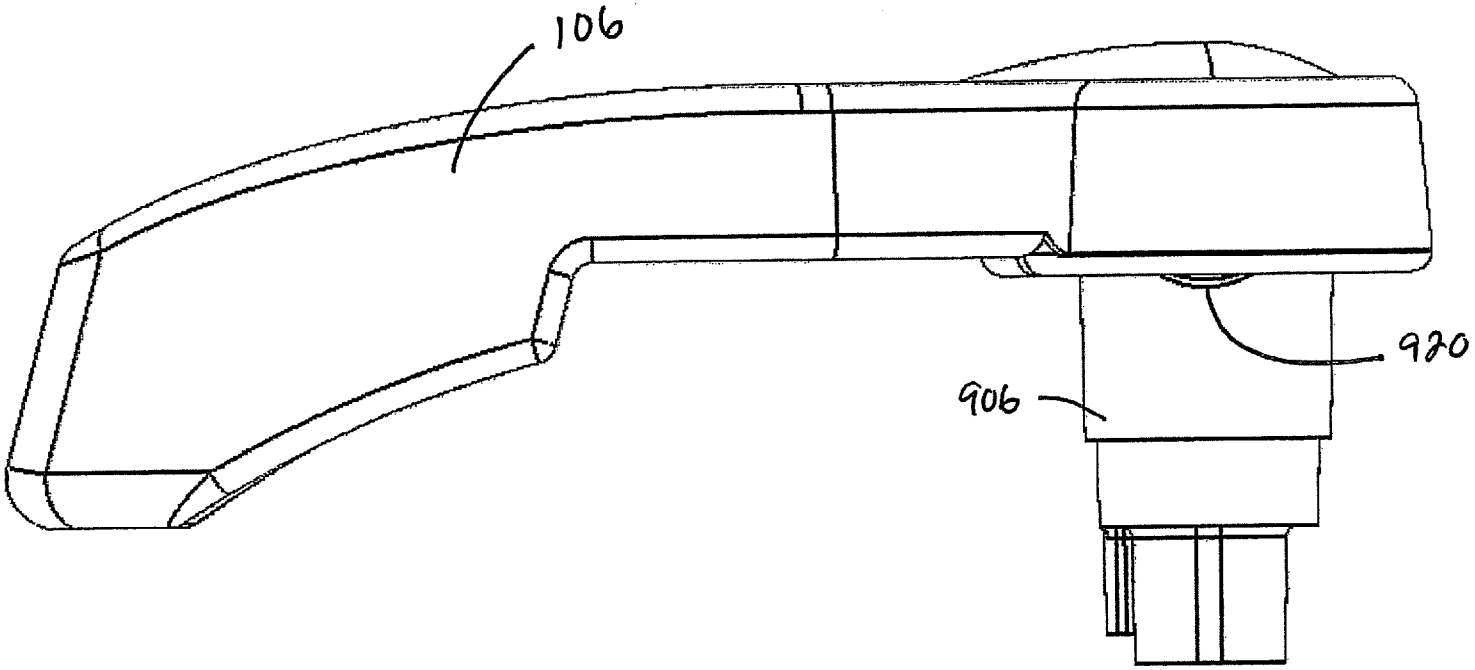
Figure 10D:
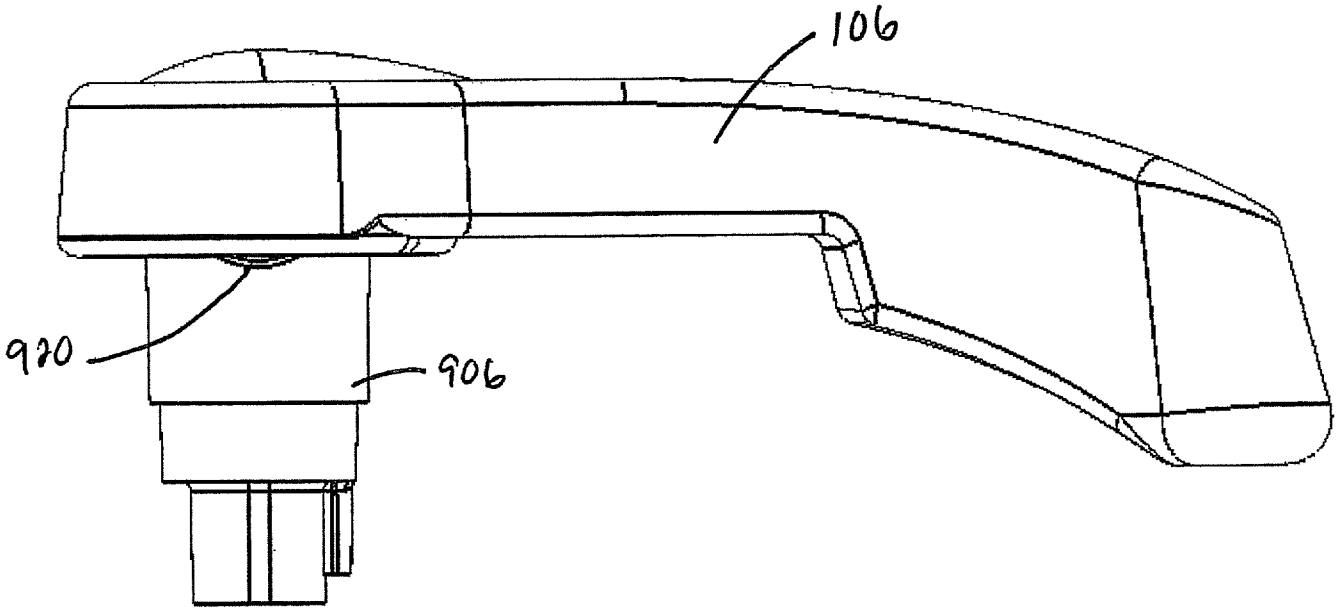
Figure 10E:
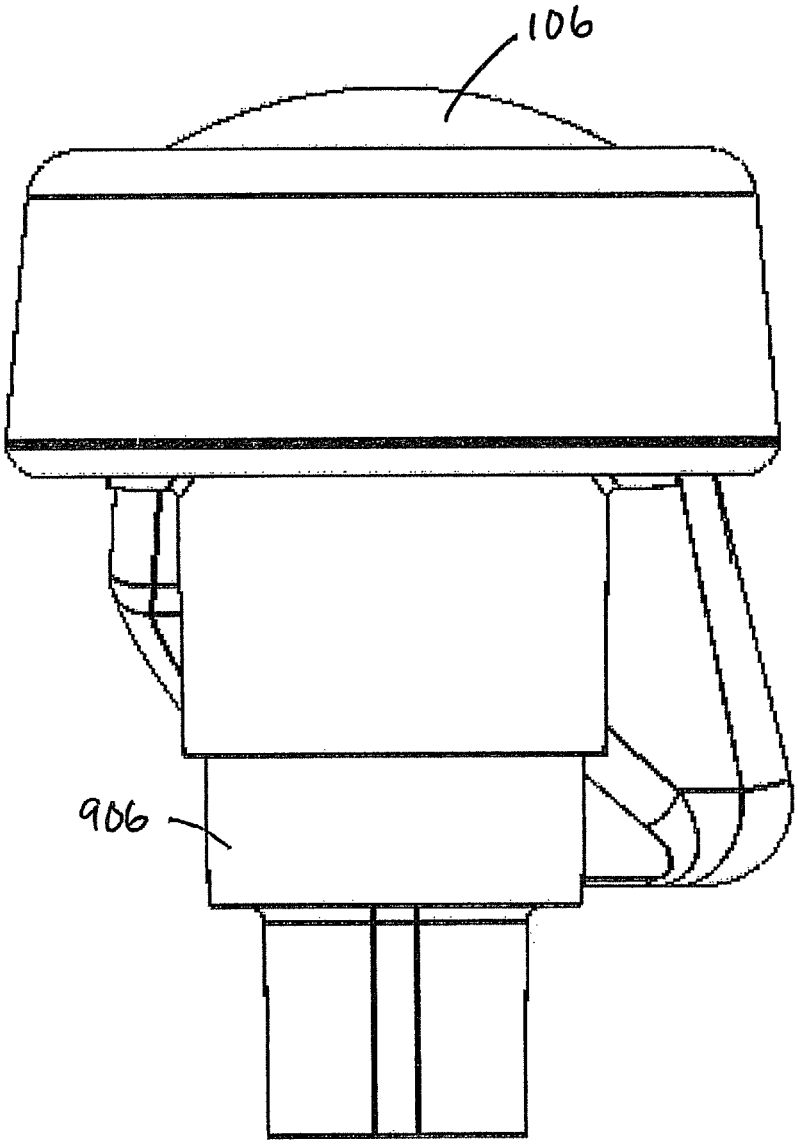
Figure 10F:
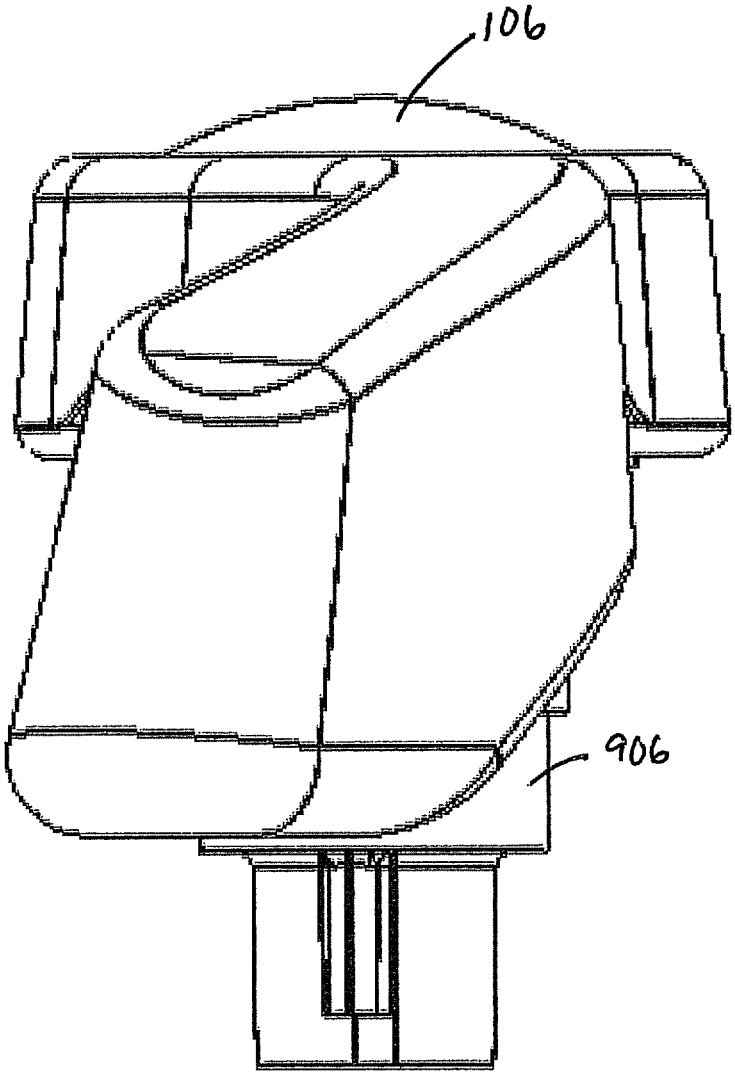
Figure 10G:
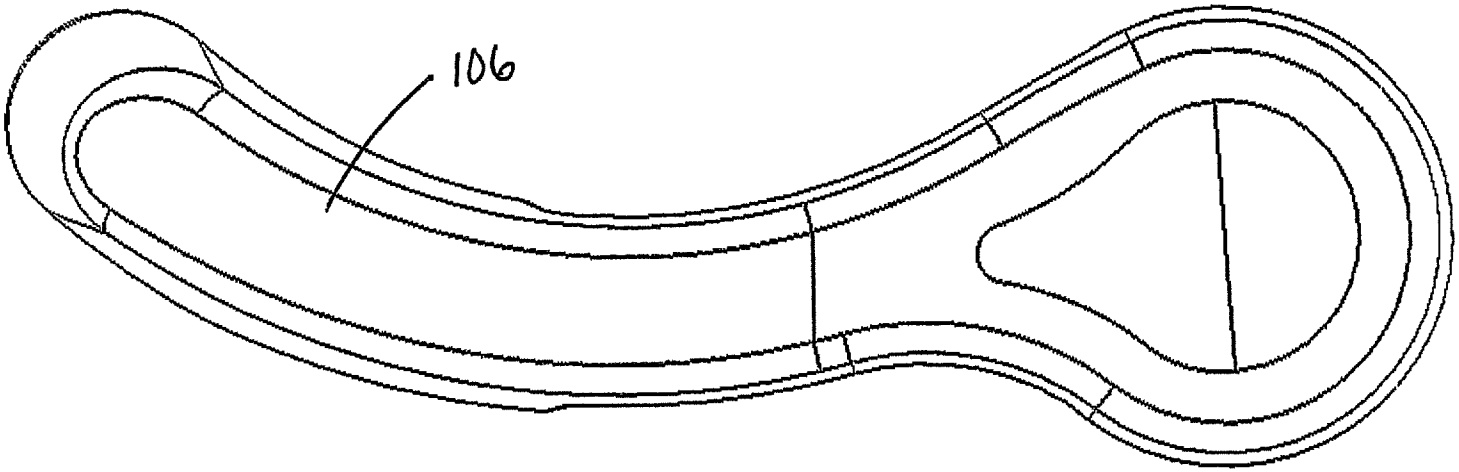
Figure 10H:
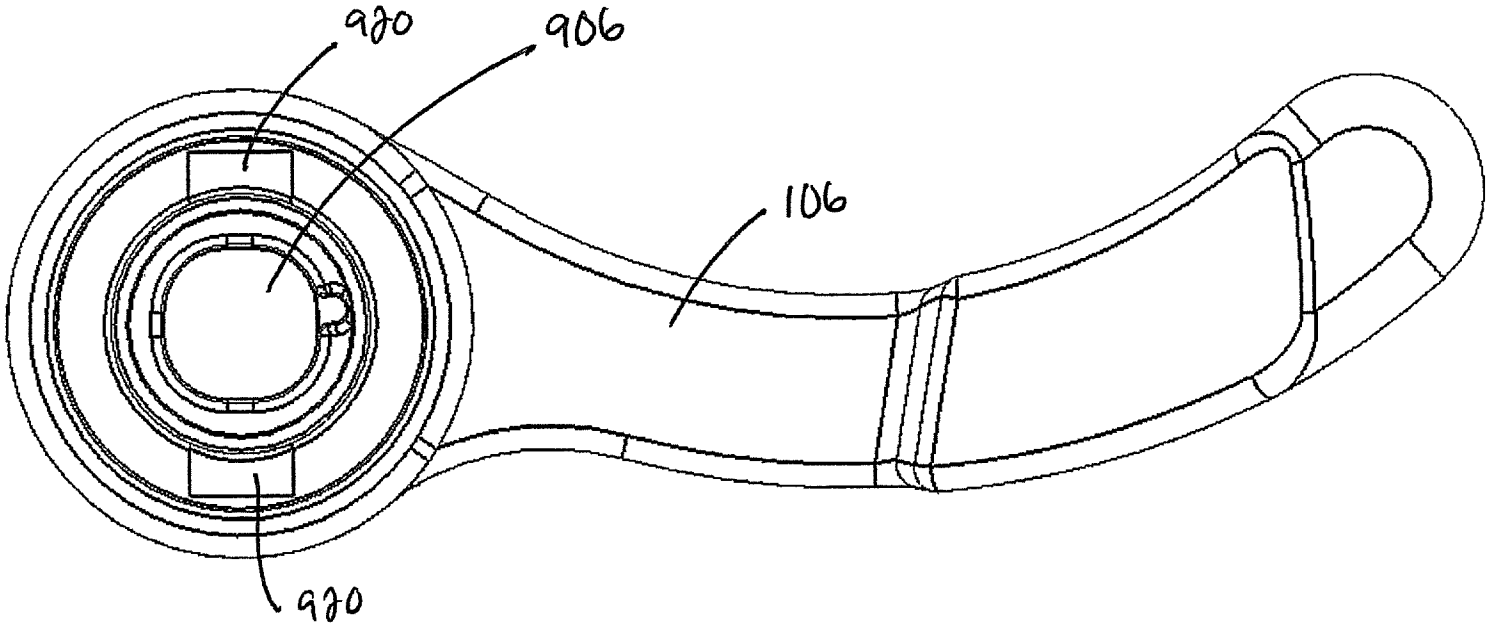
Figure 11A:
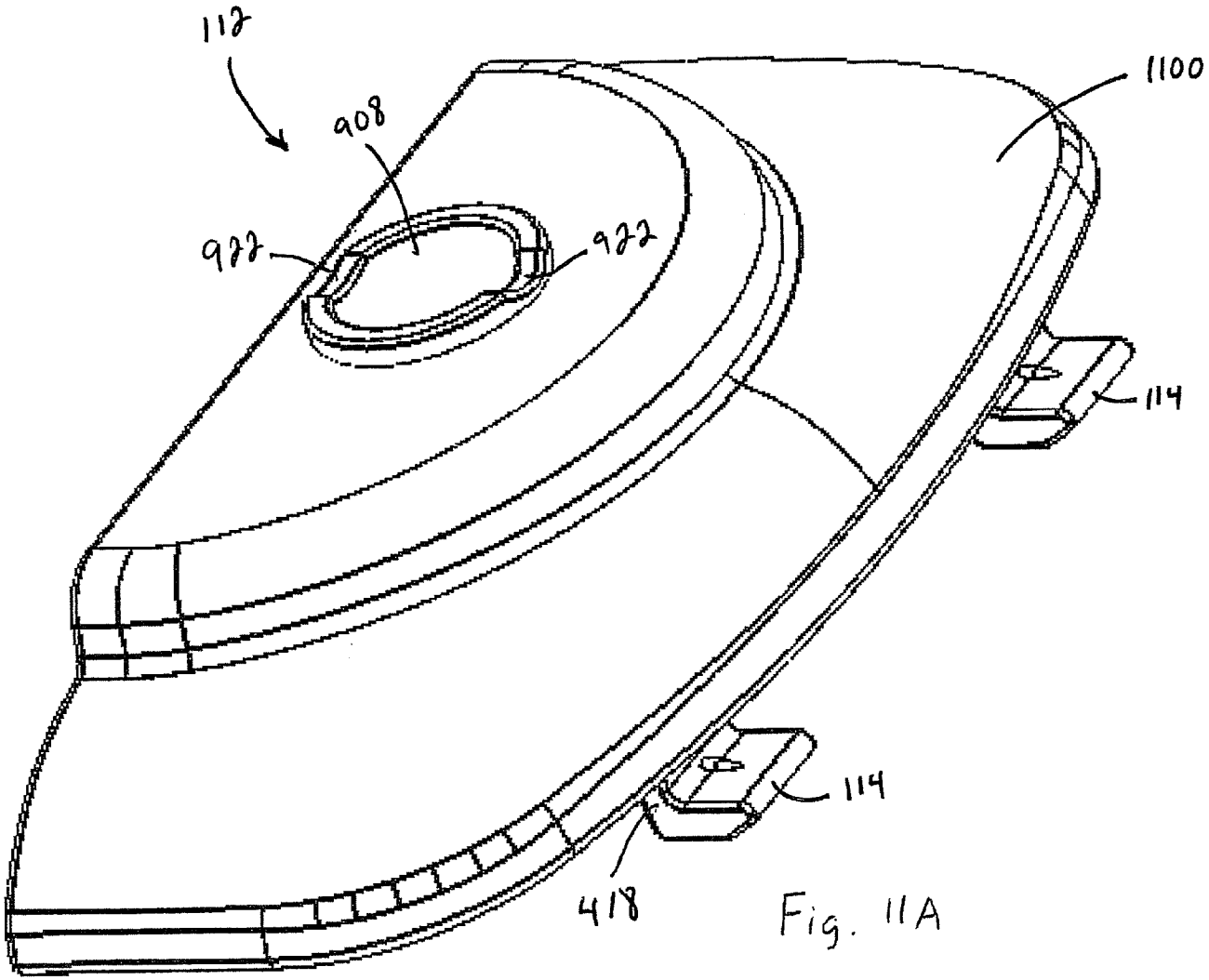
FIG. 11A is a perspective view of a housing of the sash lock assembly illustrated by FIG. 8A.
Figure 11B:
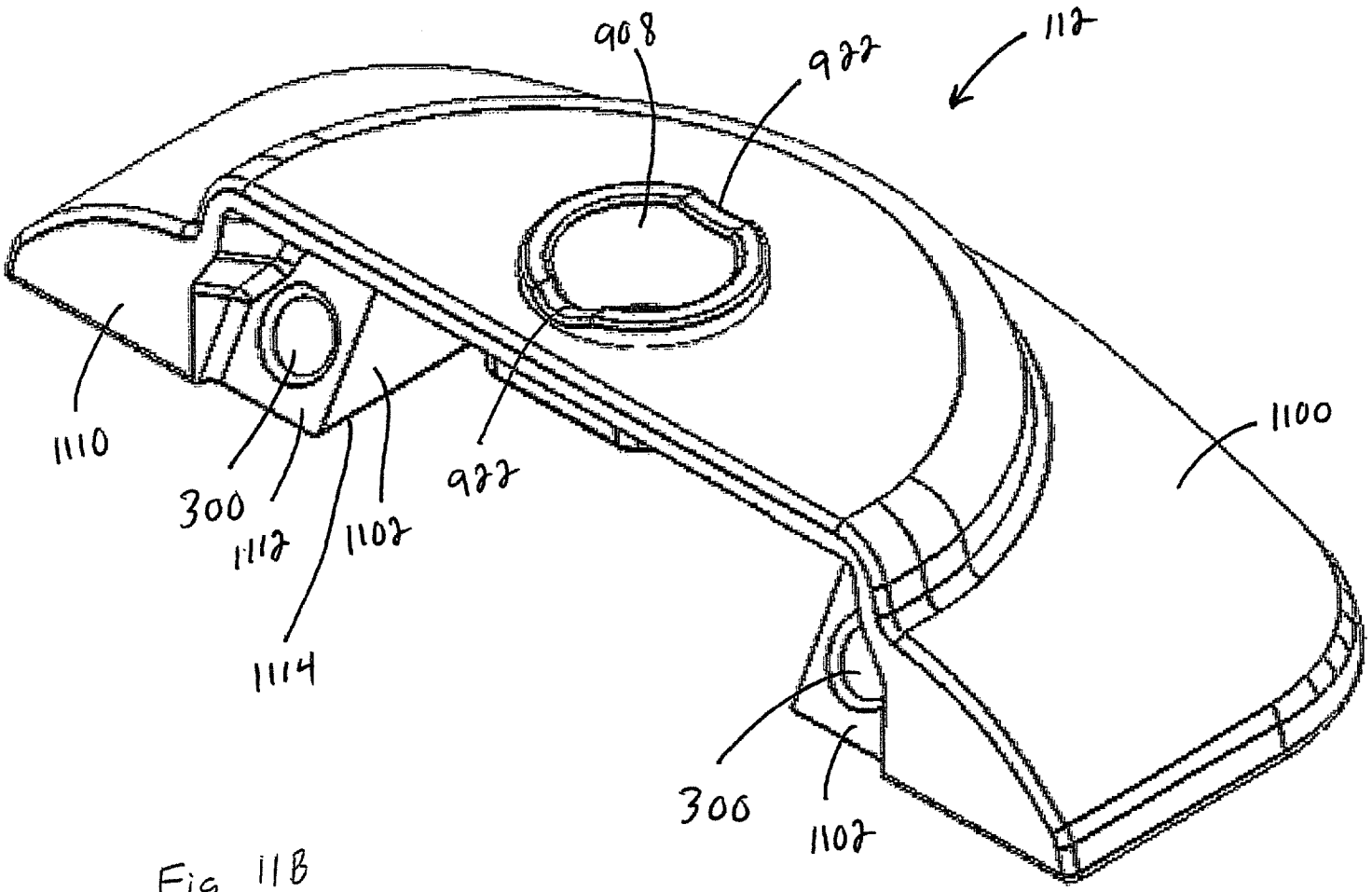
FIG. 11B is another perspective view of the housing illustrated by FIG. 11A.
Figure 11C:
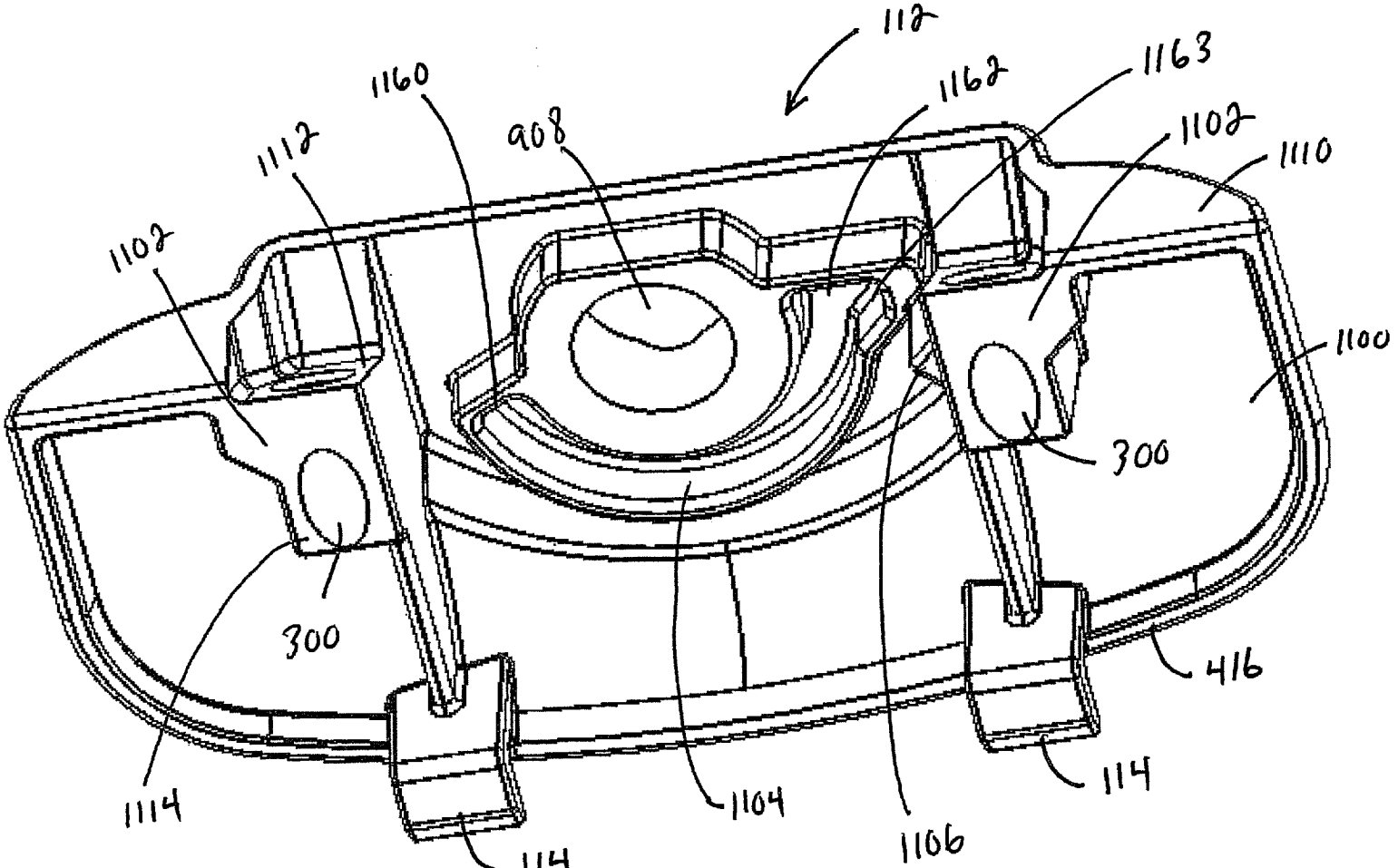
FIG. 11C is another perspective view of the housing illustrated by FIG. 11A.
Figure 11D:
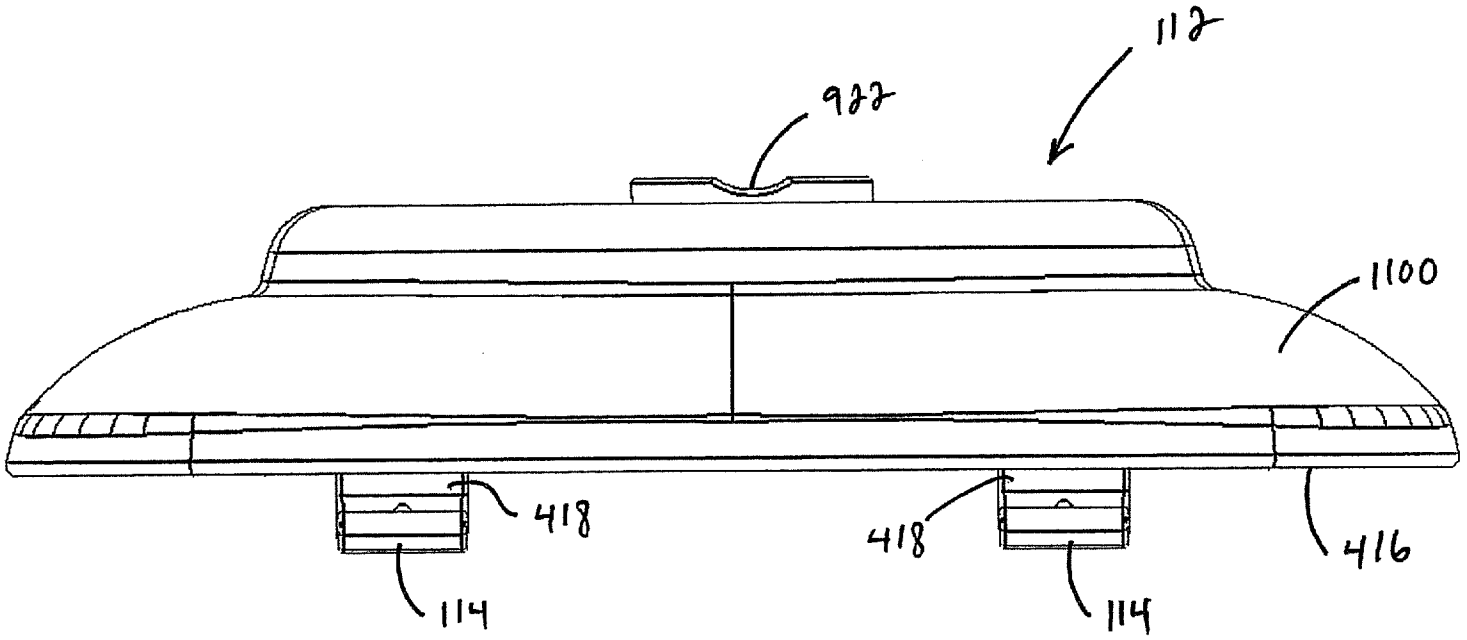
FIG. 11D is a front view of the housing illustrated by FIG. 11A.
Figure 11E:
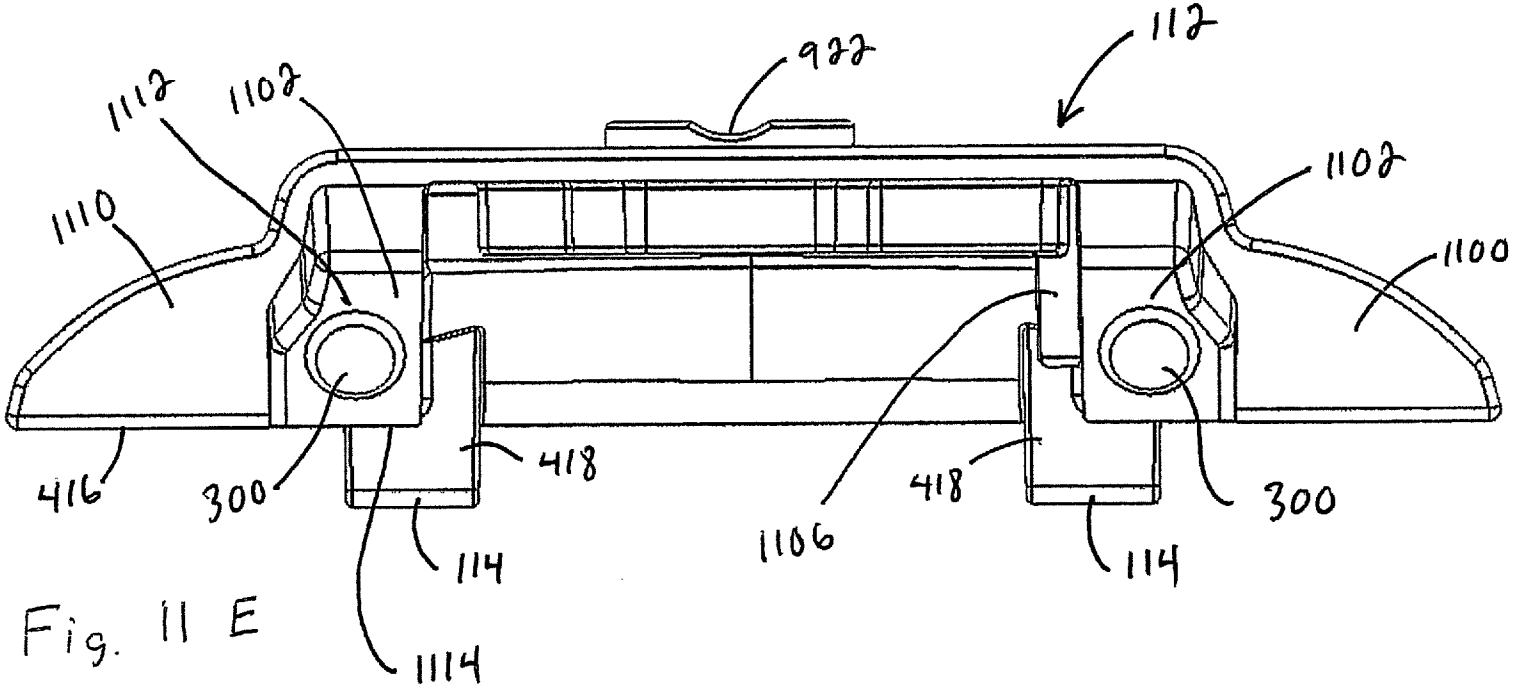
FIG. 11E is a rear view of the housing illustrated by FIG. 11A.
Figure 11F:
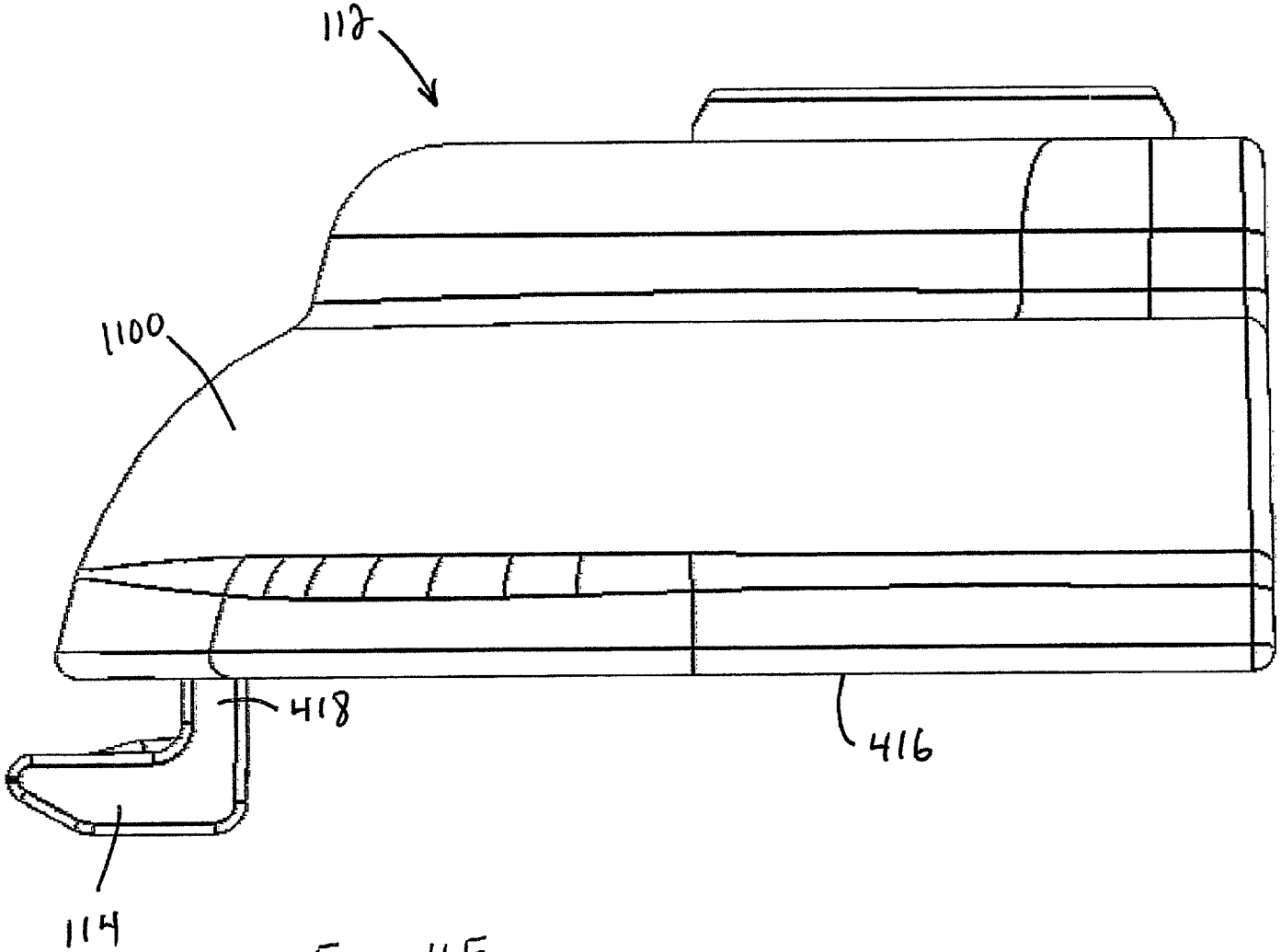
FIG. 11F is a side view of the housing illustrated by FIG. 11A.
Figure 11G:
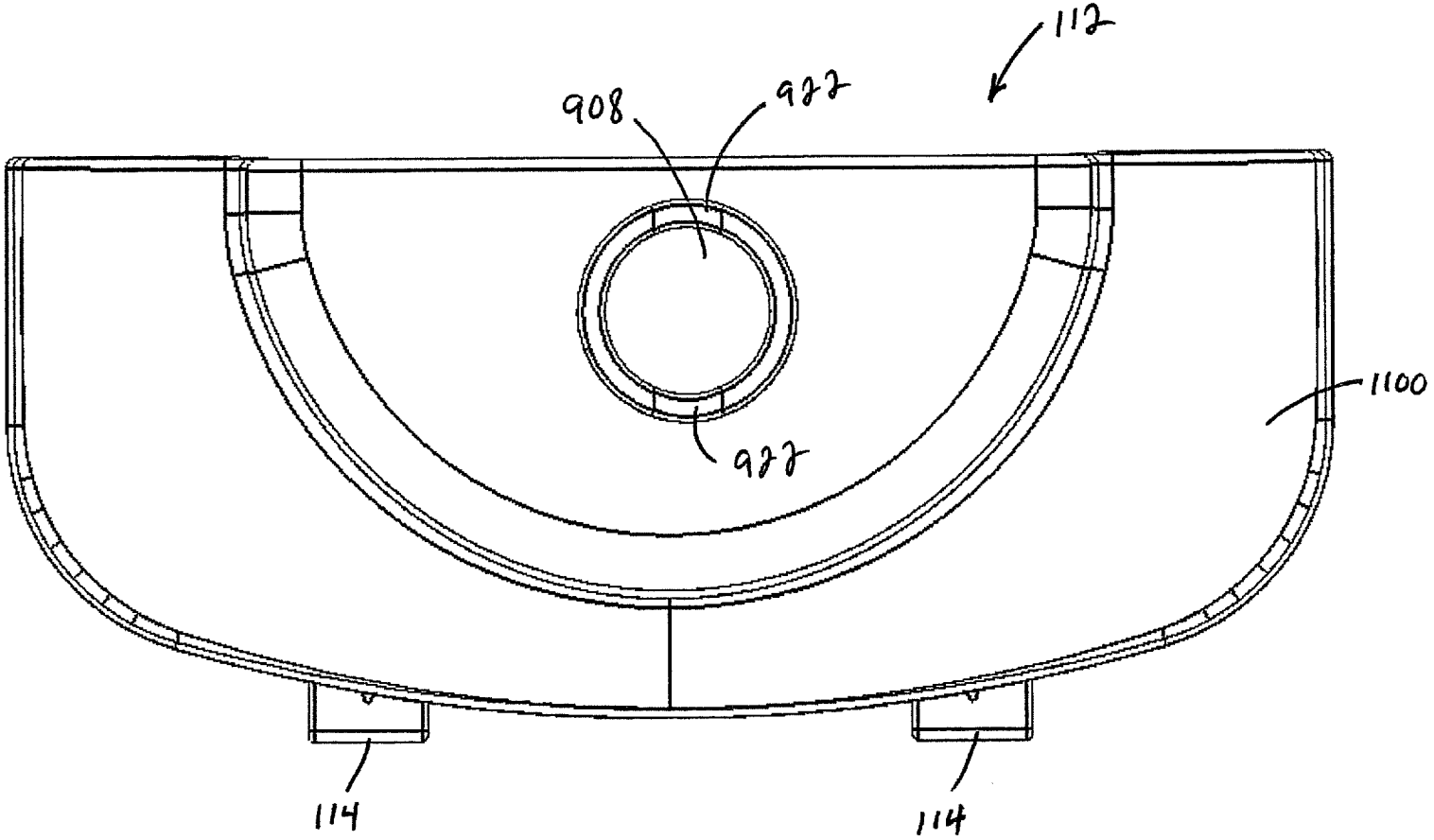
FIG. 11G is a top view of the housing illustrated by FIG. 11A.
Figure 11H:
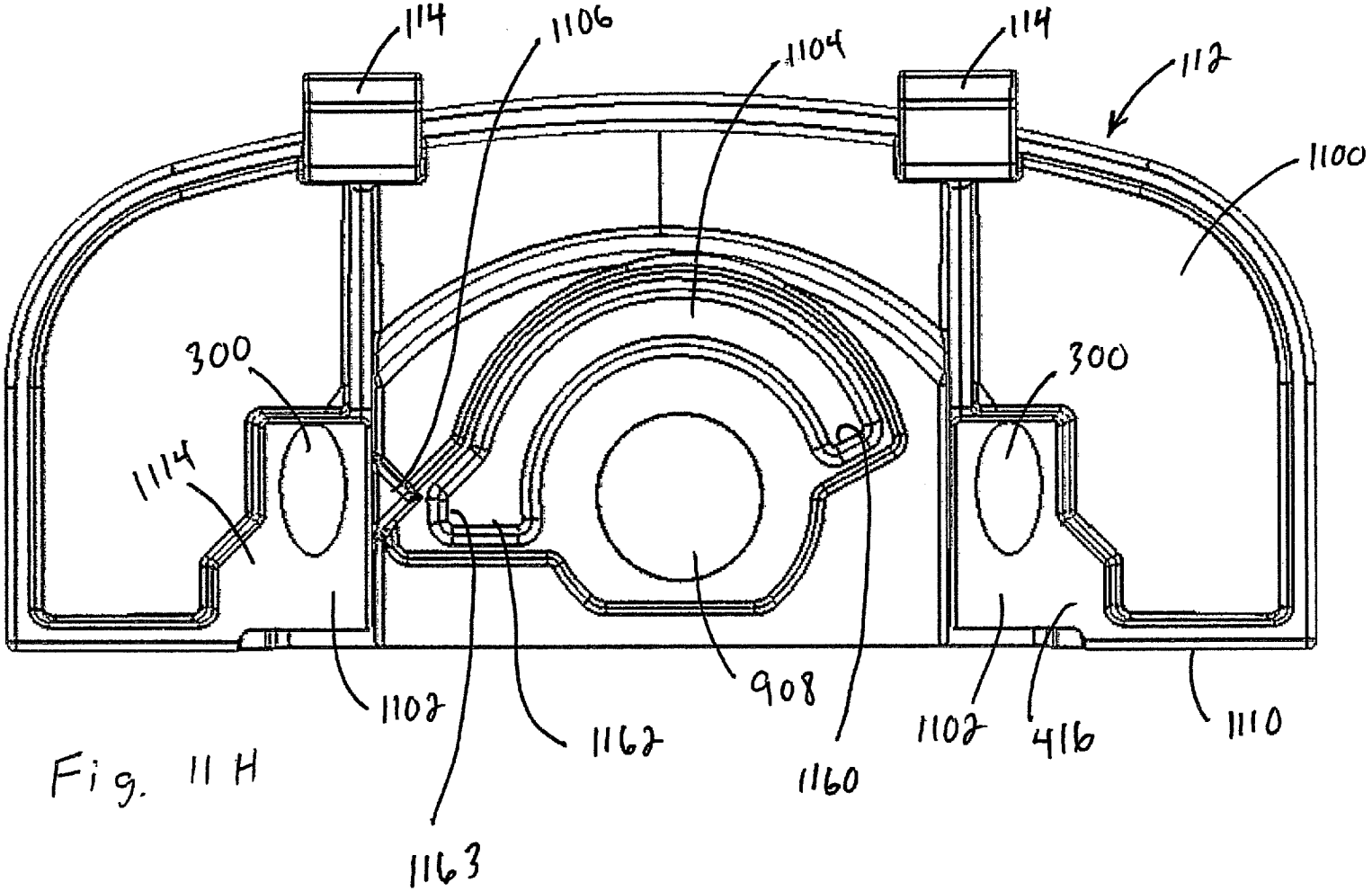
FIG. 11H is a bottom view of the housing illustrated by FIG. 11A.

The spring washer 900 acts between the sash lock body 112 and the cam member 902 to pull the handle 106 into engagement with the sash lock body 112. The spring washer 900 can be replaced with another type of spring. The handle includes one or more projections 920 (See FIG. 10B) that mate with one or more depressions 922 (See FIG. 11A) on the sash lock body 112 (or vice versa). The biasing force provided by the spring washer 900 causes the projections 920 and depressions 922 to act as a detent mechanism. In one exemplary embodiment, the projections 920 and depressions 922 are positioned to provide detents or positive/tactile stops at the locked and unlocked positions of the sash lock 104.

The sash lock body 112 can take a wide variety of different forms. In the exemplary embodiment illustrated by FIGS. 11A-11H, the sash lock body is an integral (i.e. single piece) that includes a body portion 1100, the flanges 414, the opening 908, mounting blocks 1102 that include the passages 300, a cam track 1104, and a cam locking projection 1106. The cover portion 1100 provides an aesthetically pleasing appearance while concealing the working components (i.e. the spring washer, cam member, and drive member) and the fasteners 110 from view. That is, the cover portion 1100 shields the working components and the fasteners 1100 from view when the cover portion is viewed from the front (indicated by arrow "A" in FIG. 11A. The mounting projections 114 are rectangular flanges that are offset from a bottom surface 416 of the sash lock body 112 by a legs 418. The opening 908 is sized to accept the shaft 906 of the handle 106. The body 112 includes depressions 922 on the outside of the opening 908. The mounting blocks 1102 are recessed from a rear surface 1110 and are flush with the bottom surface 416. A passage 300 passes from a rear surface 1112 to a bottom surface 1114 of each mounting block 1102. As such, the passages 300 form an angle 304 with respect to a bottom surface 416 of the body 112 (See FIG. 3D). The cam track 1104 is sized to accept a projection 950 (see FIG. 9B) of the cam member 902. The interaction between the projection 950 and the cam track 1104 define the motion of the cam member 902 as the cam member is driven by the drive member 904 upon rotation of the handle 106. The cam locking projection 1106 is configured to engage a recess 952 (see FIG. 9B) in the cam member 902 when the sash lock is moved to a locked position. This engagement of the locking projection 1106 with the recess 952 positively locks the sash lock 104 in the locked position and prevents the sash lock from being opened by engaging the cam member 902 and attempting to force the sash lock to an open position. That is, in an exemplary embodiment, the sash lock 104 can only be opened by rotating the handle 106.

The spring washer 900 can take a wide variety of different forms and may be omitted in some applications. In the exemplary embodiment illustrated by FIG. 12A and 12B, the spring washer 900 is an undulating ring 960 with the opening 910. However, other types of springs and/or washers can be used. Examples of suitable biasing members include, but are not limited to, Belleville washers, compression springs, and the like.

Figure 5A:
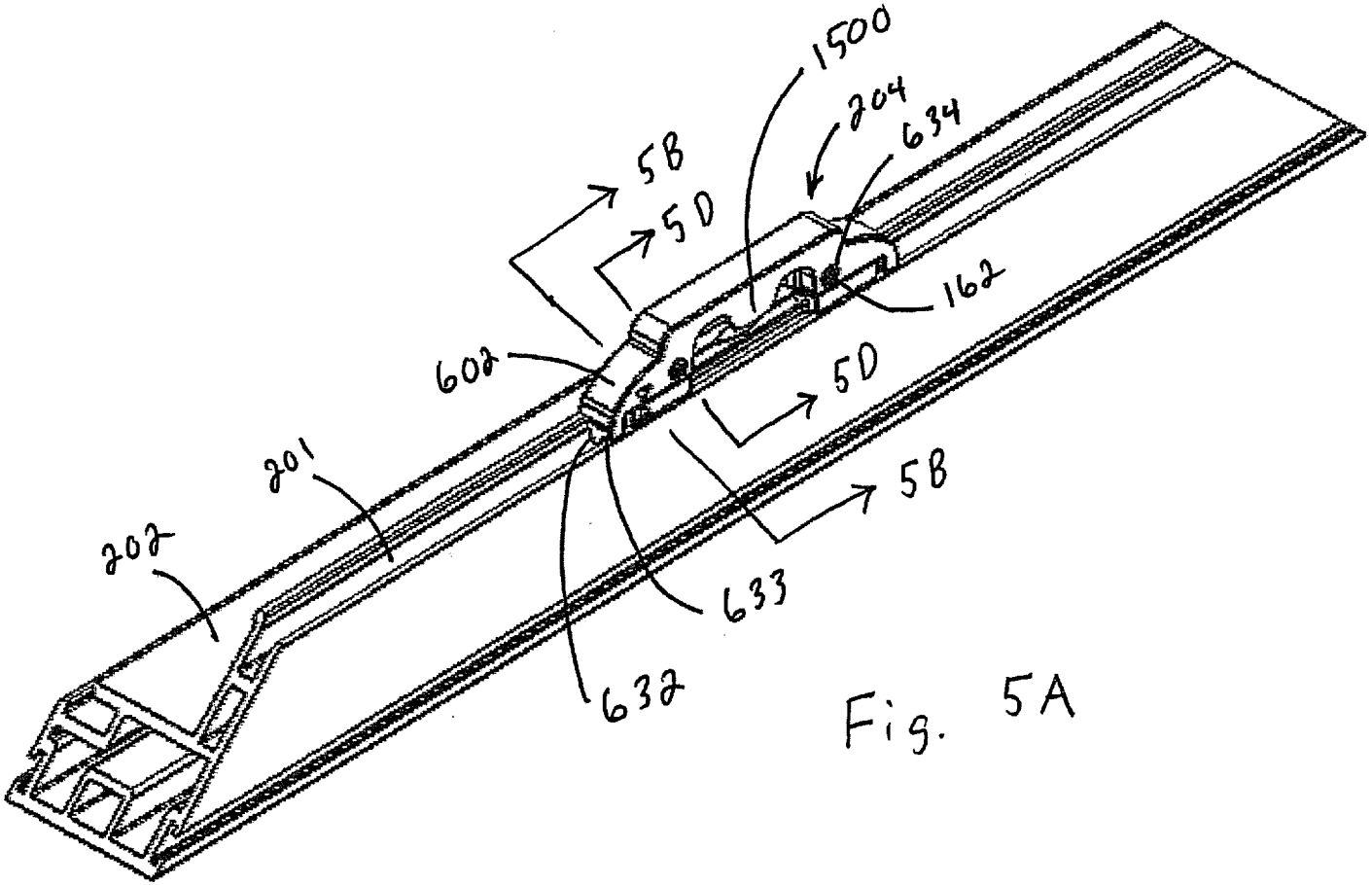
FIG. 5A is a perspective view illustrating a keeper assembly assembled with a window sash component.
Figure 58:
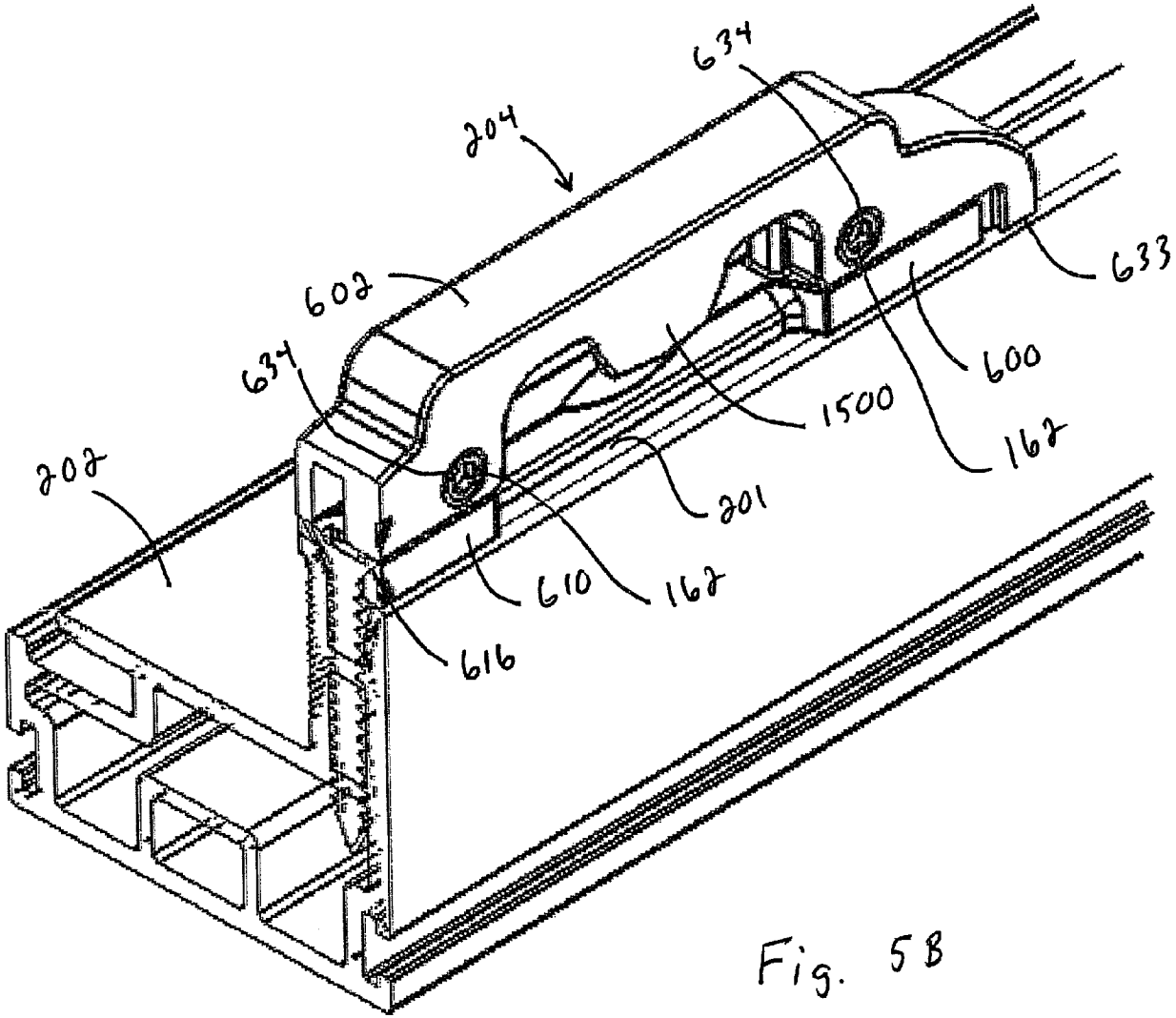
Figure 5C:
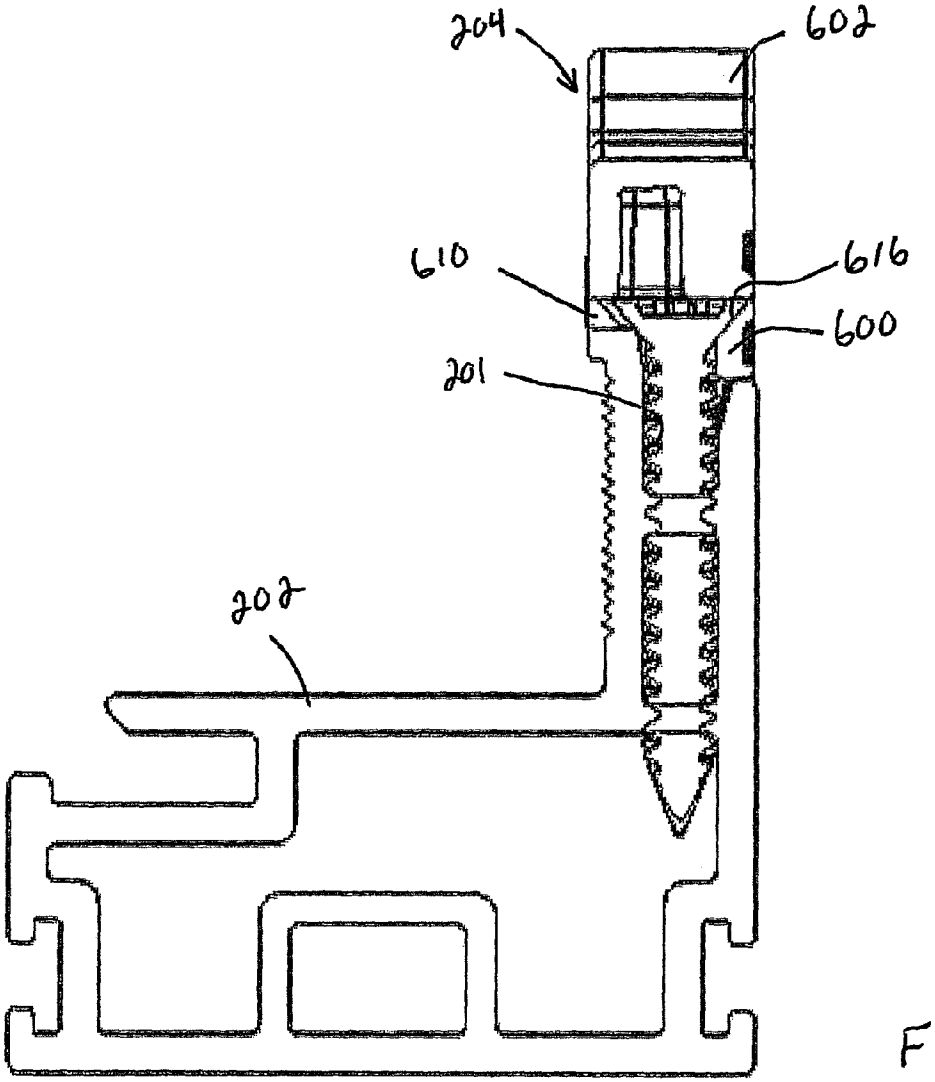
FIG. 5C is a sectional view taken along the plane indicated by lines 5B-5B in FIG. 5A.
Figure 7A:
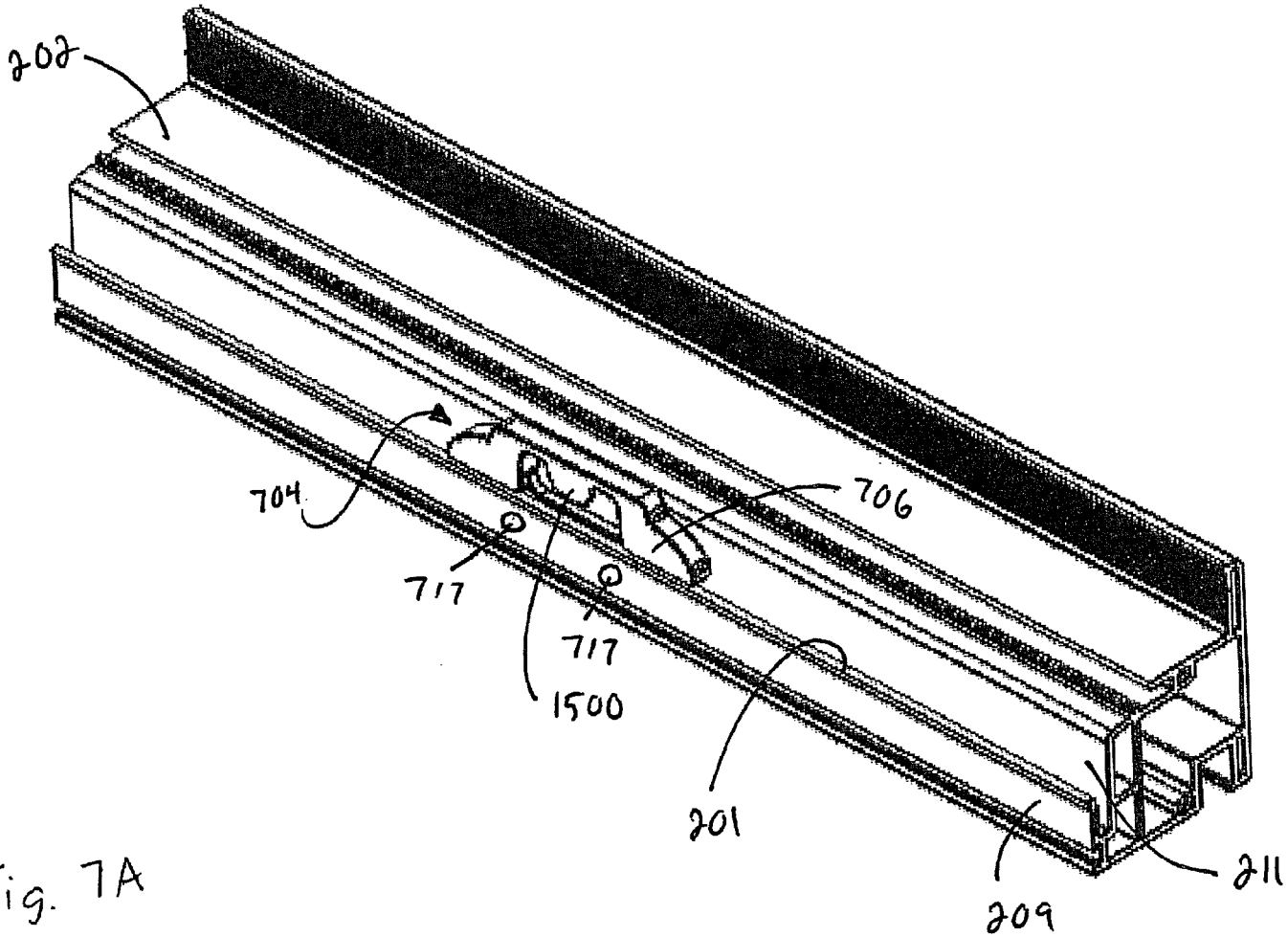
FIG. 7A is a perspective view of another embodiment of a keeper and a sash component.
Figure 7B:
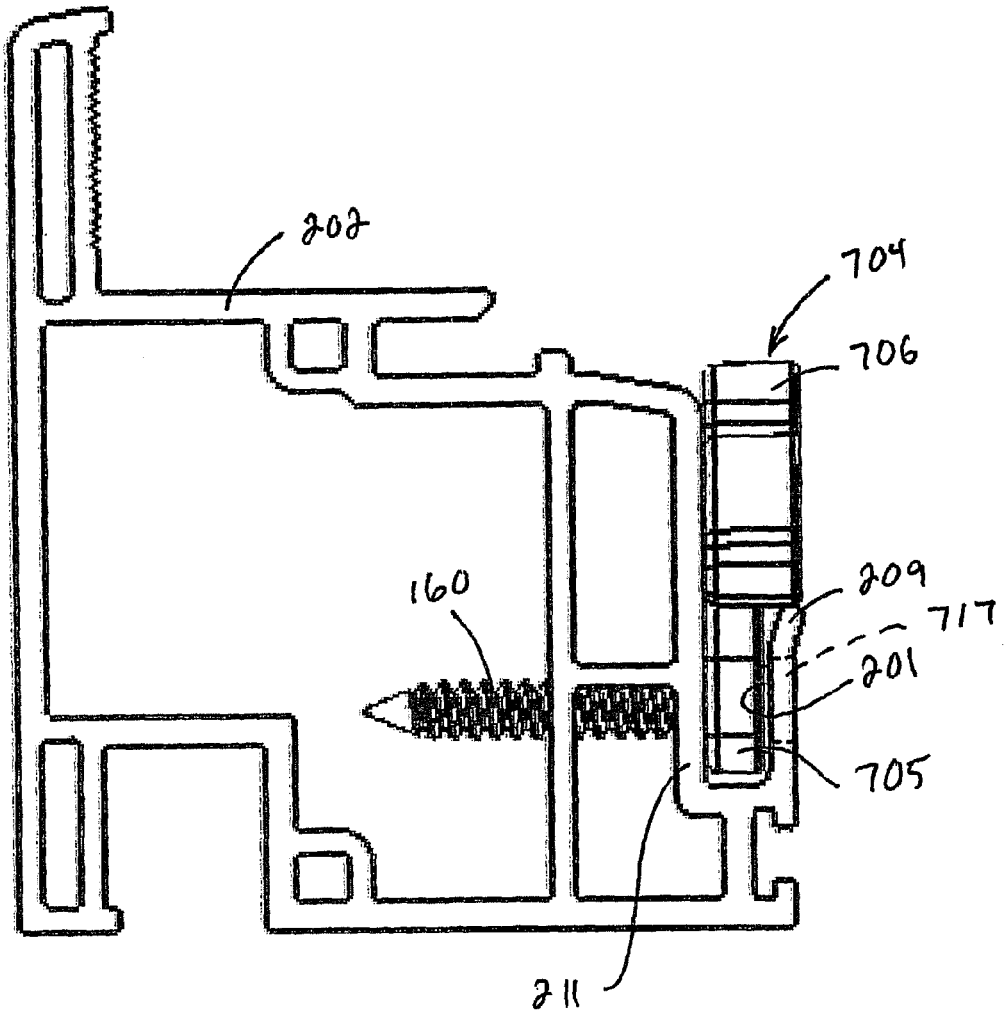
FIG. 7B is an end view of the keeper and sash component illustrated by FIG. 7A.
Figure 7C:
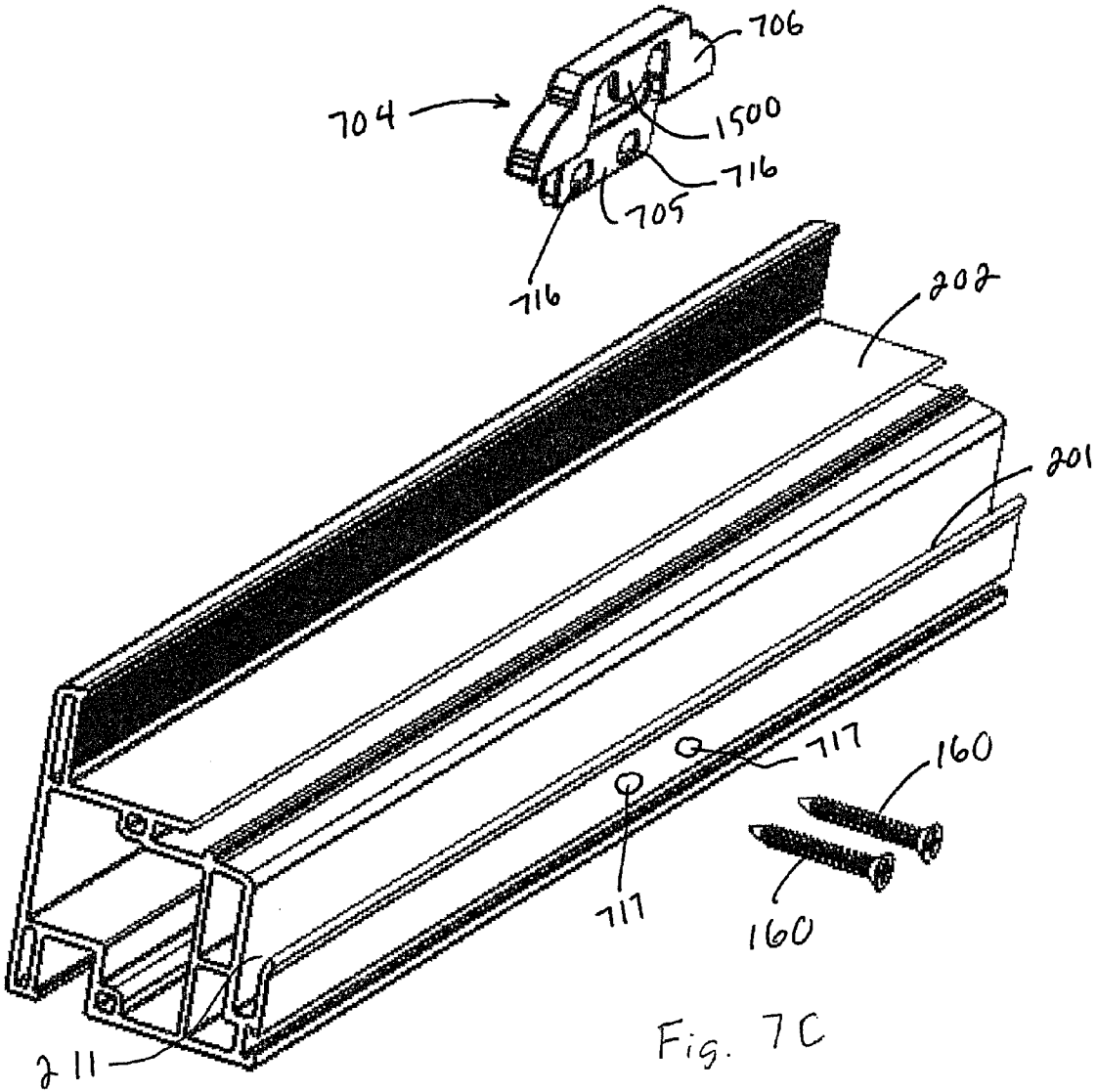
FIG. 7C is and exploded perspective view of the keeper and sash component illustrated by FIG. 7A.

The cam member 902 can take a wide variety of different forms. In the exemplary embodiment illustrated by FIGS. 13A-13F, the cam member 902 is an integral (i.e. single piece) that includes a base portion 1300, a keeper engagement ramp 1302, an oblong opening 912, the drive recess 915, the cam projection 950, and the locking recess 952. The keeper engagement ramp 1302 is configured to engage a locking projection 1500 (See FIGS. 5A and 7A) of the keeper 204 when the locking arrangement is locked and to clear the projection 1500 when the locking arrangement is unlocked. The keeper engagement ramp 1302 can take a wide variety of different forms. In the illustrated embodiment, the keeper engagement ramp 1302 includes a floor 1320 and a side wall 1322. When the window is closed and the locking arrangement 100 is moved to the locked position, the sidewall 1322 moves behind the keeper projection 1500 and the floor 1320 moves below the keeper projection 1500. This position of the keeper engagement ramp 1302 prevents the top sash from moving down and prevents the bottom sash from moving up.

The oblong opening 912 is sized to accept the shaft 906 and allow the cam member 902 to laterally move along the longer dimension of the opening 912. The drive recess 915 is sized to accept the drive member 904. In the illustrated embodiment, the drive recess 915 includes a rotation zone 1350 and a locking zone 1352 where a leg 1400 of the drive member resides based on the position of the handle 106 and the position of the projection 950 in the cam track 1104 of the sash lock body 112.

Figure 14A:
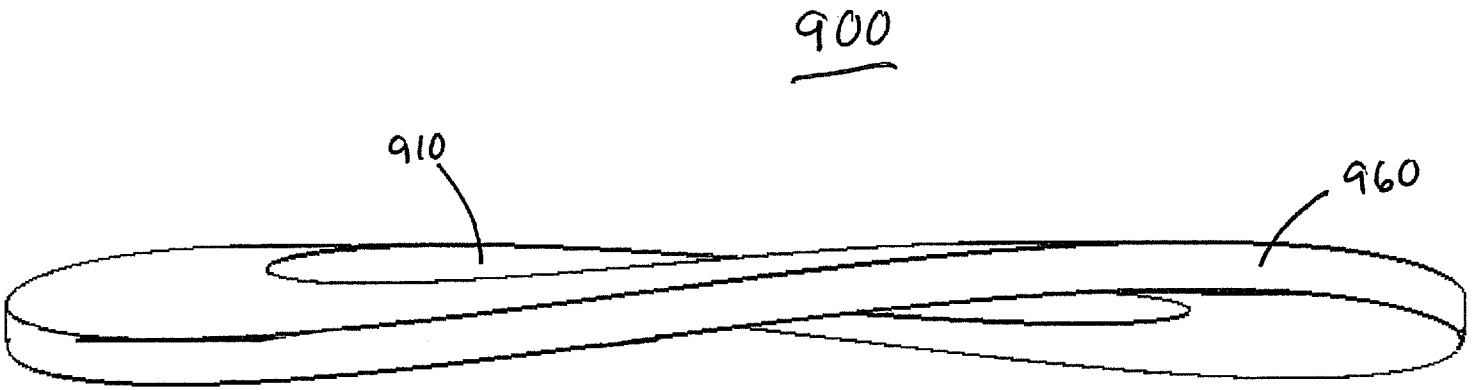
FIG. 14A is a perspective view of a drive member of the sash lock assembly illustrated by FIG. 8A.
Figure 18B:
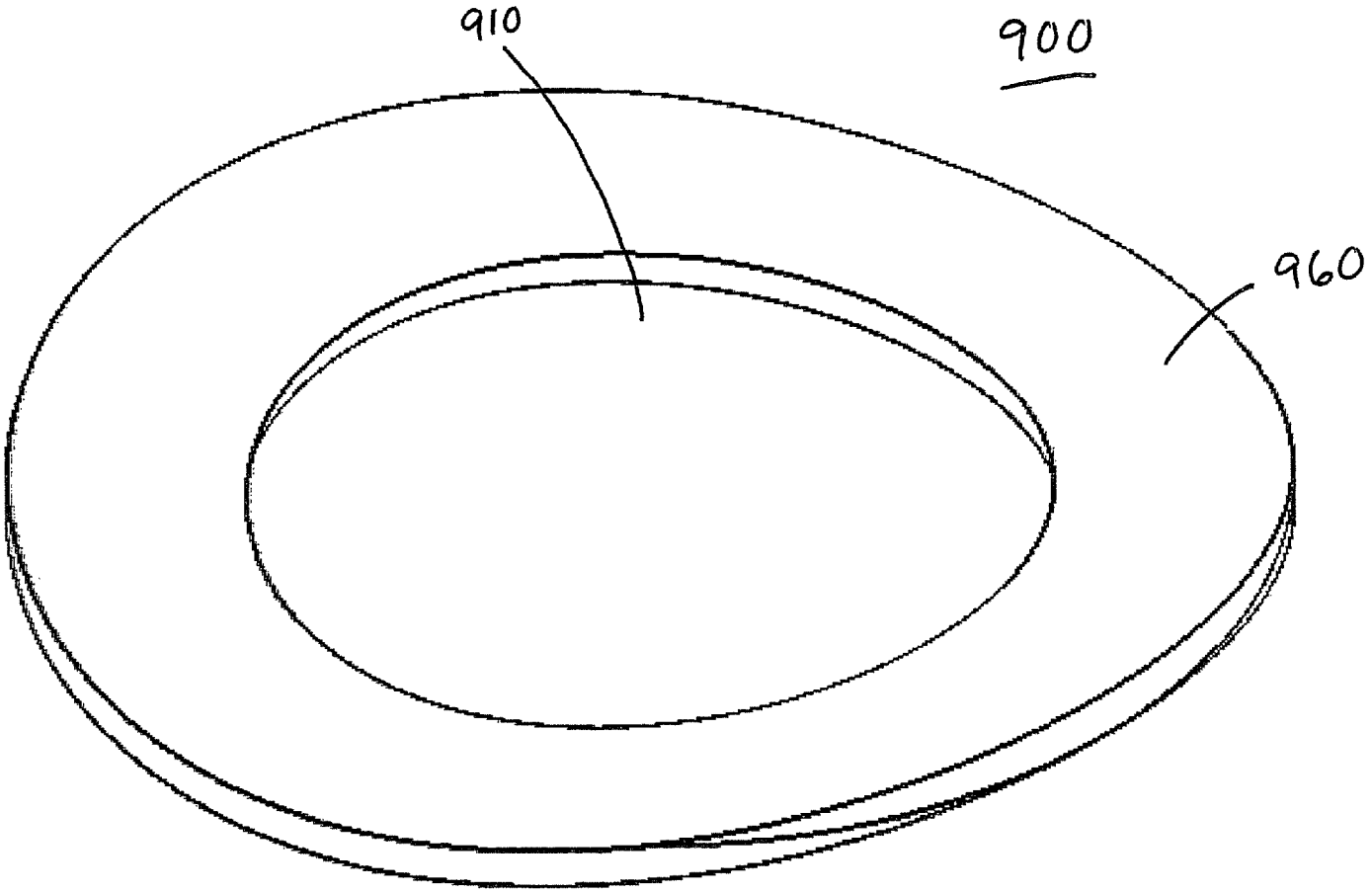
Figure 13A:
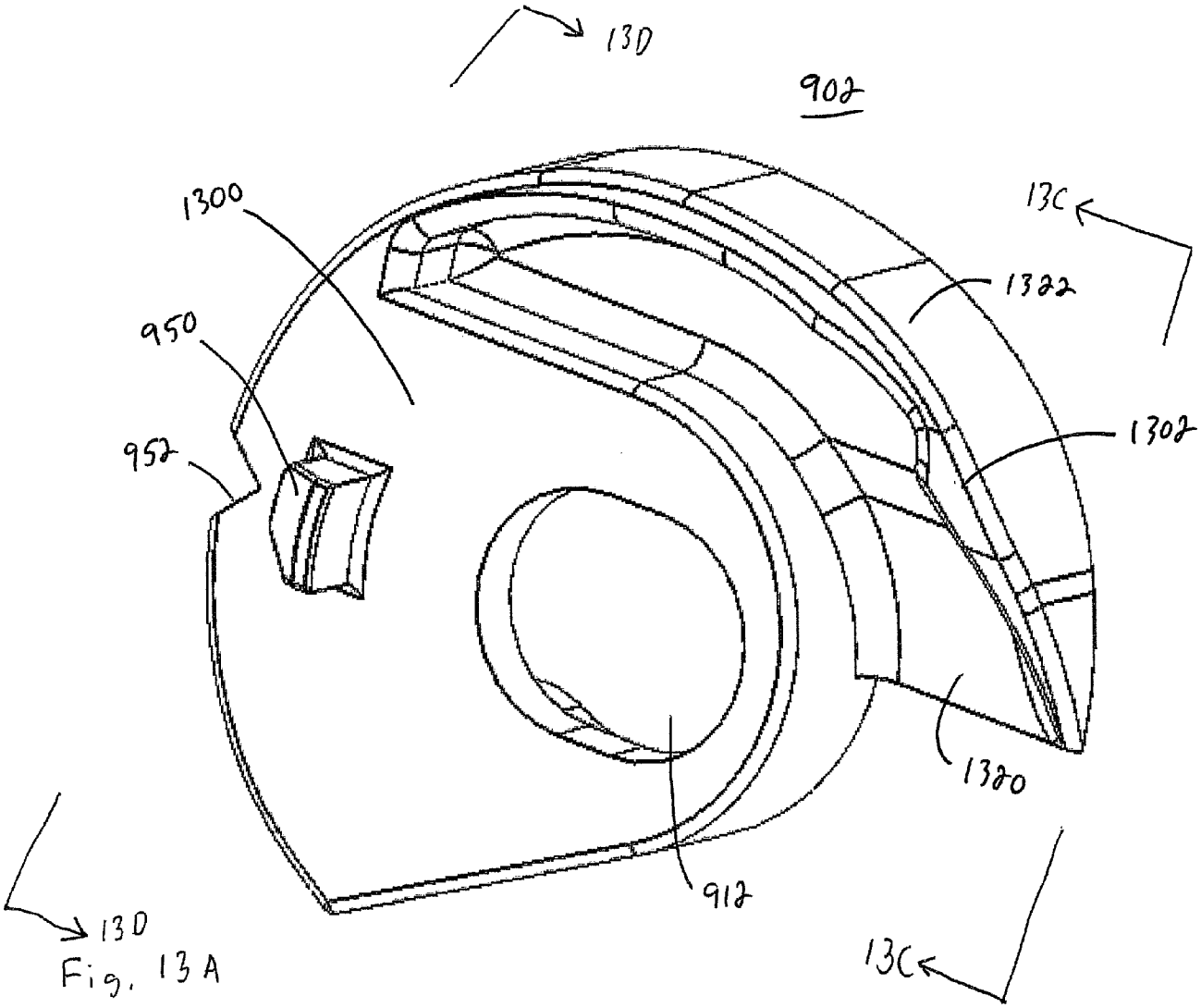
FIG. 13A is a perspective view of a cam lock member of the sash lock assembly illustrated by FIG. 8A.
Figure 13B:
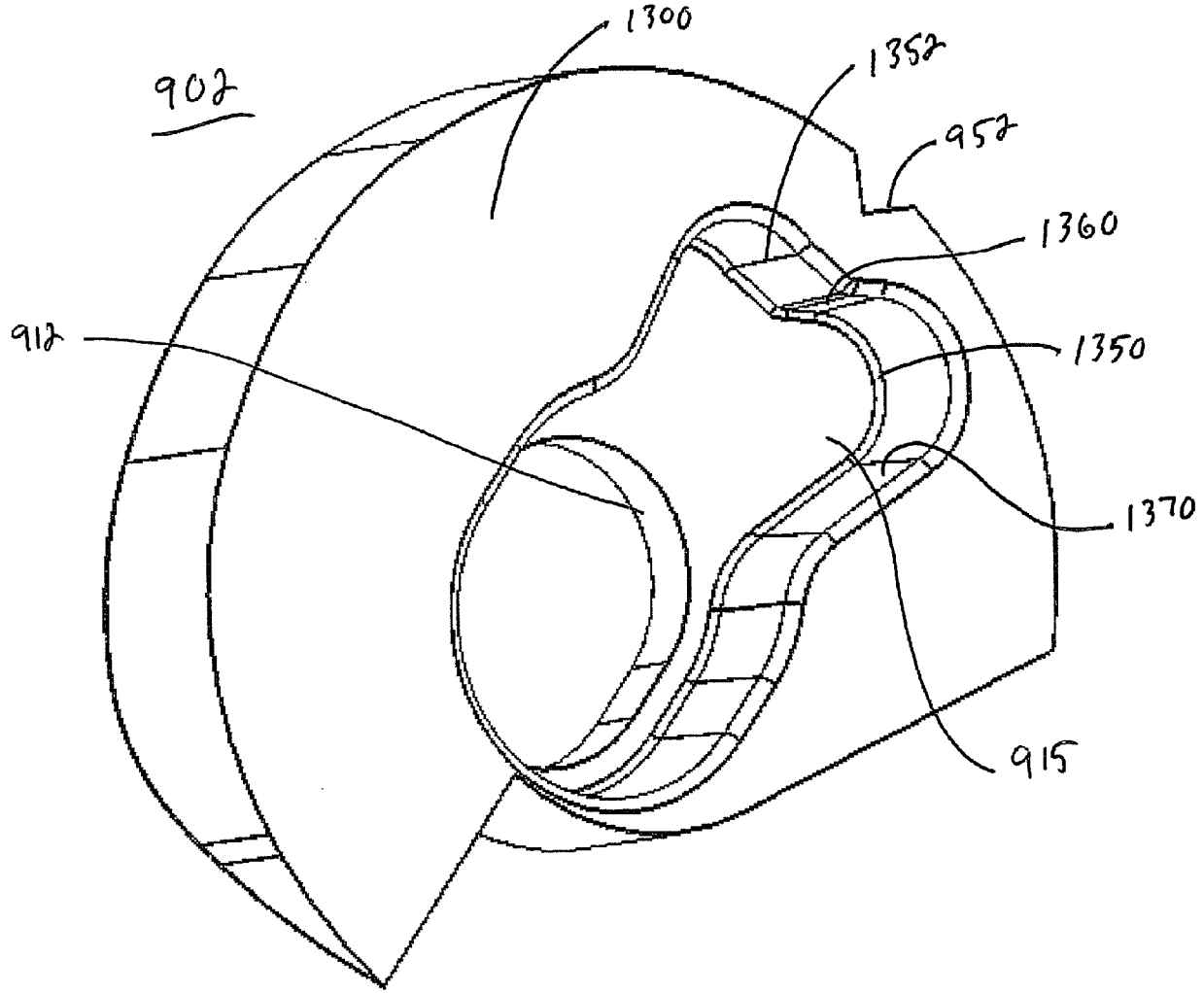
FIG. 13B is another perspective view of the cam lock member illustrated by FIG. 13A.
Figure 13C:
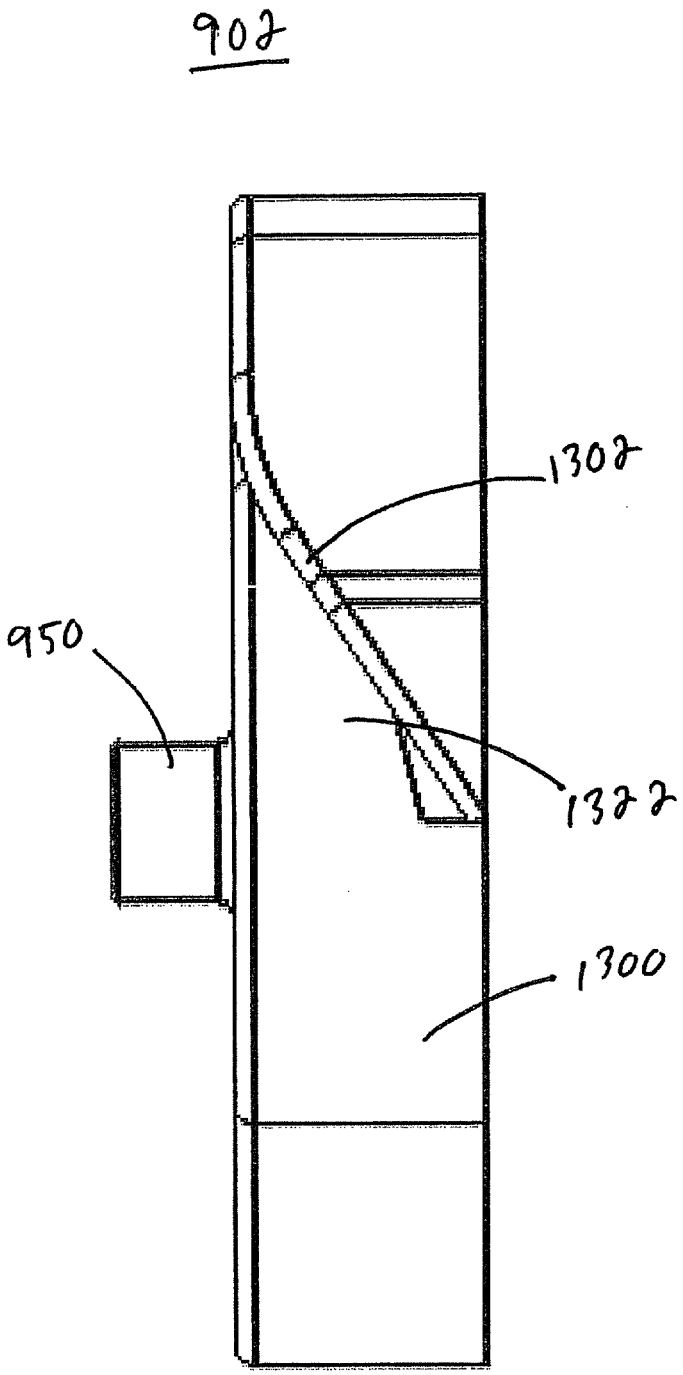
FIG. 13C is a side view of the cam lock member as indicated by lines 13C-13C in FIG. 13A.
Figure 13D:
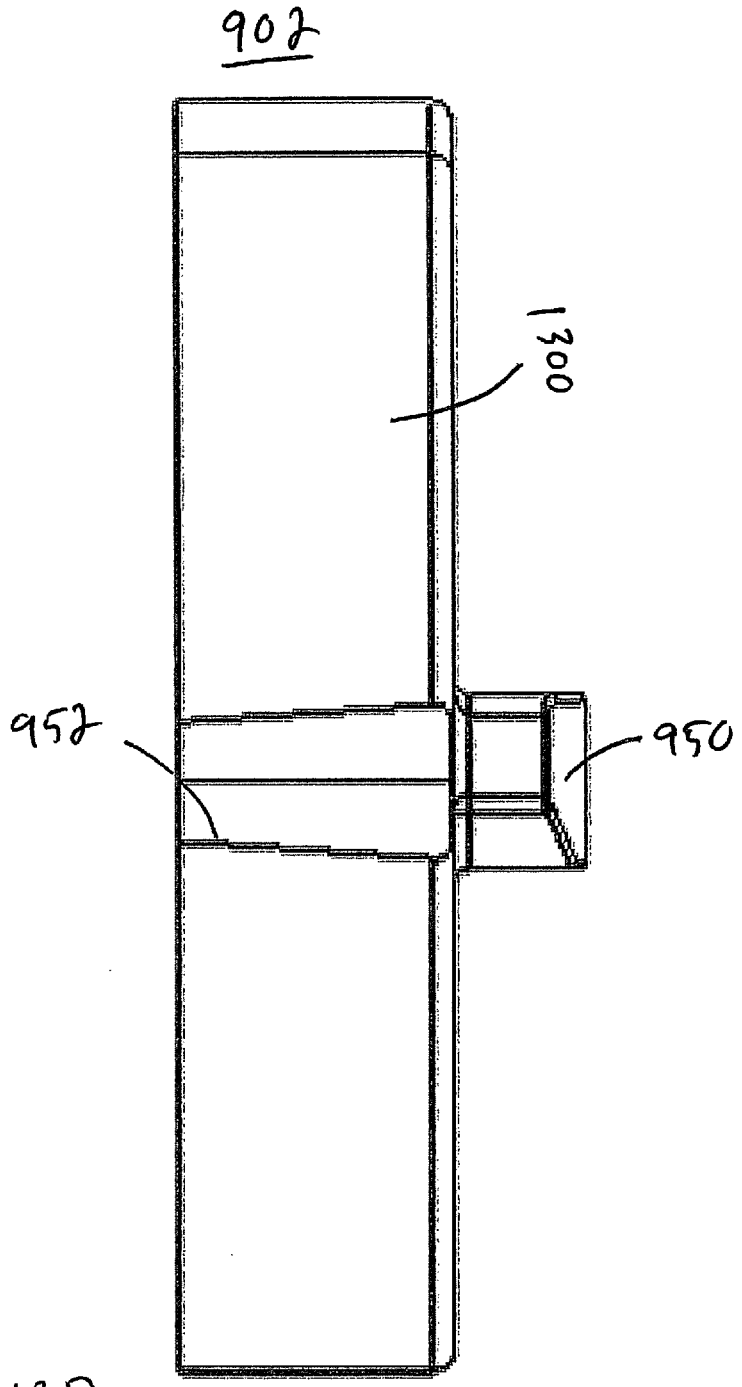
FIG. 13D is a side view of the cam lock member as indicated by lines 13C-13C in FIG. 13A.
Figure 13E:
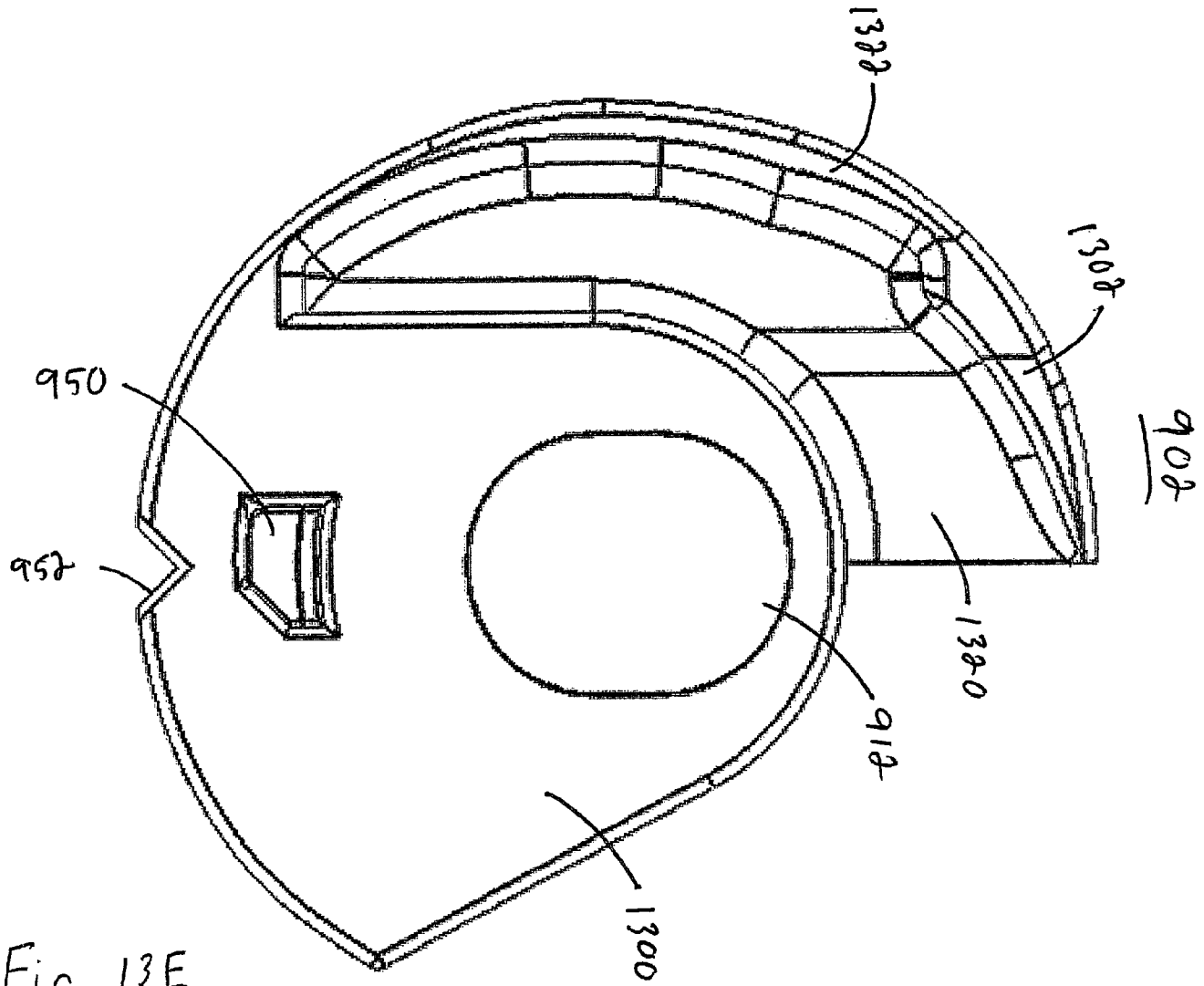
FIG. 13E is a top view of the cam lock member illustrated by FIG. 13A.
Figure 13F:
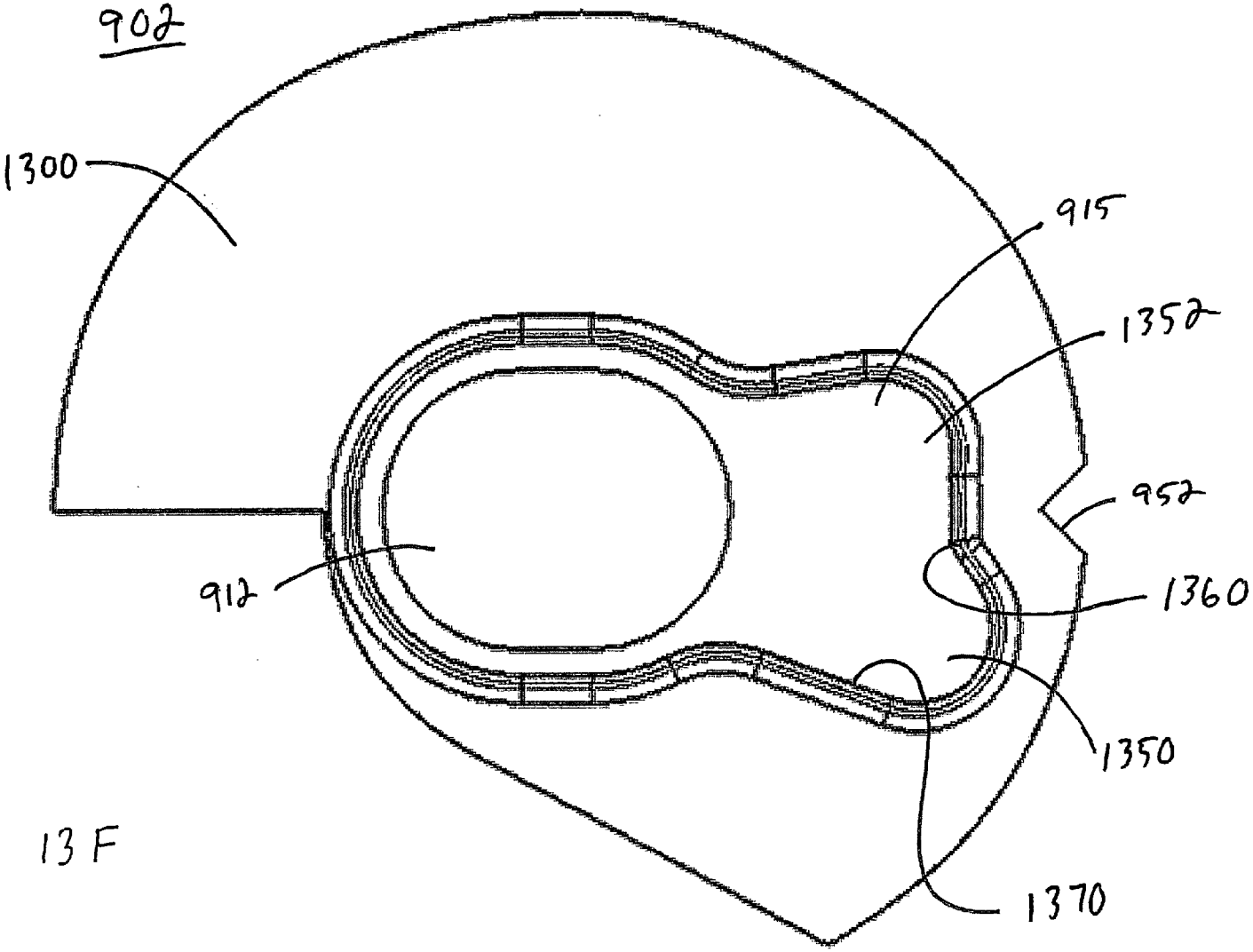
FIG. 13F is a bottom view of the cam lock member illustrated by FIG. 13A.
Figure 14A:
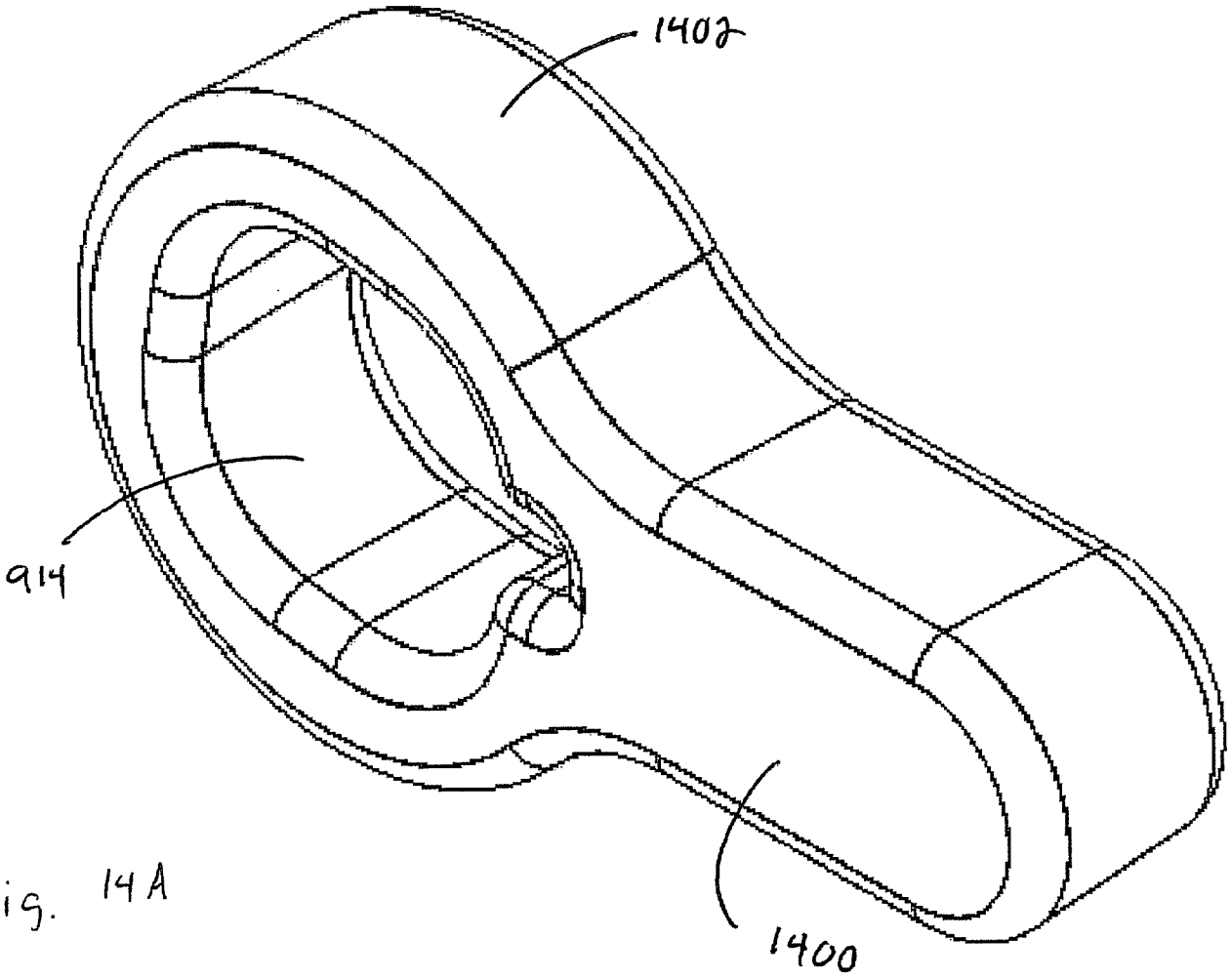
Figure 14B:
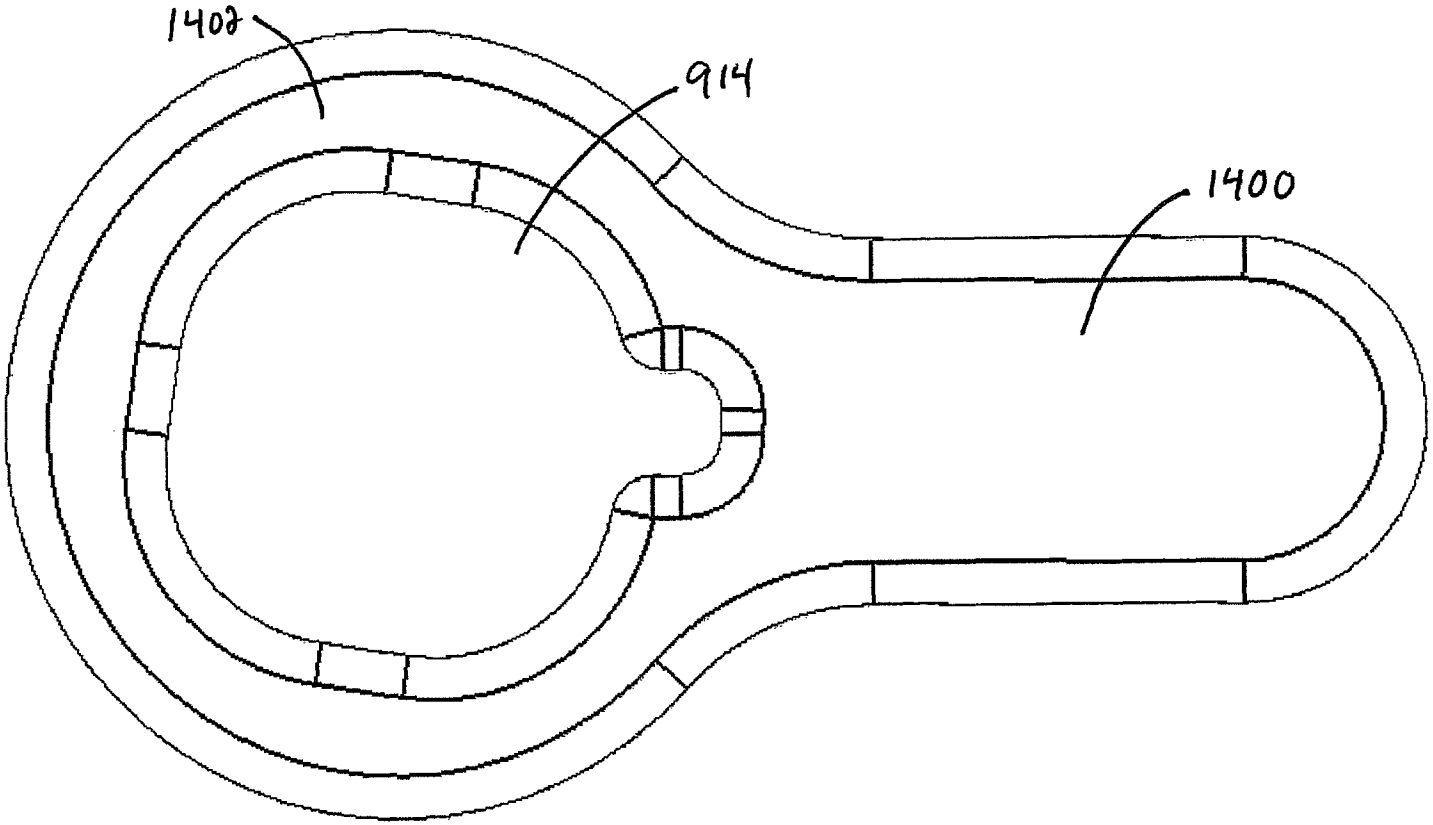
FIG. 14B is an end view of the drive member illustrated by FIG. 14A.
Figure 15A:
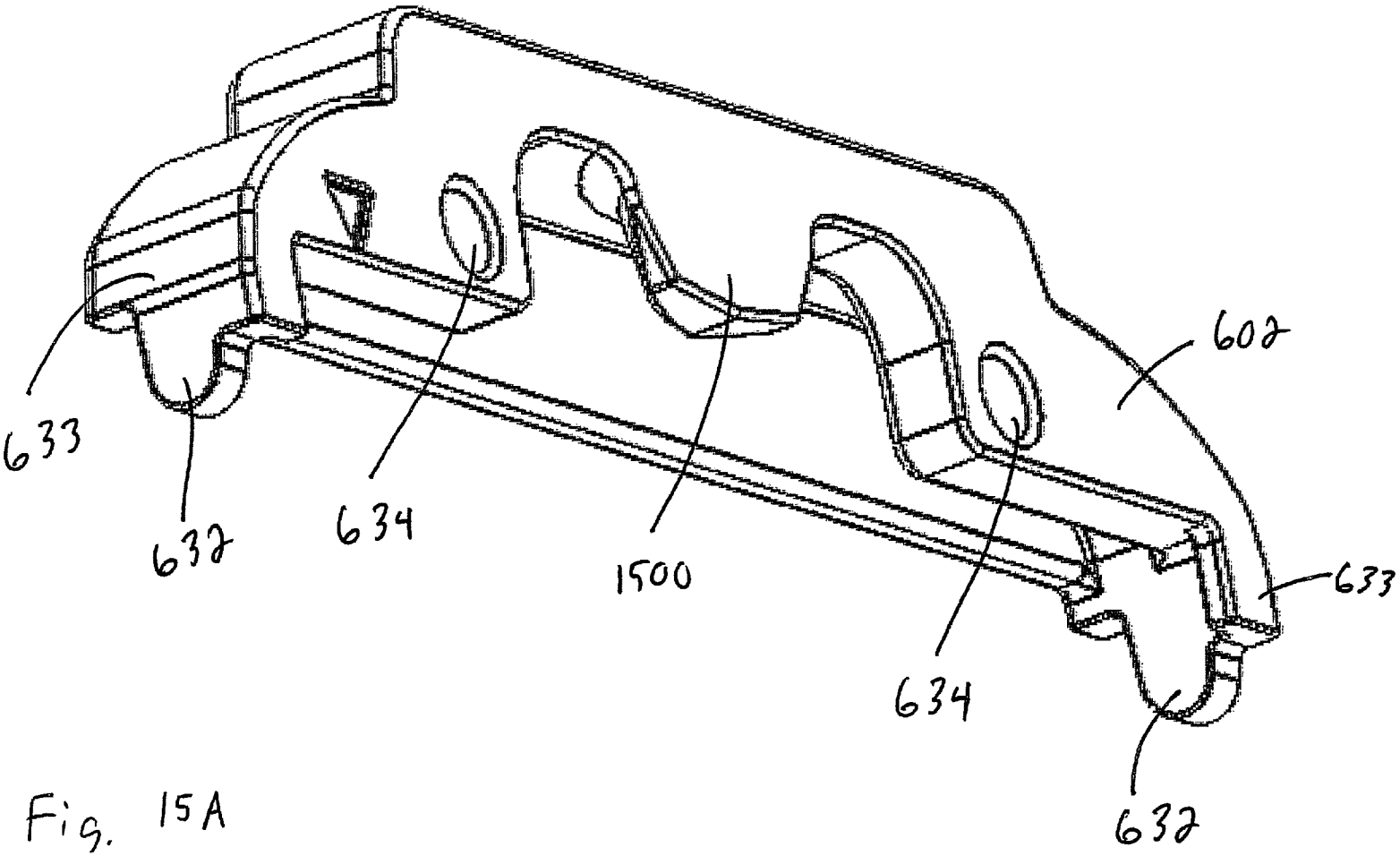
FIG. 15A is a perspective view of a housing of the keeper assembly illustrated by FIGS. 6A and 6B.
Figure 15B:
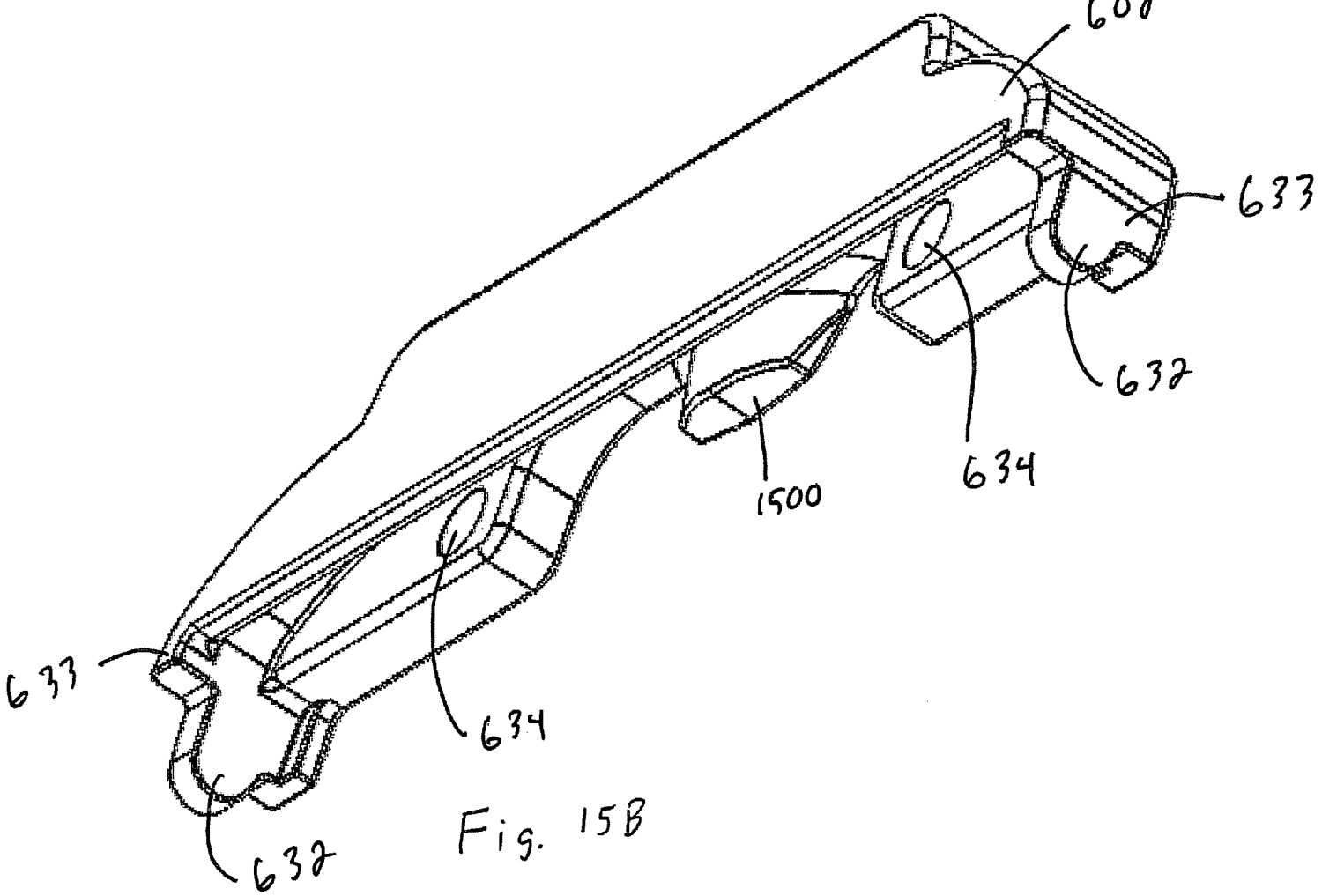
FIG. 15B is another perspective view of the housing illustrated by FIG. 15A.
Figure 15C:
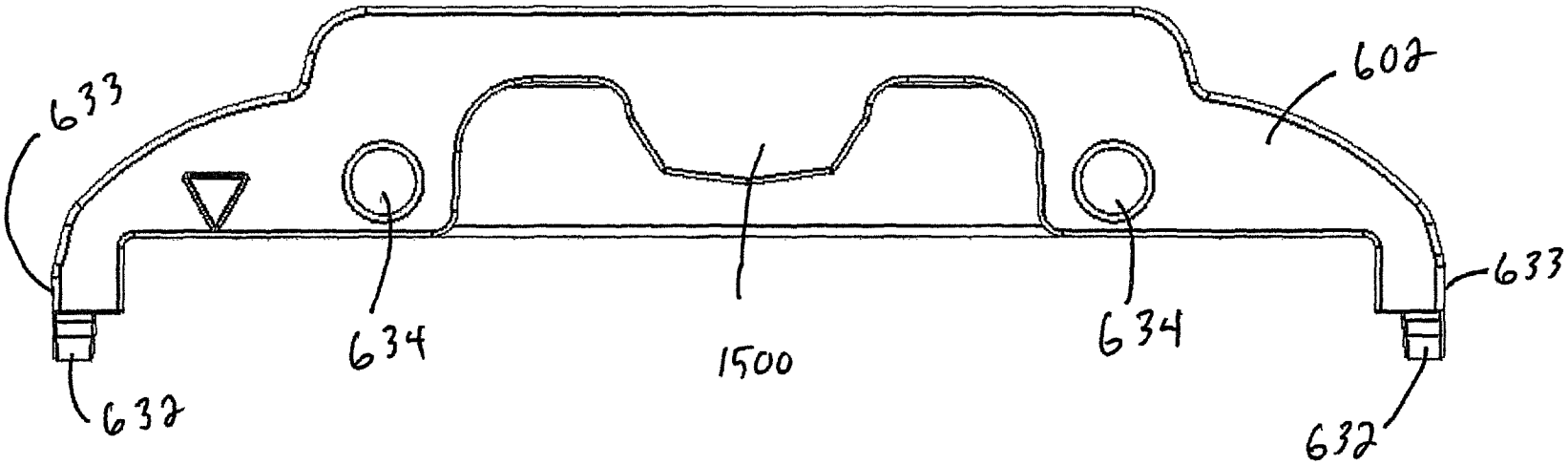
FIG. 15C is a front view of the housing illustrated by FIG. 15A.
Figure 15D:
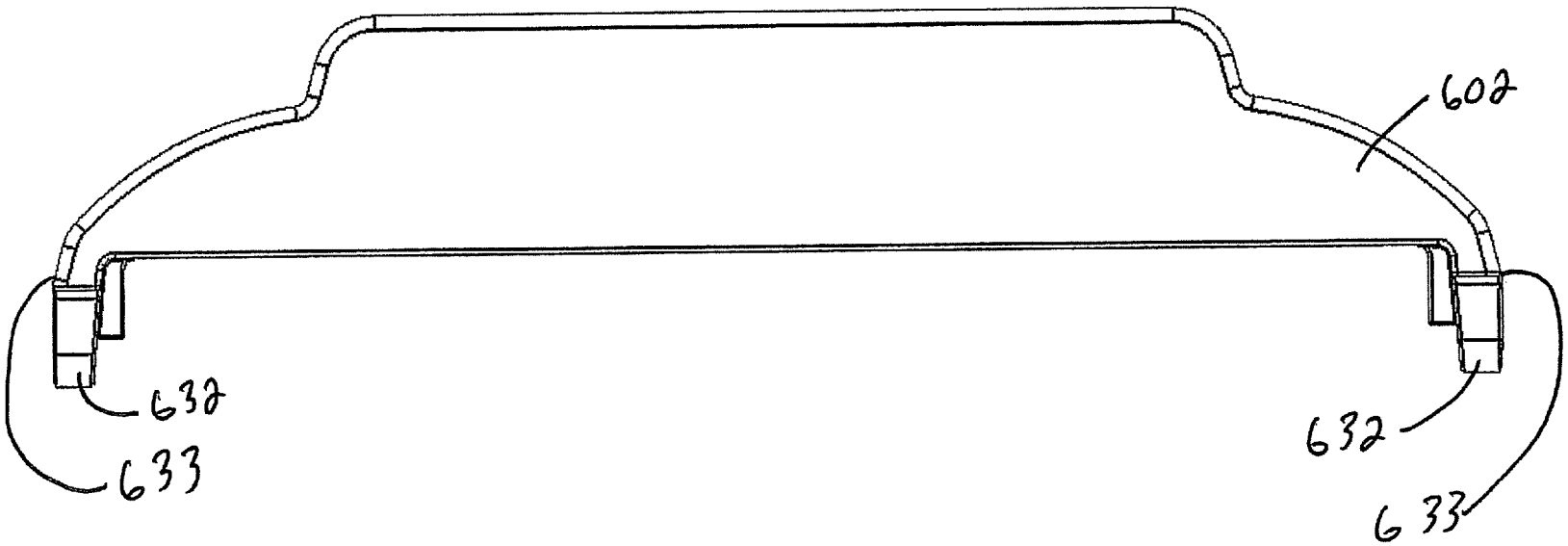
FIG. 15D is a rear view of the housing illustrated by FIG. 15A.
Figure 15E:
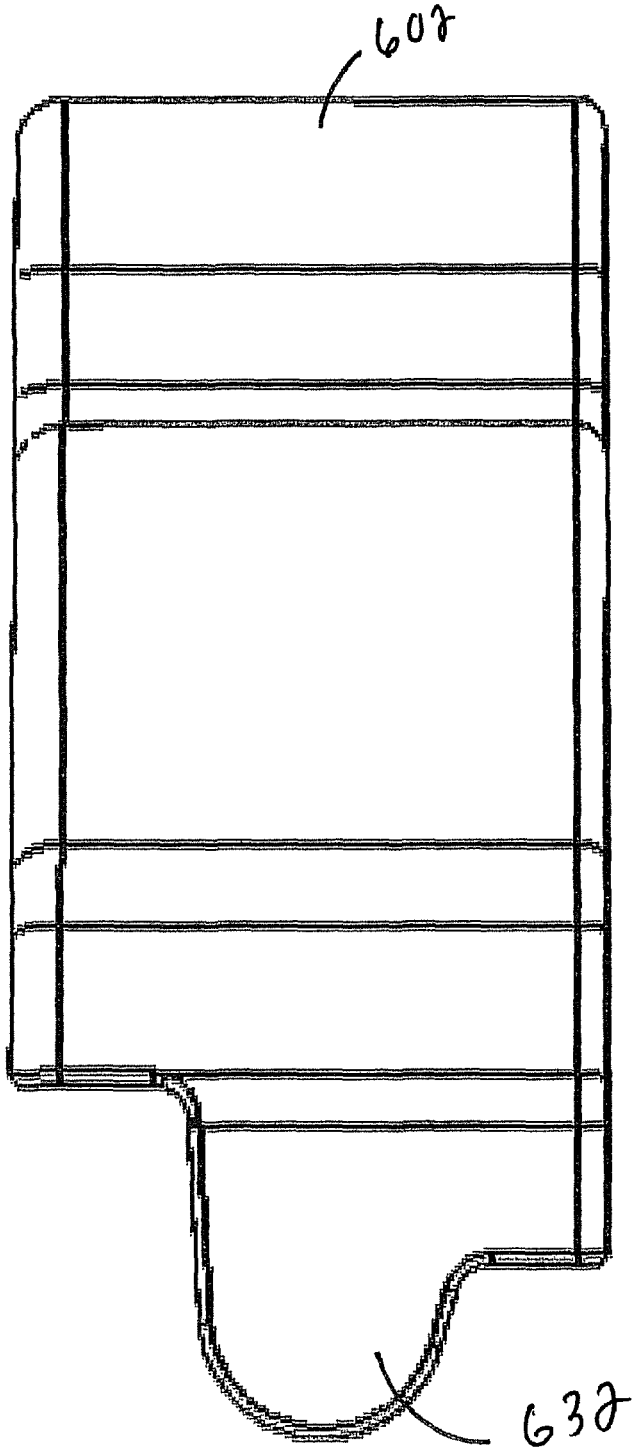
FIG. 15E is a side view of the housing illustrated by FIG. 15A.
Figure 15F:
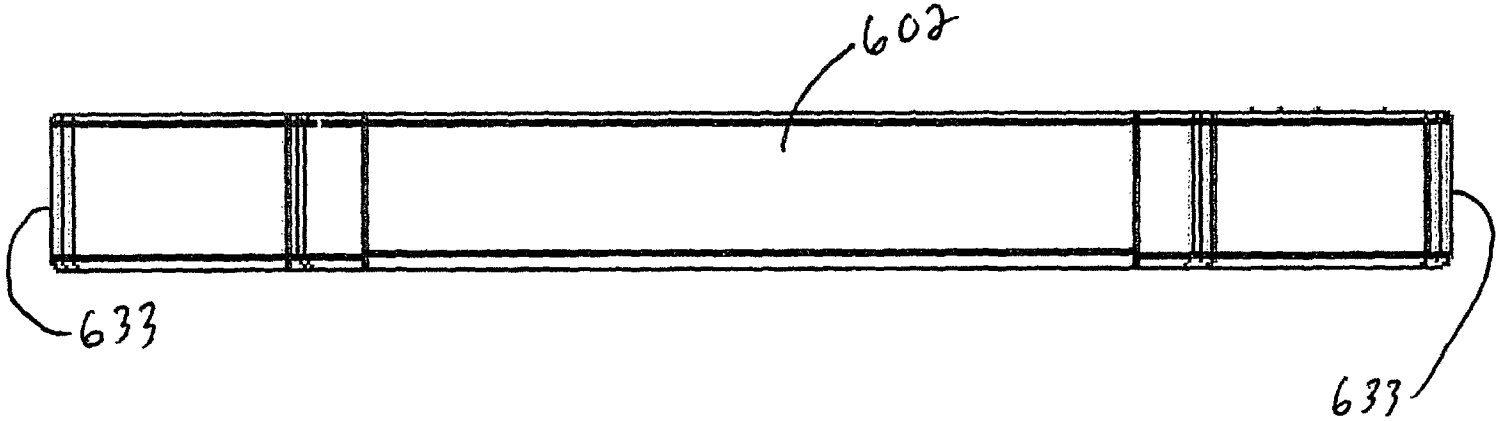
FIG. 15F is a top view of the housing illustrated by FIG. 15A.
Figure 156:
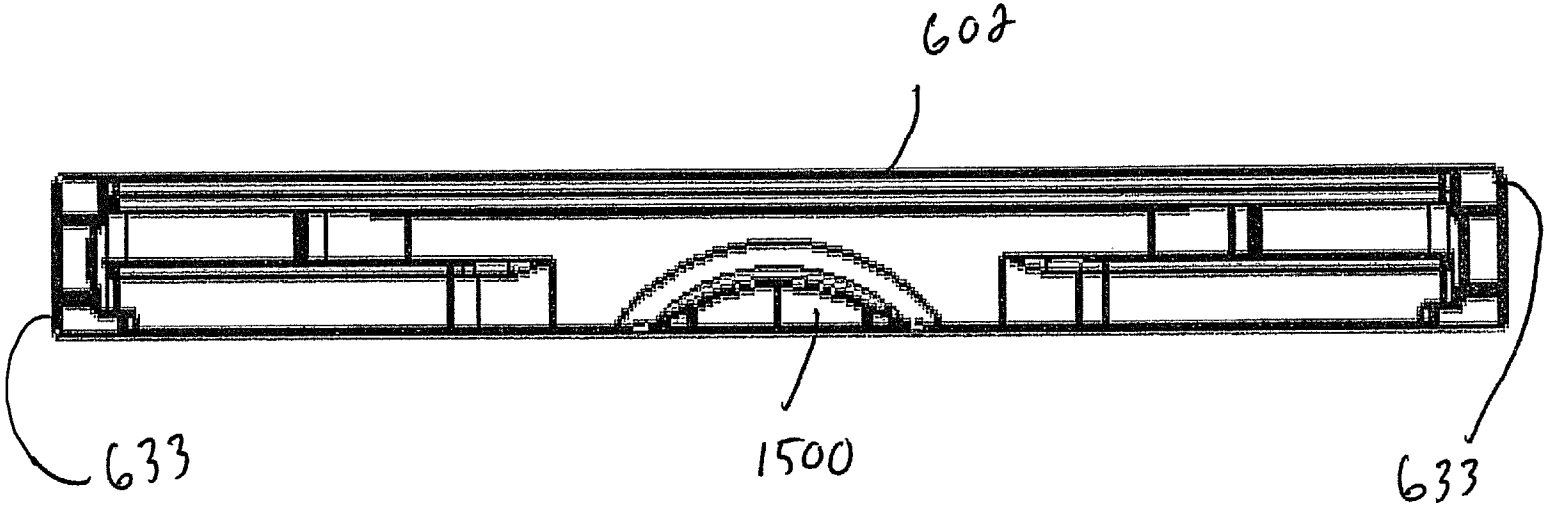
Figure 16A:
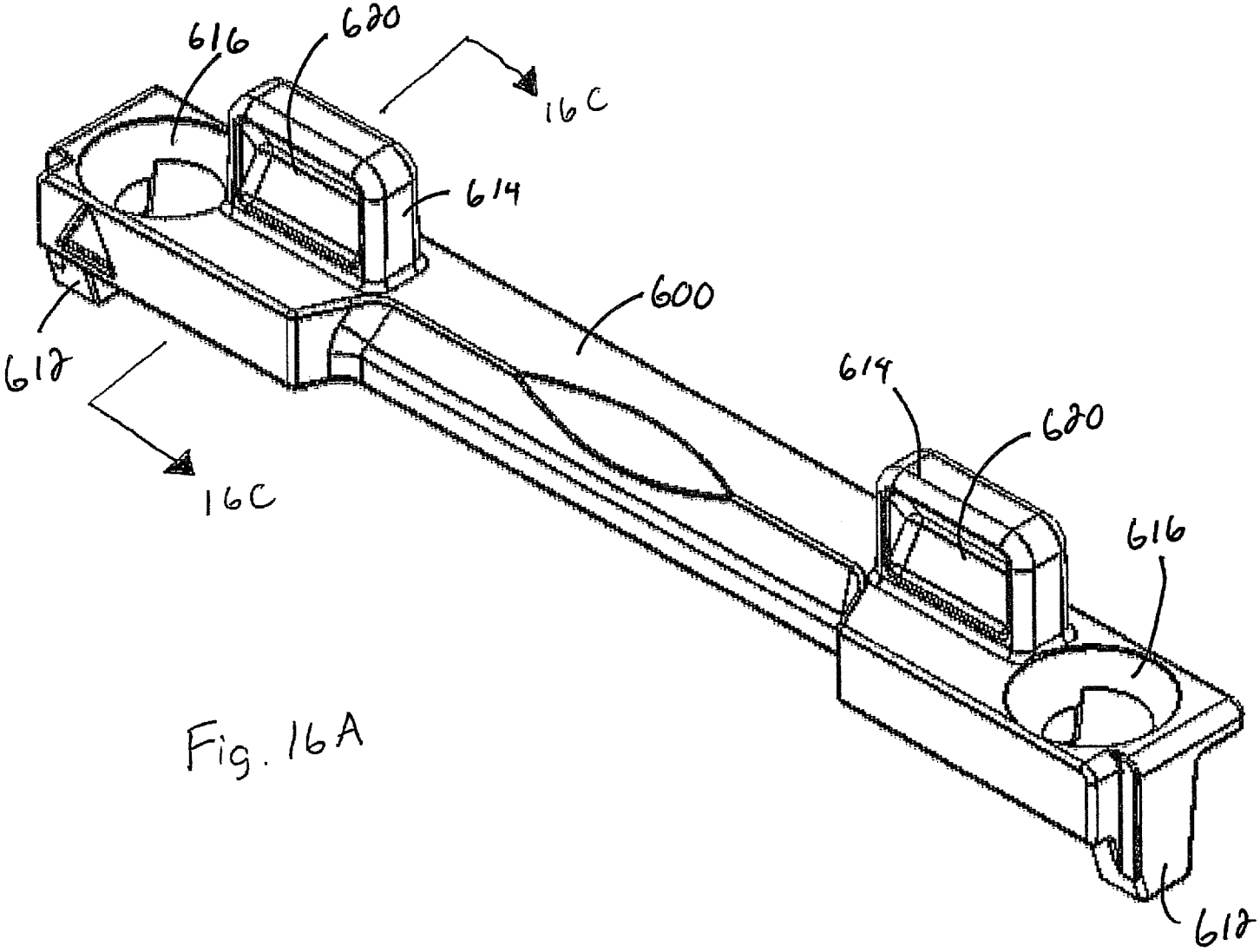
FIG. 16A is a perspective view of a base of the keeper assembly illustrated by FIGS. 6A and 6B.
Figure 16B:
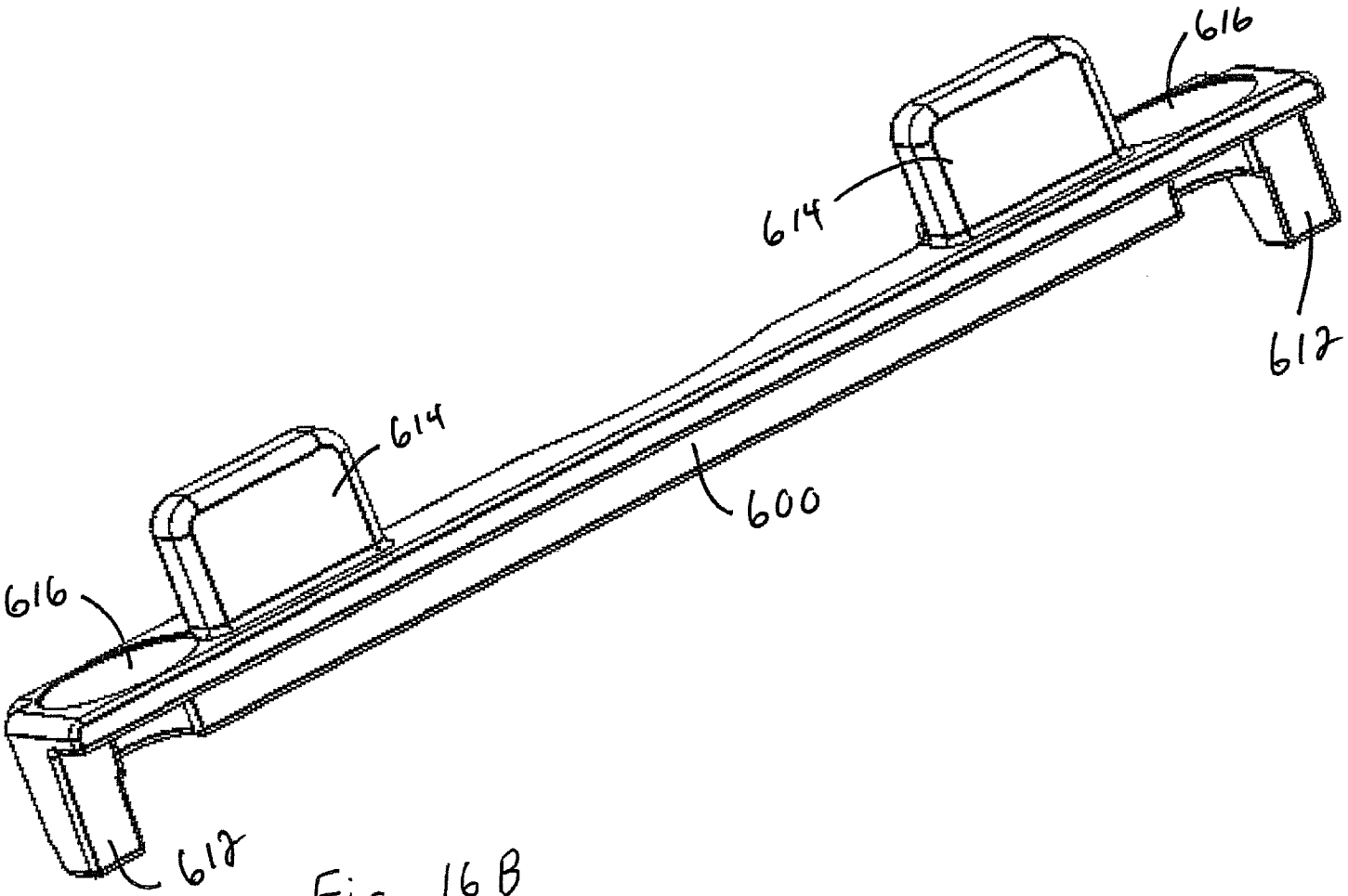
FIG. 16B is another perspective view of the base illustrated by FIG. 16A.
Figure 16C:
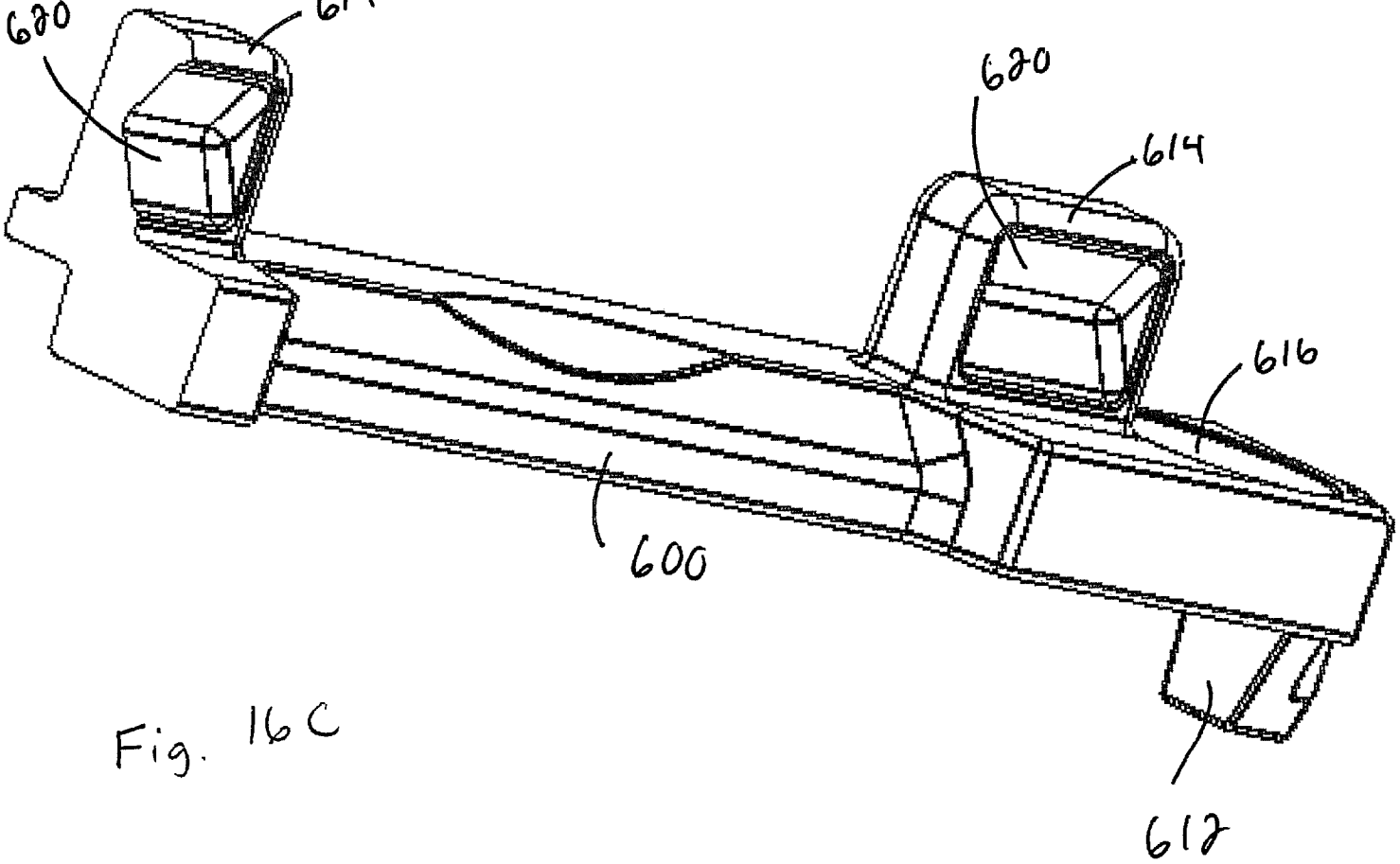
FIG. 16C is a sectioned perspective view taken along the plane indicated by lines 16C-16C in FIG. 16A.
Figure 16D:
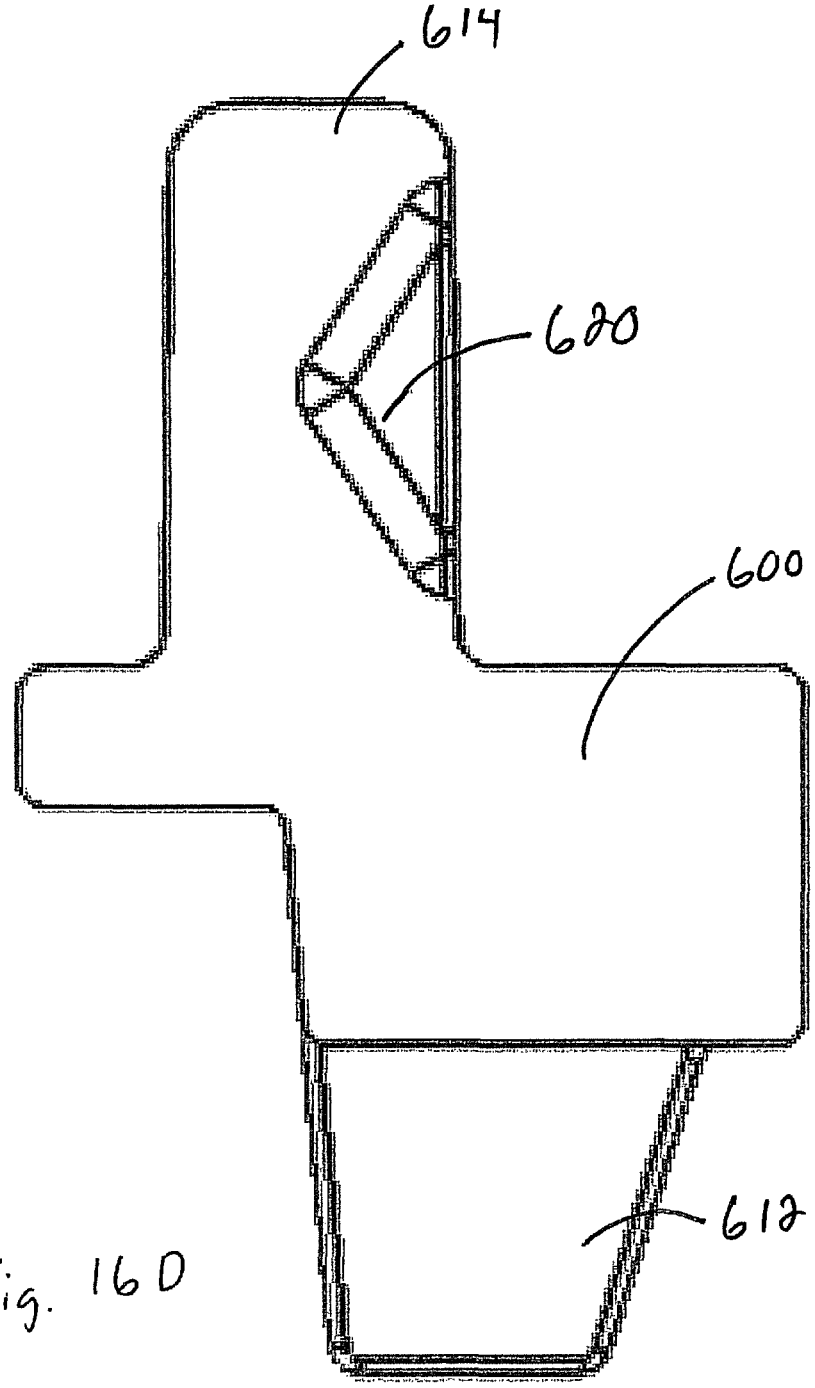
FIG. 16D is a sectional view taken along the plane indicated by lines 16C-16C in FIG. 16A.
Figure 16E:
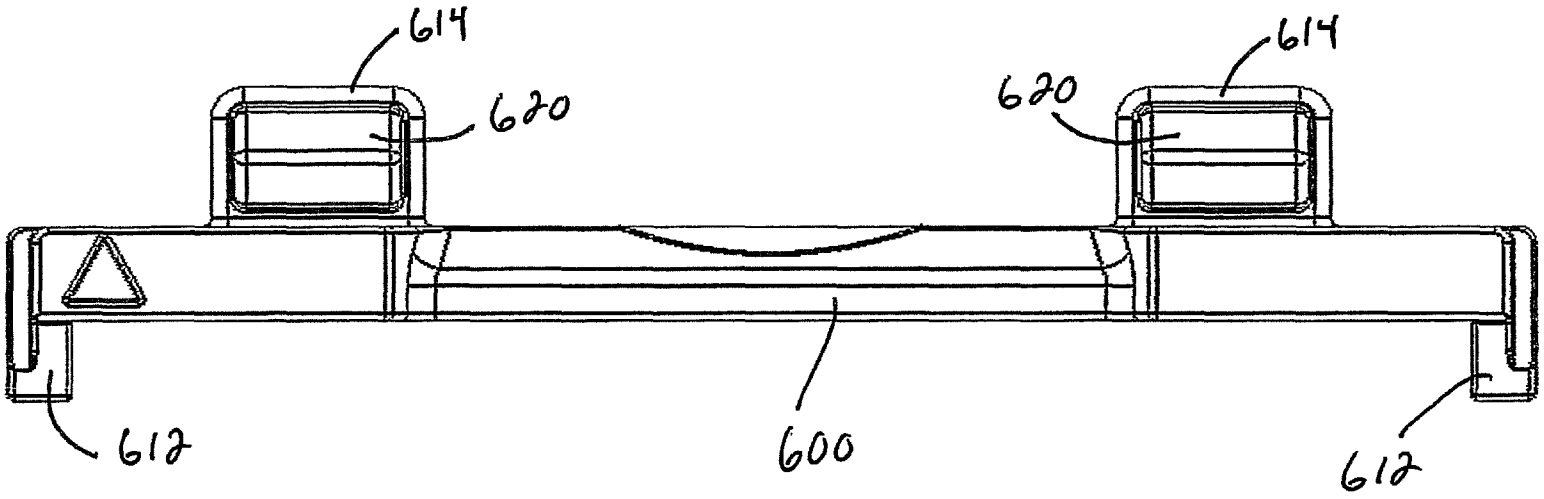
FIG. 16E is a front view of the base illustrated by FIG. 16A.
Figure 16F:
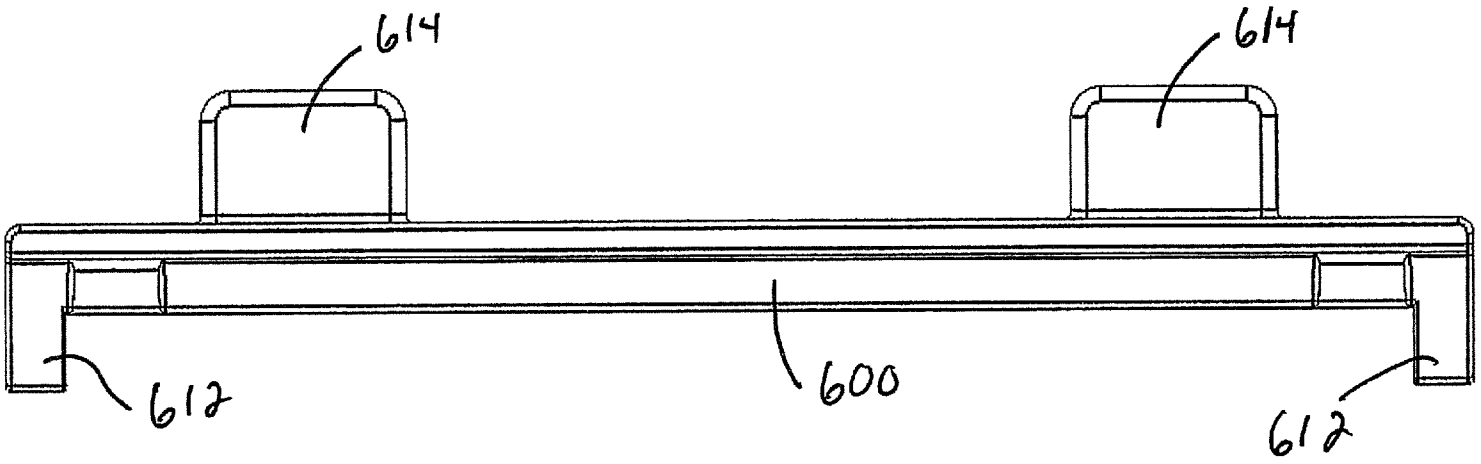
FIG. 16F is a rear view of the base illustrated by FIG. 16A.
Figure 16G:
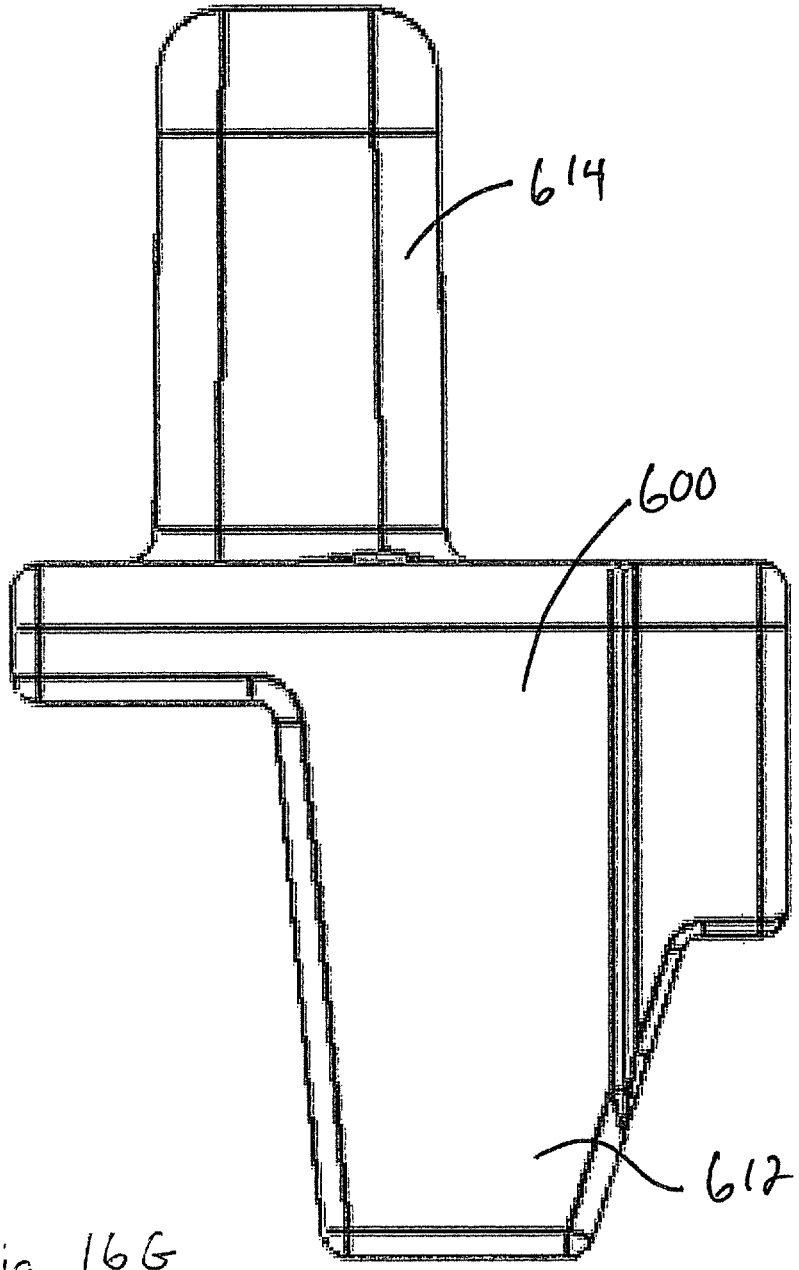
FIG. 16G is a side view of the base illustrated by FIG. 16A.
Figure 16H:
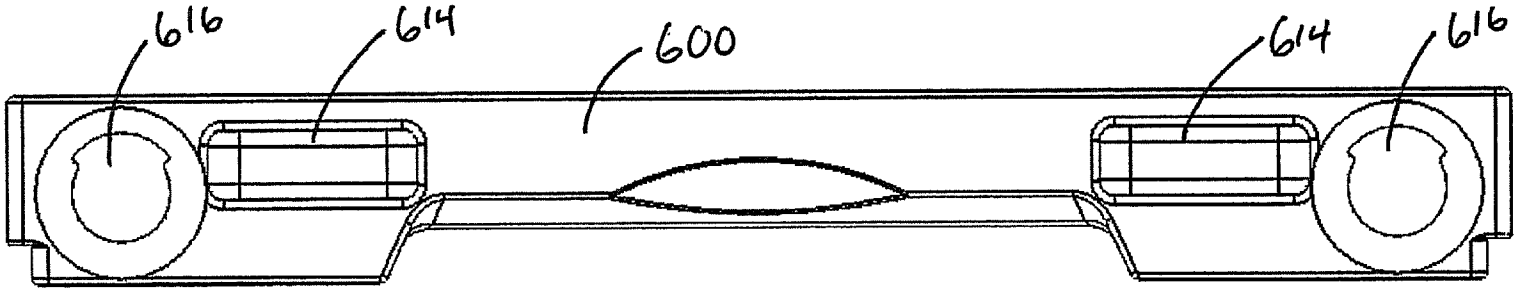
FIG. 16H is a top view of the base illustrated by FIG. 16A.
Figure 16I:
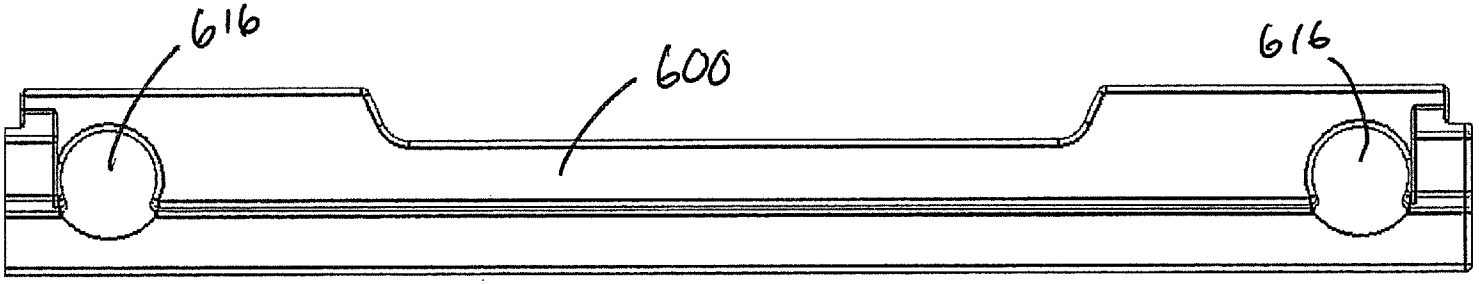
FIG. 16I is a bottom view of the housing illustrated by FIG. 16A.
Figure 17:
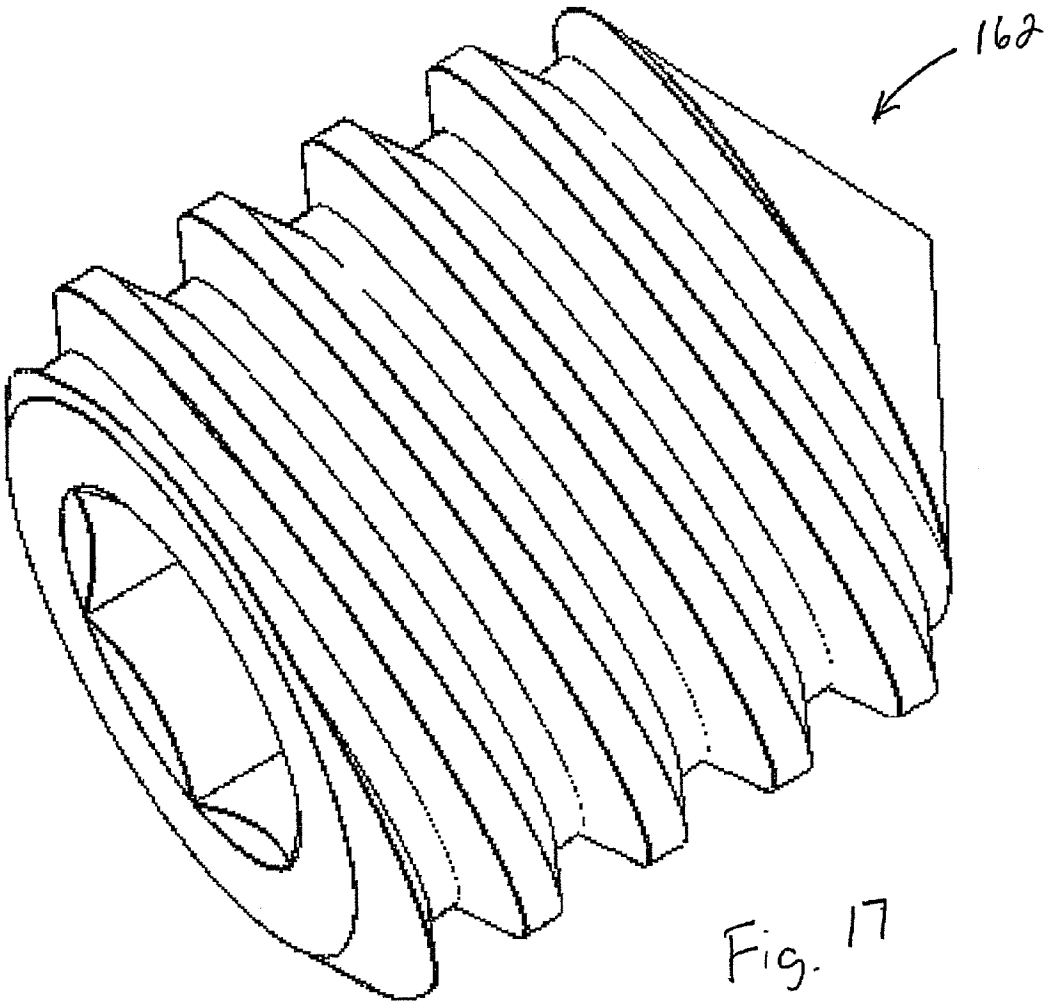
FIG. 17 is a perspective view of a set screw of the keeper assembly illustrated by FIGS. 6A and 6B.

The drive member 904 can take a wide variety of different forms. In the exemplary embodiment illustrated by FIGS. 14A-14B, the drive member 904 is an integral (i.e. single piece) that includes a central portion 1402, the opening 914, and the drive leg 1400. The opening 914 is sized to allow the shaft 906 to be secured to the central portion 1402.

Figure 8A:
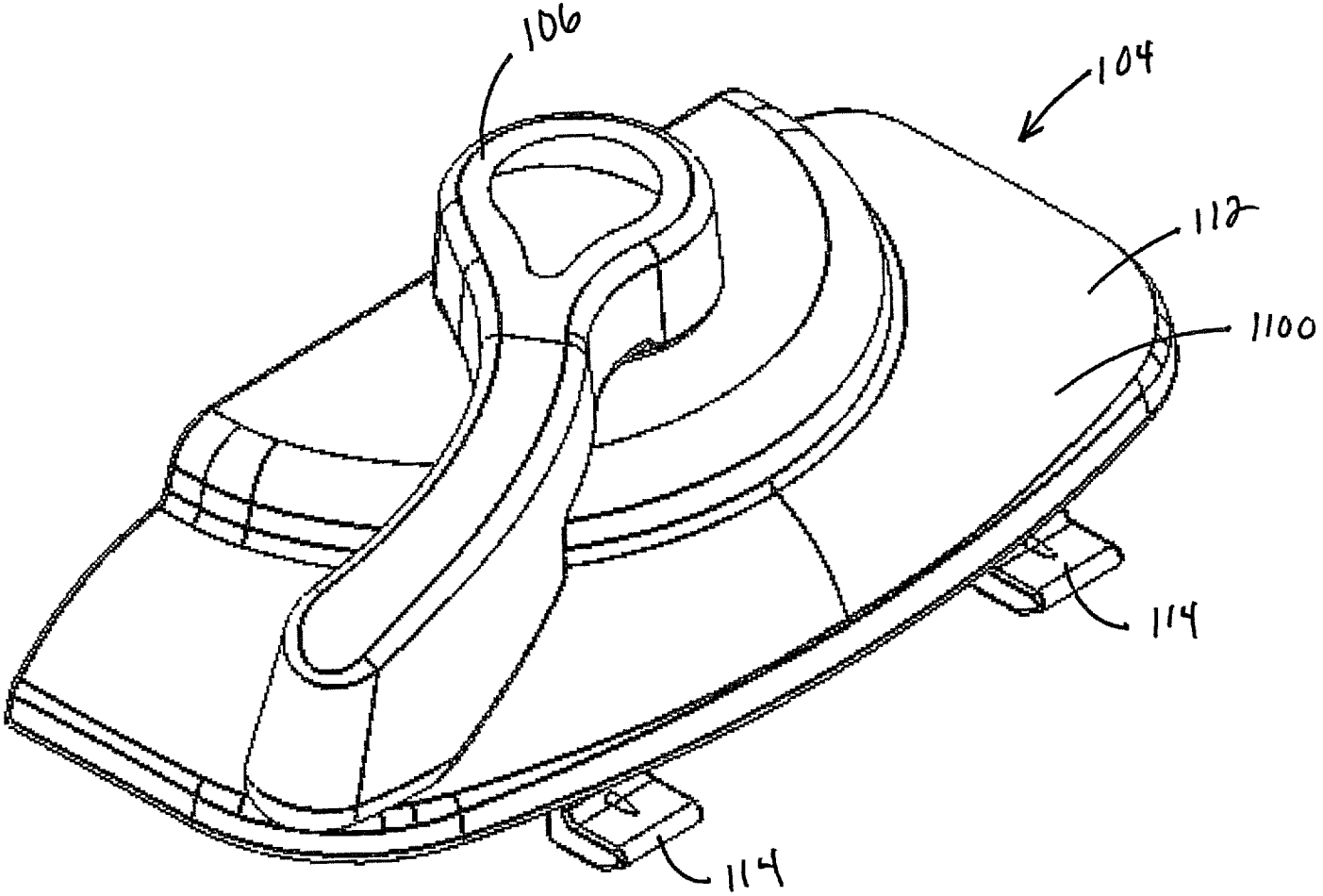
FIG. 8A is a perspective view of the sash lock illustrated by FIG. 3A.
Figure 8B:
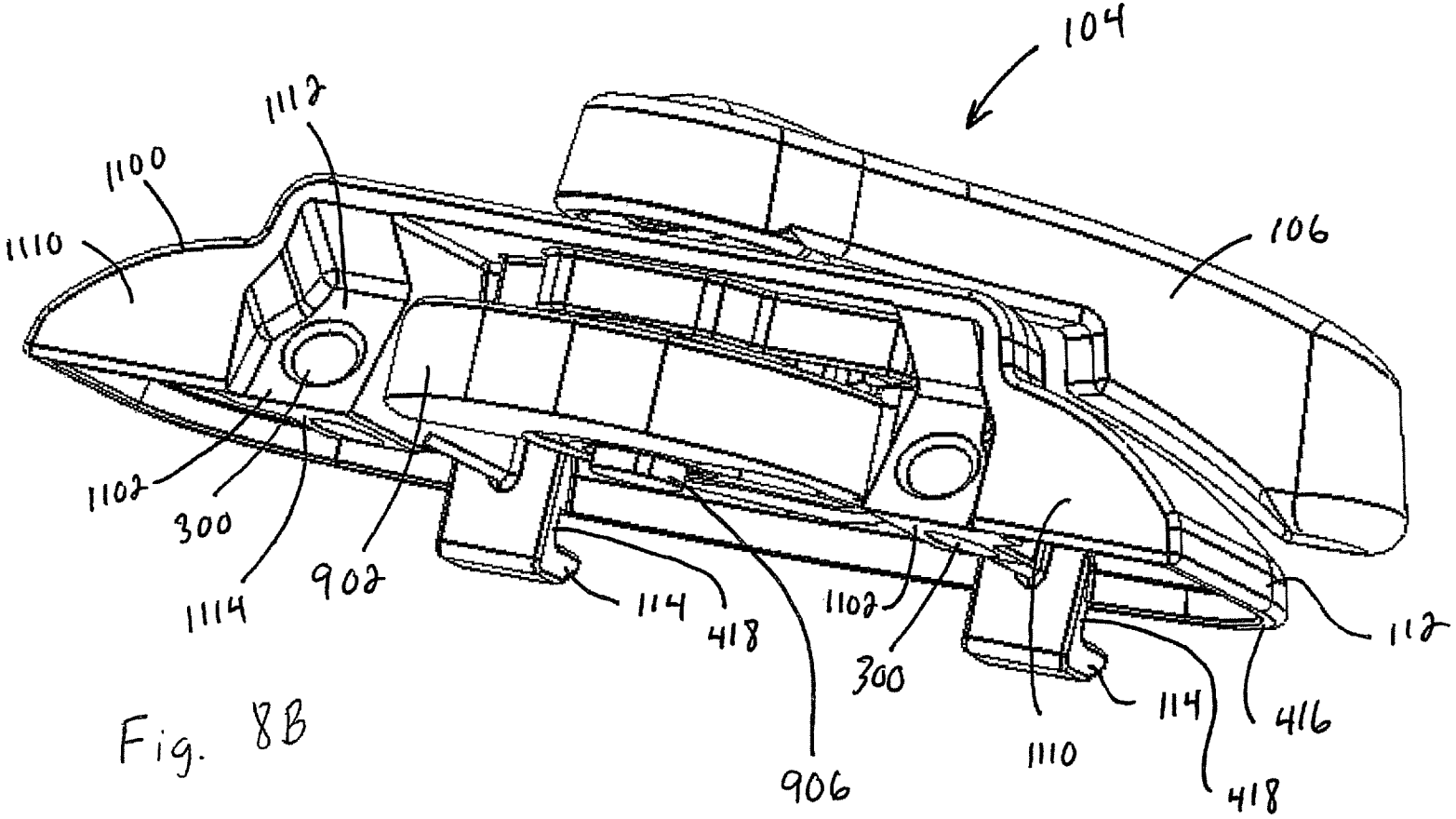
FIG. 8B is another perspective view of the sash lock illustrated by FIG. 8A.
Figure 8C:
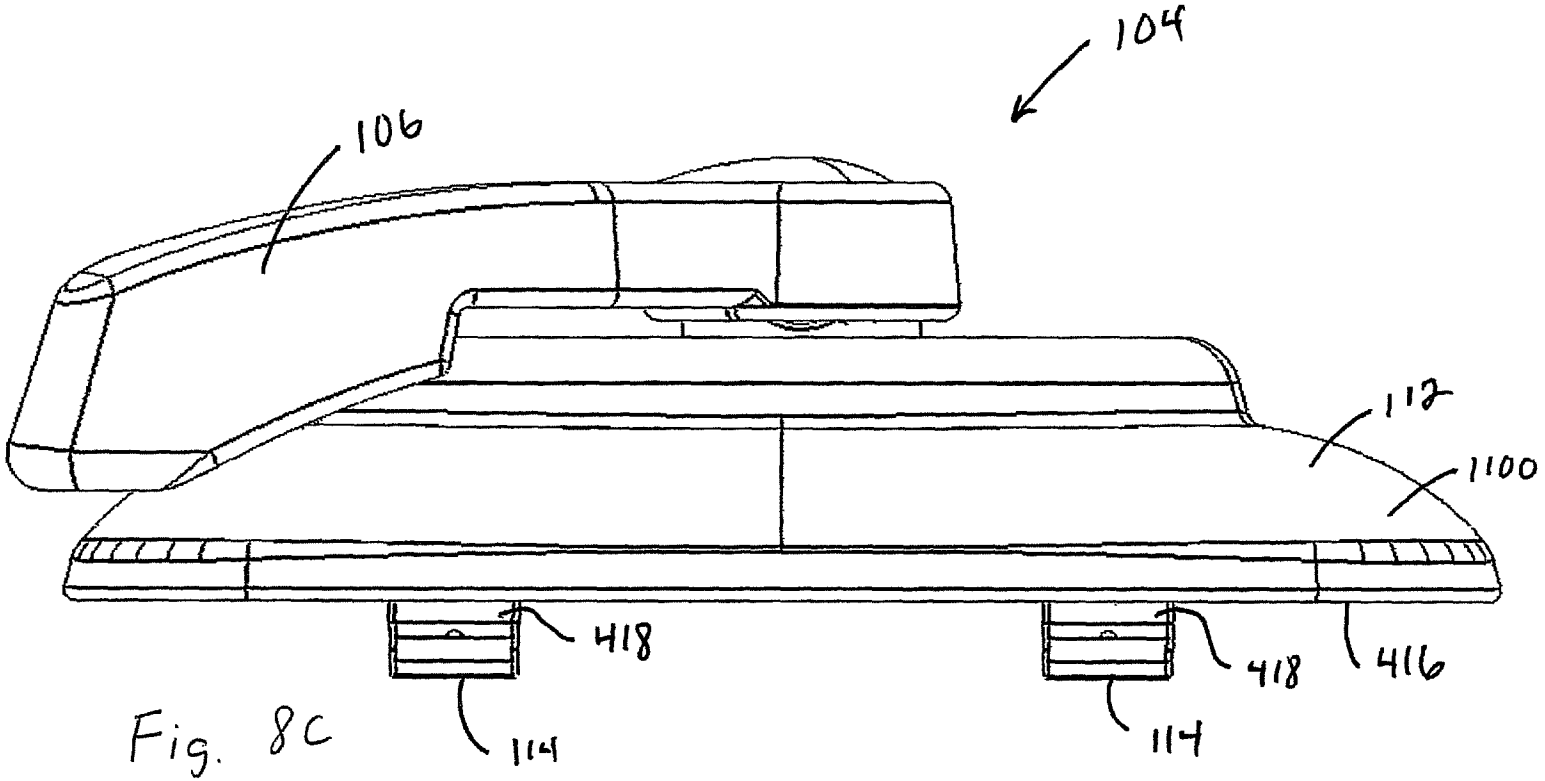
FIG. 8C is a front view of the sash lock illustrated by FIG. 8A.
Figure 8D:
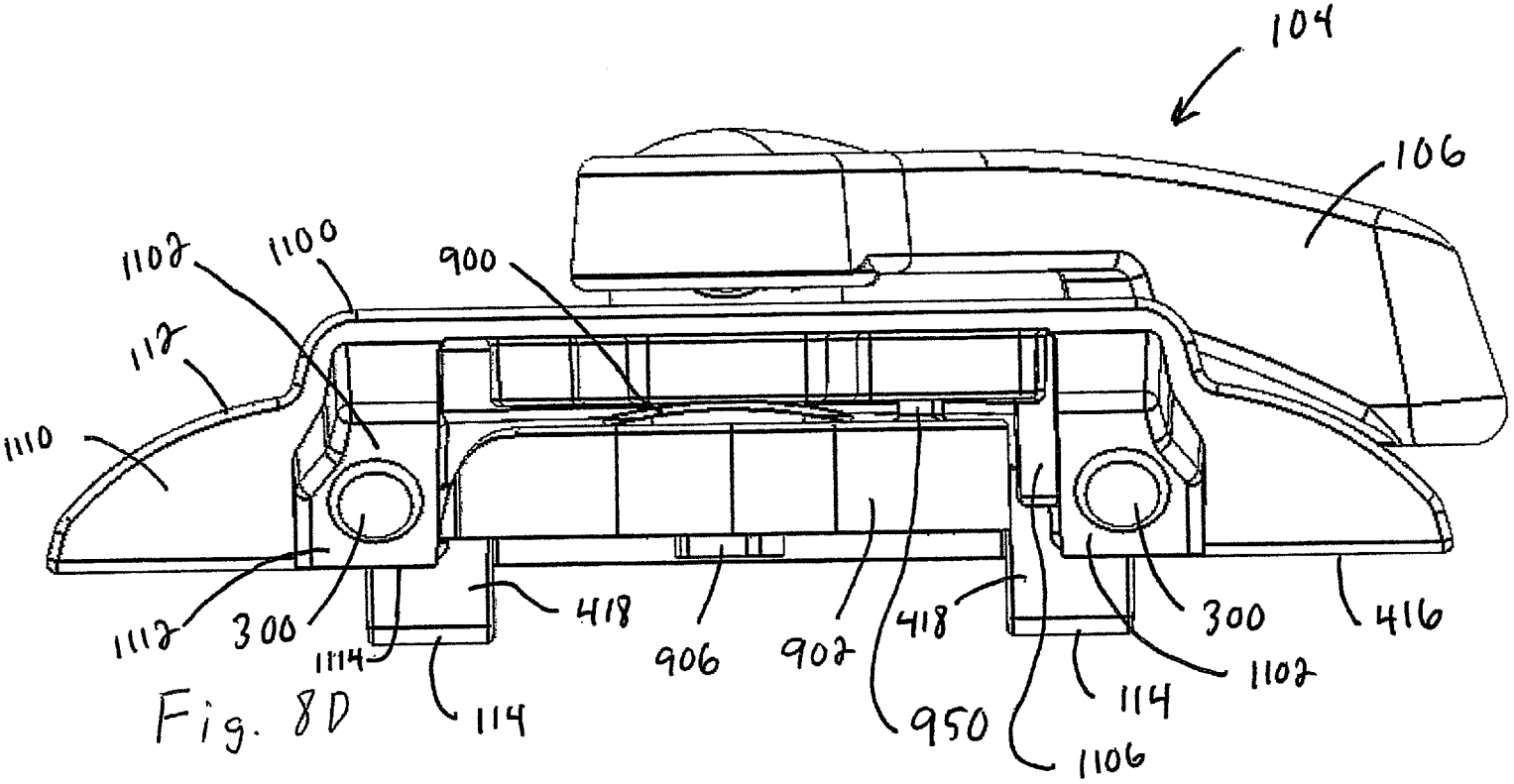
FIG. 8D is a rear view of the sash lock illustrated by FIG. 8A.
Figure 8E:
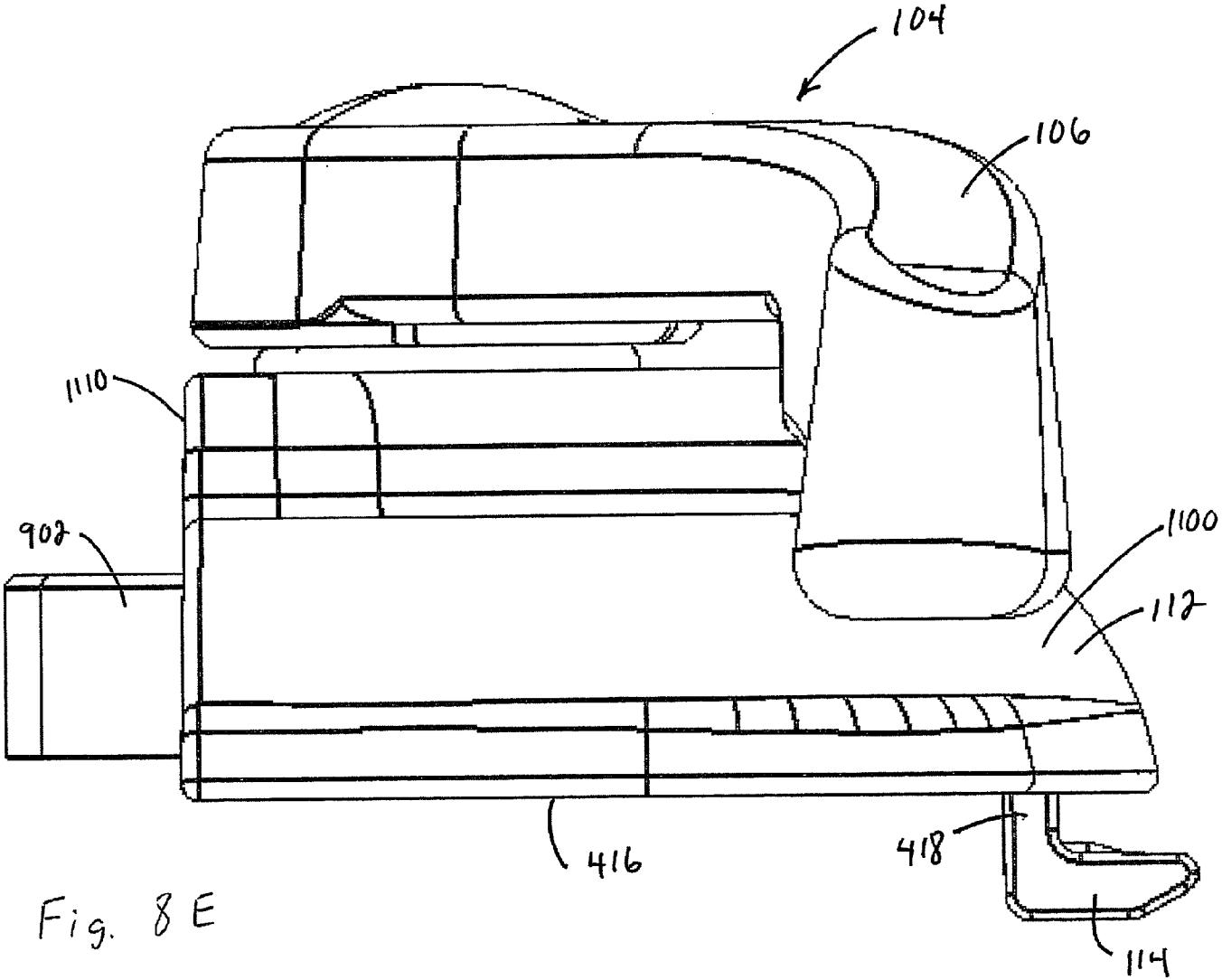
FIG. 8E is a side view of the sash lock illustrated by FIG. 8A.
Figure 8F:
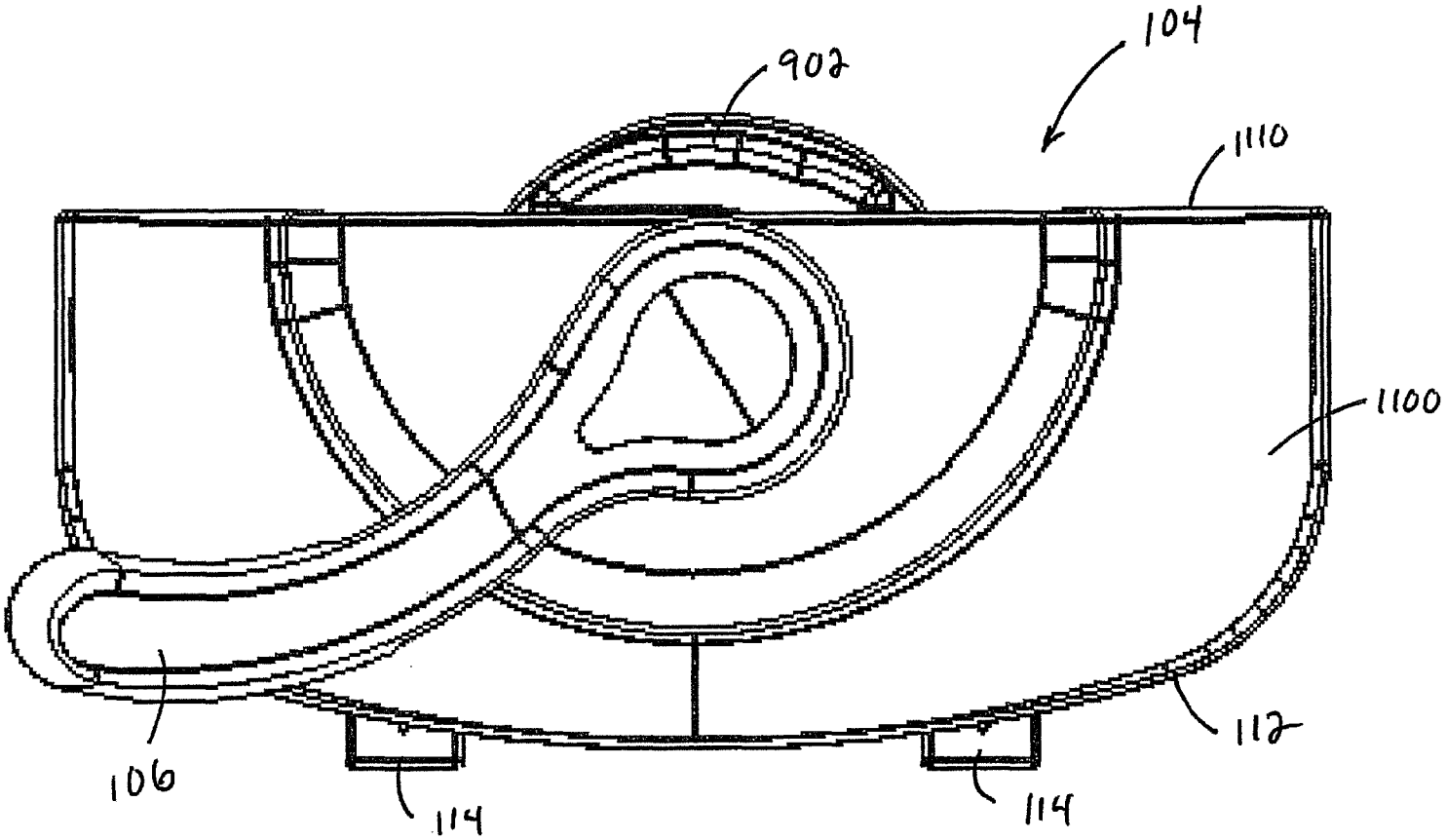
FIG. 8F is a top view of the sash lock illustrated by FIG. 8A.
Figure 8G:
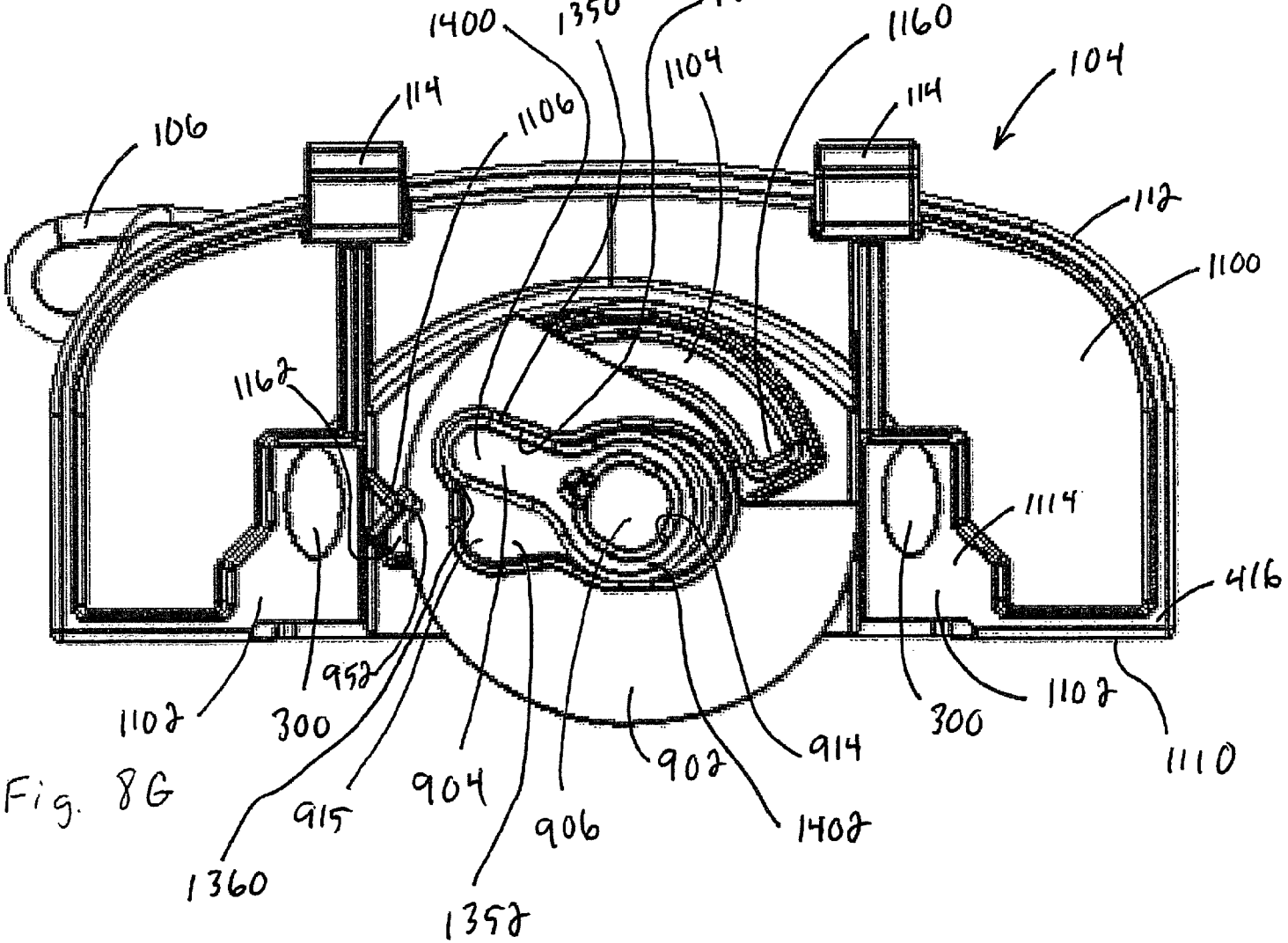
FIG. 8G is a bottom view of the sash lock illustrated by FIG. 8A.

When the handle 106 is initially in the open or unlocked position, the drive leg is in the rotation zone 1350 and the cam projection 950 positioned at a start 1160 (See FIG. 11C) of the cam track 1104. As the handle is rotated toward the closed position, the drive leg 1400 engages a shoulder 1360 between the rotation zone 1350 and the locking zone 1352 (See FIG. 8G). The cam projection 950 in the cam track 1104 prevent the drive leg 1400 from forcing the cam member 902 laterally as the handle moves from the open position toward the closed position. When the cam projection 950 reaches an end 1162 of the cam track 1104, the end 1162 prevents further rotation of the cam member 902, but allows lateral movement of the cam member due to a lateral extension 1163 (See FIG. 11C). When the cam projection 950 is at the end 1162 of the track 1104, the recess 952 is aligned with the cam locking projection 1106 (See FIG. 8G). Further movement of the handle to the locked position causes the drive leg 1400 to move into the locking zone 1352 and move the cam member 902 laterally, such that the recess 952 engages the cam locking projection 1106. This engagement prevents the lock from being unlocked unless the handle is directly engaged to move the handle from the locked position to the unlocked position.

When the handle 106 is initially in the closed or locked position, the drive leg 1400 is in the locking zone 1352, the recess 952 engages the cam locking projection 1106, and the projection 950 is at the end 1162 of the track. Initial movement of the handle 105 from the locked position toward the open position moves the cam member 902 laterally, such that the recess 952 becomes spaced apart from the cam locking projection 1106. Further movement of the handle 106 from the locked position to the open position causes the drive leg 1400 to move from the locking zone 1352 to the rotation zone 1350. Further movement of the handle 106 from the locked position toward the open position causes the drive leg to engage a wall 1370 of the rotation zone 1350. Continued movement of the handle to the open position rotates the cam member 902 to clear the keeper.

The keeper 204 can take a wide variety of different forms and can be mounted to the bottom component 202 of the upper sash frame in a wide variety of different ways. FIGS. 1A-1E and 2A-2C illustrate exemplary embodiments of locking arrangements with two different types of keepers 204. In the example illustrated by FIGS. 1A-1E, mounting screws 160 used to secure the keeper to the bottom component 202 of the upper sash frame are vertically oriented. In the example illustrated by FIGS. 2A-2C, the mounting screws 160 are horizontally oriented. In each of these illustrated embodiments, the profile of the keeper matches the profile of the sash lock 104.

Figure 6A:
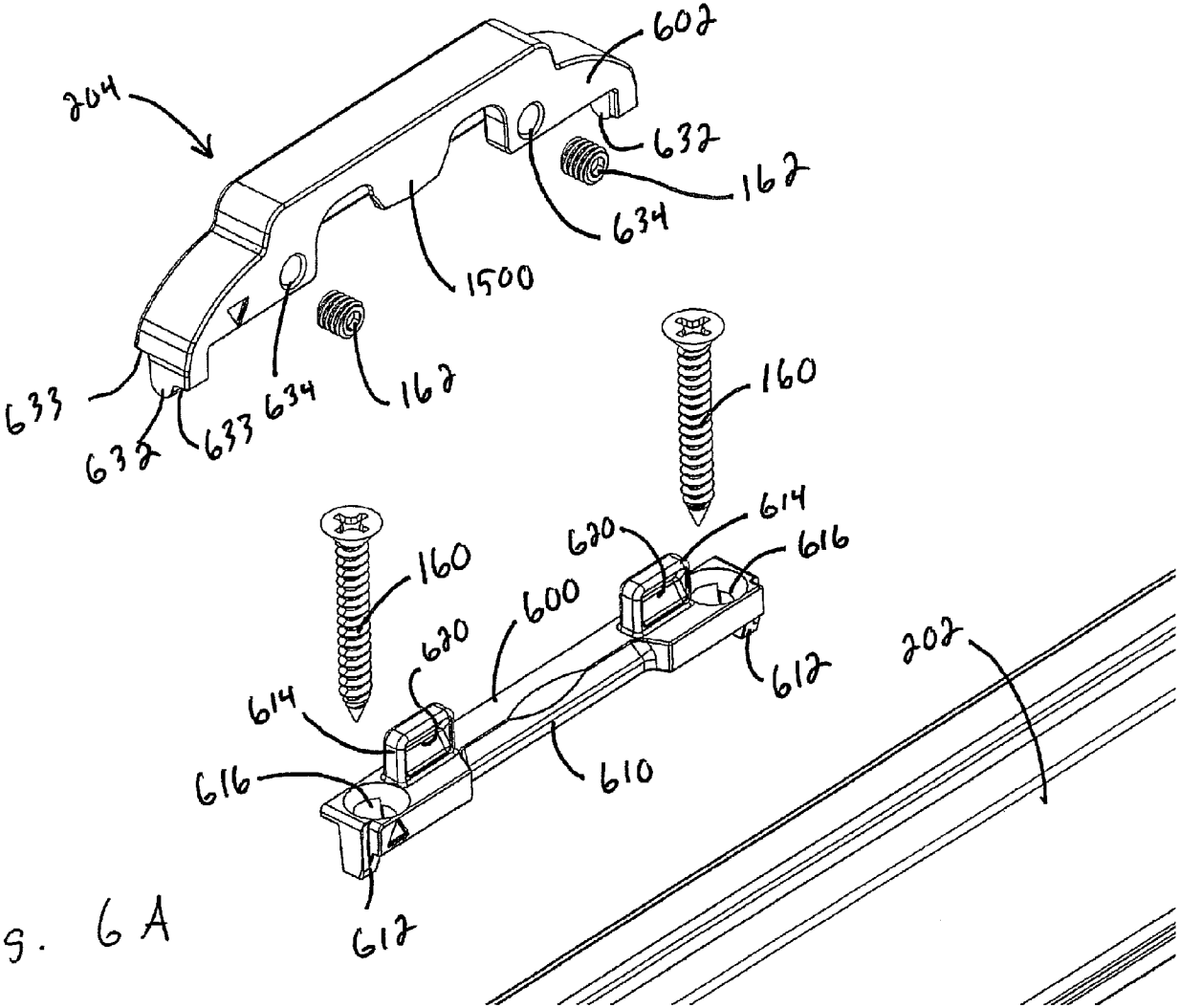
FIG. 6A is an exploded perspective view illustrating assembly of the keeper assembly and window sash component illustrated by FIG. 5A.
Figure 6B:
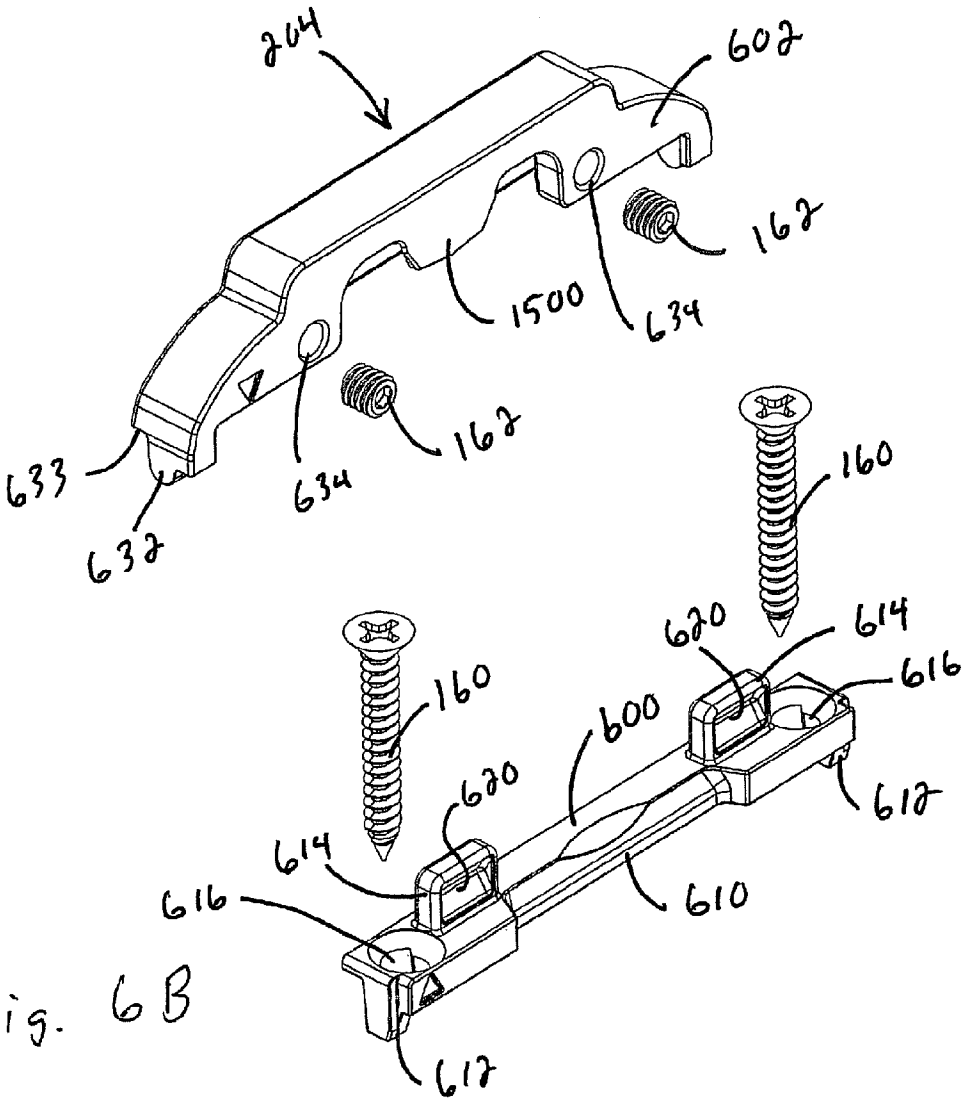
FIG. 6B is an exploded perspective view similar to FIG. 6A with the window sash component removed.

Referring to FIGS. 1A-1E and 5A-5D, in one exemplary embodiment, the keeper 202 is mounted to the bottom component 202 of the upper sash with vertical mounting screws 160. The illustrated keeper 204 includes a base 600 and a cover 602. The base 600 may take a wide variety of different forms. For example, the base 600 may be any structure that connects to the bottom component 202 and facilitates connection of the cover 602. Referring to FIG. 6A, in the illustrated embodiment, the base 600 includes a main body 610, support legs 612 (See FIG. 6A), mounting tabs 614, and mounting holes 616. The support legs 612 are sized to closely fit within the groove 201 of the lower sash bottom component 202 with the main body 610 resting on top of walls 203 that define the groove 201. In the illustrated embodiment, the walls 203 are offset and the bottom surface of the base 600 is stepped to match the top walls 203. The base 600 is secured to the sash component 202 by the mounting screws 160 that extend through the mounting holes 616. The illustrated configuration of the base 600 and the walls that define the channel allow the position of the keeper 204 to be adjusted along the bottom component before the position of the base is fixed with the fasteners 160. The mounting tabs 614 extend upward from the base 600 and include cover mounting recesses 620.

The cover 602 may take a wide variety of different forms. For example, the cover 602 may be any structure that connects to the base 600 and provides a keeper projection 1500. In the illustrated embodiment, the cover 602 includes stabilizing legs 632 and mounting holes 634. The cover 602 is sized to fit over the mounting tabs 612 of the base 600. The cover 602 may snugly fit over the mounting tabs 614 or clearance may be provided to allow for some lateral adjustment of the cover 602 relative to the base. For example, the cover 602 and tabs 614 may provide between 1/16" and 1/4" of lateral adjustability. In one exemplary embodiment, the cover 602 and tabs 614 provide 1/8" of lateral adjustability.

The stabilizing legs 632 are sized to closely fit within the groove 201 of the upper sash bottom component 202 with sides 633 of the cover 602 resting on top of the walls 203 that define the groove 201. The cover 602 is secured to the base 600 by set screws 162 that thread into the mounting holes 634 and engage the mounting tabs 614 in the cover mounting recesses 620. The illustrated configuration where the recesses 620 are wider than the set screws 162 allows the position of the cover 602 to be adjusted along the base 600 before the position of the cover is fixed with the set screws 162. For example, the set screws 162 and tabs 614 may provide between 1/16" and 1/4" of lateral adjustability. In one exemplary embodiment, the set screws 162 and tabs 614 provide 1/8" of lateral adjustability.

Referring to FIGS. 2A-2C and 7A-7C, in one exemplary embodiment, a keeper 704 is mounted to the bottom component 202 of the upper sash with horizontal mounting screws 160. The illustrated keeper 204 includes a mounting portion 705 and a latching portion 706. The mounting portion 705 may take a wide variety of different forms. For example, the mounting portion 705 may be any structure that connects to the bottom component 202. In the illustrated embodiment, the mounting portion 705 is rectangular with mounting holes 716. The mounting portion 705 is sized to closely fit within the groove 201 of the lower sash bottom component 202 with the latching portion 706 resting on top of wall 209 that defines one side of the groove 201. The mounting portion 705 is secured to the sash component 202 by the mounting screws 160 that extend through the mounting holes 716 and into the bottom component (See FIG. 7C). Optional clearance holes 717 may be provided in wall 209 or the mounting screws 170 may be driven through a wall 209, pass through the mounting holes 716 and be driven into the wall 211 that defines the second side of the groove 207. However, the bottom component 202 may have a wide variety of different configurations. The illustrated configuration of the mounting portion 705 allows the position of the keeper 204 to be adjusted along the bottom component 202 before the position of the base is fixed with the fasteners 170. The latching portion 706 may take a wide variety of different forms. For example, the latching portion may be integrally formed with the mounting portion 705 and provide a keeper projection 1500.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, hardware, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative apparatus, and illustrative examples shown and described. Accordingly, departures can be made from such details without departing from the spirit or scope of the applicant's general inventive concept.

The invention claimed is:

1. A sash lock assembly comprising:

a window sash frame component of a window sash configured to be slidably mounted in a window frame;

a sash lock having a sash lock body mounted on a top surface of the window sash frame component, wherein the sash lock body includes a bottom surface abutting the top surface of the window sash frame component, a rear surface extending from and substantially perpendicular to the bottom surface, and at least one angled fastener passage formed in the sash lock body between the bottom surface and the rear surface, and at angle with respect to the bottom surface; and at least one fastener installed from the rear surface of the sash lock body, through the at least one angled fastener passage, and into the top surface of the window sash frame component to secure the sash lock body to the window sash frame component, so that when a surface of the sash lock body opposite the rear surface is viewed, the at least one fastener is concealed from view by the sash lock body without applying an additional cover.

2. The sash lock assembly of claim 1 wherein said at least one angled fastener passage is aligned with at least one fastener securing passage formed in the top surface of the window sash frame component.

3. The sash lock assembly of claim 1 wherein the sash lock body further comprises at least one mounting projection that fits within at least one opening in the top surface of the window sash frame component.

4. The sash lock assembly of claim 3 wherein the at least one mounting projection comprises a flange that is offset from the bottom surface of the sash lock body.

5. The sash lock assembly of claim 4 wherein the offset of the at least one flange from the bottom surface of the sash lock body corresponds to a thickness of a top wall of the window sash frame component.

6. The sash lock assembly of claim 3 wherein the at least one mounting projection comprises a hook that is offset from the bottom surface of the sash lock body.

7. The sash lock assembly of claim 4 wherein the offset of the at least one hook from the bottom surface of the sash lock body is configured such that the hook engages a bottom edge formed in a top wall of the window sash frame component by the opening.

8. The sash lock assembly of claim 1 wherein the window sash frame component is hollow with a reinforcement member disposed inside the window sash frame component, wherein a top surface of the reinforcement member is spaced apart from a bottom surface of a top wall of the window sash frame component.

9. The sash lock assembly of claim 8 wherein the sash lock body further comprises at least one mounting projection that fits within at least one opening in the top surface of the window sash frame component, wherein the at least one mounting projection comprises a flange that is offset from the bottom surface of the sash lock body and clears the top surface of the reinforcement member.

10. The sash lock assembly of claim 8 wherein the sash lock body further comprises at least one mounting projection that fits within at least one opening in the top surface of the window sash frame component, wherein the at least one mounting projection comprises a hook that is configured to engage a bottom edge formed in a top wall of the window sash frame component by the opening and clear the top surface of the reinforcement member.

11. The sash lock assembly of claim 1 wherein the sash lock body is attached to the window sash frame component of the window sash, the sash lock assembly further comprising a window sash frame component of a second window sash and a keeper attached to the window sash frame component of the second window sash.

12. The sash lock assembly of claim 11 wherein the keeper includes legs that fit within a groove in the window sash frame component of the second window sash.

13. The sash lock assembly of claim 11 wherein the keeper includes a base and a cover, wherein the cover is connected to the base such that the cover is laterally adjustable relative to the base.

14. The sash lock assembly of claim 13 wherein the base includes at least one recess that accepts at least one set screw, wherein said at least one recess is wider than said at least one set screw to allow said lateral adjustment.

15. A sash lock assembly comprising:

a window sash frame component of a window sash configured to be slidably mounted in a window frame;

at least one opening in a top surface of the window sash frame component;

a sash lock having a sash lock body mounted on top surface of the window sash frame component, wherein the sash lock body comprises at least one mounting projection that fits within the at least one opening in the top surface of the window sash frame component;

the sash lock body further comprises a bottom surface abutting the top surface of the window sash frame component, a rear surface extending from and substantially perpendicular to the bottom surface, and at least one angled fastener passage formed in the sash lock body between the bottom surface and the rear surface, and at angle with respect to the bottom surface; and at least one fastener installed from the rear surface of the sash lock body, through the at least one fastener passage, and into the top surface of the window sash frame component to secure the sash lock body to the window sash frame component.

16. A sash lock assembly comprising:

a first window sash frame component of a first window sash configured to be slidably mounted in a window frame;

at least one opening in a top surface of the first window sash frame component;

a sash lock having a sash lock body mounted on a top surface of the window sash frame component, wherein the sash lock body includes a bottom surface abutting the top surface of the first window sash frame component, a rear surface extending from and substantially perpendicular to the bottom surface, and at least one angled fastener passage formed in the sash lock body between the bottom surface and the rear surface, and at angle with respect to the bottom surface, the sash lock body further comprises at least one mounting projection that fits within the at least one opening in the top surface of the first window sash frame component;

at least one fastener installed from the rear surface of the sash lock body, through the at least one angled fastener passage, and into the top surface of the window sash frame component to secure the sash lock body to the window sash frame component, so that when a surface of the sash lock body opposite the rear surface is viewed, the least one fastener is concealed from view by the sash lock body without applying an additional cover;

a second window sash frame component of a second window sash configured to be mounted in a window frame;

a keeper attached to the second window sash frame component, wherein the keeper includes legs that fit within a groove in the second window sash frame component of the second window sash, wherein the keeper includes a base and a cover, wherein the cover is connected to the base such that the cover is laterally adjustable relative to the base, wherein the base includes at least one recess that accepts at least one set screw, wherein said at least one recess is wider than said at least one set screw to allow said lateral adjustment of the cover with respect to the base.

* * * * *